US009163300B2

(12) United States Patent
Oishi

(10) Patent No.: US 9,163,300 B2
(45) Date of Patent: Oct. 20, 2015

(54) HIGH STRENGTH AND HIGH CONDUCTIVITY COPPER ALLOY PIPE, ROD, OR WIRE

(75) Inventor: Keiichiro Oishi, Tokyo (JP)

(73) Assignee: MITSUBISHI SHINDOH CO., LTD., Tokyo (JP)

( * ) Notice: Subject to any disclaimer, the term of this patent is extended or adjusted under 35 U.S.C. 154(b) by 1300 days.

(21) Appl. No.: 12/808,564

(22) PCT Filed: Feb. 23, 2009

(86) PCT No.: PCT/JP2009/053216

§ 371 (c)(1),
(2), (4) Date: Apr. 11, 2011

(87) PCT Pub. No.: WO2009/119222

PCT Pub. Date: Oct. 1, 2009

(65) Prior Publication Data

US 2011/0174417 A1 Jul. 21, 2011

(30) Foreign Application Priority Data

Mar. 28, 2008 (JP) ..... 2008-087339

(51) Int. Cl.

| | |
|---|---|
| ***C22C 9/00*** | (2006.01) |
| ***C22C 9/02*** | (2006.01) |
| ***C22C 9/06*** | (2006.01) |
| ***C22F 1/08*** | (2006.01) |
| ***H01B 1/02*** | (2006.01) |

(52) U.S. Cl.
CPC ... *C22C 9/02* (2013.01); *C22C 9/06* (2013.01); *C22F 1/08* (2013.01); *H01B 1/026* (2013.01)

(58) Field of Classification Search
None
See application file for complete search history.

(56) References Cited

U.S. PATENT DOCUMENTS

| | | | | |
|---|---|---|---|---|
| 2,074,713 | A | 3/1937 | Tross | |
| 4,073,667 | A | 2/1978 | Caron et al. | |
| 4,260,432 | A | 4/1981 | Plewes | |
| 4,388,270 | A | 6/1983 | Stavish et al. | |
| 4,427,627 | A | 1/1984 | Guerlet et al. | |
| 4,666,667 | A * | 5/1987 | Kamio et al. | 420/471 |
| 5,004,498 | A | 4/1991 | Shimamura et al. | |
| 5,322,575 | A | 6/1994 | Endo et al. | |
| 5,814,168 | A | 9/1998 | Hatakeyama et al. | |
| 6,132,529 | A | 10/2000 | Hatakeyama et al. | |
| 7,608,157 | B2 | 10/2009 | Oishi | |
| 7,928,541 | B2 * | 4/2011 | Miwa et al. | 257/666 |
| 2006/0016528 | A1 * | 1/2006 | Hatakeyama | 148/684 |
| 2006/0260721 | A1 * | 11/2006 | Oishi | 148/433 |
| 2007/0051442 | A1 * | 3/2007 | Yamamoto et al. | 148/684 |
| 2009/0014102 | A1 * | 1/2009 | Hatakeyama | 148/684 |
| 2009/0084473 | A1 | 4/2009 | Aruga et al. | |
| 2010/0008817 | A1 * | 1/2010 | Ando | 420/471 |
| 2010/0047112 | A1 | 2/2010 | Fugono et al. | |
| 2010/0206513 | A1 * | 8/2010 | Hattori et al. | 164/462 |
| 2010/0297464 | A1 * | 11/2010 | Oishi | 428/586 |
| 2011/0056596 | A1 * | 3/2011 | Oishi | 148/680 |
| 2011/0100676 | A1 | 5/2011 | Oishi | |
| 2011/0200479 | A1 | 8/2011 | Mihara et al. | |

FOREIGN PATENT DOCUMENTS

| | | | |
|---|---|---|---|
| CN | 1546701 | A | 11/2004 |
| CN | 1693502 | A | 11/2005 |
| EP | 1630240 | A1 | 3/2006 |
| JP | 60-245753 | A * | 12/1985 |
| JP | 60-245754 | A * | 12/1985 |
| JP | 63-65039 | A | 3/1988 |
| JP | 01-108322 | A | 4/1989 |
| JP | 04-272148 | A | 9/1992 |
| JP | 06-094390 | A | 4/1994 |
| JP | 10-130754 | A | 5/1998 |
| JP | 10-168532 | | 6/1998 |
| JP | 11-097609 | A | 4/1999 |
| JP | 11-256255 | | 9/1999 |
| JP | 2001-214226 | A | 8/2001 |
| JP | 2001-316742 | | 11/2001 |
| JP | 2003-268467 | | 9/2003 |
| JP | 2004-137551 | | 5/2004 |
| JP | 2004-292917 | A | 10/2004 |
| TW | 200417616 | | 9/2004 |
| TW | 200706660 | | 2/2007 |
| WO | 2004/079026 | A1 | 9/2004 |
| WO | 2007-139213 | A1 | 12/2007 |
| WO | 2008/099892 | A1 | 8/2008 |
| WO | 2009/107586 | A1 | 9/2009 |

OTHER PUBLICATIONS

Office Action issued in related Taiwanese application 097143579 on Oct. 24, 2012.
Fundamentals of Rockwell Hardness Testing, www.wilsoninstrumenets.com, 2004, pp. 1-15.
Office Action issued in co-pending related U.S. Appl. No. 12/555,990 on Mar. 27, 2014.
Office Action issued in co-pending related U.S. Appl. No. 12/919,206 on Mar. 12, 2014.
International Search Report issued in corresponding application No. PCT/JP2009/053216 completed May 19, 2009 and mailed May 26, 2009.

(Continued)

*Primary Examiner* — Kiley Stoner
(74) *Attorney, Agent, or Firm* — Griffin & Szipl, P.C.

(57) ABSTRACT

A high strength and high conductivity copper alloy pipe, rod, or wire is composed of an alloy composition containing 0.13 to 0.33 mass % of Co, 0.044 to 0.097 mass % of P, 0.005 to 0.80 mass % of Sn, and 0.00005 to 0.0050 mass % of O, wherein a content [Co] mass % of Co and a content [P] mass % of P satisfy a relationship of $2.9 \leq ([Co]-0.007)/([P]-0.008) \leq 6.1$, and the remainder includes Cu and inevitable impurities. The high strength and high conductivity copper alloy pipe, rod, or wire is produced by a process including a hot extruding process. Strength and conductivity of the high strength and high conductivity copper pipe, rod, or wire are improved by uniform precipitation of a compound of Co and P and by solid solution of Sn.

32 Claims, 11 Drawing Sheets

(56) References Cited

OTHER PUBLICATIONS

J.R. Davies (ed.), ASM Specialty Handbook Copper and Copper Alloys 8-9 (ASM International), filed as Exhibit A in related application.
J.R. Davies (ed.), ASM Specialty Handbook Copper and Copper Alloys 243-247 (ASM International 2001), filed as Exhibit D in related application.
Data Sheet No. A 6 Cu-DHP, Consel International Pour Le Developpement Du Cuivre, pp. 1, 2 and 4 (1968), submitted in a related application as Exhibit B.
Copper Parts Data Book, pp. 88 and 94 (1997), submitted in a related application as Exhibit C.
International Search Report issued in related application PCT/JP2009/071599, completed Mar. 19, 2010 and mailed Apr. 6, 2010.
Table 1, comporsitions and elemental relationships of sample alloy Nos. 5-11, and Table 2, experimental results of alloy Nos. 55-61, submitted in related U.S. Appl. No. 12/555,990 as Exhibit A.
International Search Report issued in related application PCT/JP2008/070410, completed Jan. 23, 2009 and mailed Feb. 10, 2009.
Restriction Election issued in co-pending related U.S. Appl. No. 13/144,034 on Apr. 18, 2012.
Espacenet English Abstract of JP 10-130754 (filed as Exhibit A1 in related U.S. Appl. No. 12/555,990), modified 2011.
Definition of Tensile Strength, at http://metals.about.com/library/bldef-Tensile-Strength.htm (2002), (filed as Exhibit A2 in related U.S. Appl. No. 12/555,990).
"Definition of Hardness," at http://metals.about.com/library/bldef-Hardness.htm (2002), (filed as Exhibit A3 in related U.S. Appl. No. 12/555,990).
"Definition of Proof Stress," at http://metals.about.com/library/bldef-Proof-Stress.htm (2002), (filed as Exhibit A4 in related U.S. Appl. No. 12/555,990).
Pierre Leroux, Breakthrough Indentation Yield Strength Testing (Nanovea 2011), (filed as Exhibit A5 in related U.S. Appl. No. 12/555,990).
Copper and Copper Alloys of the ASM Specialty Handbook®, p. 454 (filed as Exhibit A6 in related U.S. Appl. No. 12/555,990).
Copper and Copper Alloys of the ASM Specialty Handbook®, pp. 3 and 4 (filed as Exhibit A7 in related U.S. Appl. No. 12/555,990).
Standards Handbook: Part 2—Alloy Data, Wrought Copper and Copper Alloy Mill Products 34 and 38 (Copper Development Association, Inc. 1985), (filed as Exhibit A8 in related U.S. Appl. No. 12/555,990).
Yield Strength—Strength(Mechanics) of Materials, at http://www.engineersedge.com/material_science/yield_strength.htm (downloaded Apr. 18, 2012), two pages.
J.R. Davies (ed.), ASM Specialty Handbook Copper and Copper Alloys 8-9 (ASM International), filed as Exhibit A in related U.S. Appl. No. 13/514,680.
E. Paul Degarmo et al., Materials and Processes in Manufacturing 402-404, 432-434, 989-998 (John Wiley & Sons, Inc. 2003).
Office Action issued in related Canadian application 2,706,199 on Dec. 2, 2011.
Office Action issued in co-pending related U.S. Appl. No. 12/555,990 on Apr. 14, 2011.
Office Action issued in co-pending related U.S. Appl. No. 13/144,034 on Apr. 26, 2013.
E. Paul Degarmo et al., Materials and Processes in Manufacturing 383-384 (9th ed. 2003), filed in a related application as Exhibit Al.
Copper Parts Data Book, pp. 88 and 94 (1997).
Copper and Copper Alloys, ASM Specialty Handbook, pp. 3-4, and 454 (2001).
1994 Annual Book of ASTM Standards, vol. 02.01, 480-486 and 514-521 (1994), filed in a related application Exhibit A1.
Taiwanese office action issued in related matter 099100411 on Oct. 22, 2013.
Office Action issued in co-pending U.S. Appl. No. 13/144,057 on Sep. 8, 2014.
Office Action issued in co-pending related U.S. Appl. No. 13/144,057 on Feb. 25, 2015.
ASM Specialty Handbook, Copper and Copper Alloys, 2001, p. 521, filed herewith as Exhibit C.

* cited by examiner

PRODUCING PROCESS P

PRODUCING PROCESS Q

PRODUCING PROCESS R

Alloy No. 11 Process K3 Transmission Electron Image

Alloy No. 11 Transmission Electron Image of Precipitated Grains after Heating at 700° C for 120 seconds in Compression-Processed Material in Process K0
Average Grain Diameter 4.6 mm

HIGH STRENGTH AND HIGH CONDUCTIVITY COPPER ALLOY PIPE, ROD, OR WIRE

This is a National Phase Application in the United States of International Patent Application No. PCT/JP2009/053216 filed Feb. 23, 2009, which claims priority on Japanese Patent Application No. 2008-087339, filed Mar. 28, 2008. The entire disclosures of the above patent applications are hereby incorporated by reference.

TECHNICAL FIELD

The present invention relates to a high strength and high conductivity copper alloy pipe, rod, or wire produced by processes including a hot extruding process.

BACKGROUND ART

Copper having excellent electrical and thermal conductivity has been widely used in various kinds of industrial field as connectors, relays, electrodes, contact points, trolley lines, connection terminals, welding tips, rotor bars used in motors, wire harnesses, and wiring materials of robots or airplanes. For example, copper has been used for wire harnesses of cars, and weights of the cars need to be reduced to improve fuel efficiency regarding global warming. However, the weights of used wire harnesses tend to increase according to high information, electronics, and hybrids of the car. Since copper is expensive metal, the car manufacturing industry wants to reduce the amount of copper to be used in view of the cost. For this reason, if a copper wire for a wire harness which has high strength, high conductivity, flexibility, and excellent ductility is used, it becomes possible to reduce the amount of copper to be used thereby allow achieving a reduction in weight and cost.

There are several kinds of wire harnesses, for example, a power system and a signal system in which only very little current flows. For the former, conductivity close to that of pure copper is required as the first condition. For the later, particularly, high strength is required. Accordingly, a copper wire balanced in strength and conductivity is necessary according to purposes. Distribution lines and the like for robots and airplanes are required to have high strength, high conductivity, and flexibility. In such distribution lines, there are many cases of using a copper wire as a stranded wire including several or several tens of thin wires in structure to further improve flexibility. In this specification, a wire means a product having a diameter or an opposite side distance less than 6 mm. Even when the wire is cut in a rod shape, the cut wire is called a wire. A rod means a product having a diameter or an opposite side distance of 6 mm or more. Even when the rod is formed in a coil shape, the coil-shaped rod is called a rod. Generally, a material having a large outer diameter is cut in a rod shape, and a thin material comes out into a coil-shaped product. However, when a diameter or an opposite side distance is 4 to 16 mm, there are wires and rods together. Accordingly, they are defined herein. A general term of a rod and a wire is a rod wire.

A high strength and high conductivity copper alloy pipe, rod, or wire (hereinafter, referred to as a high performance copper pipe, rod, or wire) according to the invention requires the following characteristics according to usage.

Thinning on the male side connector and a bus bar is progressing according to reduction in size of the connector, and thus strength and conductivity capable of standing against putting-in and drawing-out of the connector is required. Since a temperature rises during usage, a stress relaxation resistance is necessary.

In a relay, an electrode, a connector, a buss bar, a motor, and the like, in which large current flows, high conductivity is naturally required and also high strength is necessary for compact size or the like.

In a wire for wire cut (electric discharging), high conductivity, high strength, wear resistance, high-temperature strength, and durability are required.

In a trolley line, high conductivity and high strength are required, and durability, wear resistance, and high-temperature strength are also required during usage. Generally, since there are many trolley lines having a diameter of 20 mm, the trolley lines fall within the scope of rod in this specification.

In a welding tip, high conductivity, high strength, wear resistance, high-temperature strength, durability, and high thermal conductivity are required.

In the viewpoint of high reliability, soldering is not used, but brazing is generally used for connection among electrical members, among high-speed rotating members, among members with vibration such as a car, and among copper materials and nonferrous metal such as ceramics. As a brazing material, for example, there is 56Ag-22Cu-17Zn-5Sn alloy brazing such as Bag-7 described in JIS Z 3261. As a temperature of the brazing, a high temperature of 650 to 750° C. is recommended. For this reason, in a rotor bar used in a motor, an end ring, a relay, an electrode, or the like, heat resistance for 700° C. as a brazing temperature is required even for a short time. Naturally, it is used electrically, and thus high conductivity is required even after the brazing. Centrifugal force of the rotor bar used in a motor is increased by high speed, and thus strength for standing against the centrifugal force is necessary. In an electrode, a contact point, a relay which is used in a hybrid car, an electric car, and a solar battery and in which high current flows, high conductivity and high strength are necessary even after the brazing.

Electrical components, for example, a fixer, a brazing tip, a terminal, an electrode, a relay, a power relay, a connector, a connection terminal, and the like are manufactured from rods by cutting, pressing, or forging, and high conductivity and high strength are required. In the brazing tip, the electrode, and the power relay, additionally, wear resistance, high-temperature strength, and high thermal conductivity are required. In these electrical components, brazing is often used as bonding means. Accordingly, heat resistance for keeping high strength and high conductivity even after high-temperature heating at, for example, 700° C. is necessary. In this specification, heat resistance means that it is hard to be recrystallized even by heating at a high temperature of 500° C. or higher and strength after the heating is excellent. In mechanical components such as nuts or metal fittings of faucets, a pressing process and a cold forging process are performed. An after-process includes rolling and cutting. Particularly, formability in cold, forming easiness, high strength, and wear resistance are necessary, and it is required that there is no stress corrosion cracking. In addition, there are many cases of employing the brazing for connecting pipes or the like, and thus high strength after the brazing is required.

In copper materials, pure copper based on C1100, C1020, and C1220 having excellent conductivity has low strength, and thus a using amount thereof is increased to widen a sectional area of a used part. In addition, as high strength and high conductivity copper alloy, there is Cr—Zr copper (1% Cr-0.1% Zr—Cu) that is solution-aging precipitation alloy. However, this alloy is made into a rod, generally through a heat treatment process of hot extruding, heating of materials at 950° C. (930 to 990° C.) again, rapid cooling just thereafter, and aging, and then it is additionally processed in various shapes. A product is made through a heat treatment process of a plasticity process such as hot or cold forging of an extruded rod after hot extruding, heating at 950° C. after the plasticity process, rapid cooling, and aging. As described above, the high temperature process such as at 950° C. requires large energy. In addition, since oxidation loss occurs by heating in the air and diffusion easily occurs due to the high temperature, sticking among materials occurs and thus a pickling process is necessary. For this reason, a heat treatment at 950° C. in inert gas or vacuum is performed, but a cost for the heat treatment is increased and extra energy is necessary. In addition although it is possible to prevent the oxidation loss, the problem of the sticking is not solved. In Cr—Zr copper, a scope of a solution temperature condition is narrow, and sensitivity of a cooling rate is high. Accordingly, a particular management is necessary. Moreover, Cr—Zr copper includes a large amount of active Zr and Cr, and thus there is a limitation in casting and forging. As a result, characteristics are excellent, but costs are increased.

A copper material that is an alloy composition containing 0.15 to 0.8 mass % of Sn and In in total and the remainder including Cu and inevitable impurities, has been known (e.g., Japanese Patent Application Laid-Open No. 2004-137551). However, strength is insufficient in such a copper material.

DISCLOSURE OF THE INVENTION

The present invention has been made to solve the above-described problems, and an object of the invention is to provide a low-cost, high-strength and high-conductivity copper alloy pipe, rod, or wire having high strength and high conductivity.

According to a first aspect of the invention to achieve the object, there is provided a high strength and high conductivity copper alloy pipe, rod, or wire produced by a process including a hot extruding process, which is an alloy composition containing: 0.13 to 0.33 mass % of Co; 0.044 to 0.097 mass % of P; 0.005 to 0.80 mass % of Sn; and 0.00005 to 0.0050 mass % of O, wherein a content [Co] mass % of Co and a content [P] mass % of P satisfy a relationship of $2.9 \leq ([Co]-0.007)/([P]-0.008) \leq 6.1$, and the remainder includes Cu and inevitable impurities.

According to the invention, strength and conductivity of the high strength and high conductivity copper alloy pipe, rod, or wire are improved by uniformly precipitating a compound of Co and P and by solid solution of Sn, and a cost thereof is reduced since it is produced by the hot extruding process.

According to another aspect of the invention, there is provided a high strength and high conductivity copper alloy pipe, rod, or wire produced by a process including a hot extruding process, which is an alloy composition containing: 0.13 to 0.33 mass % of Co; 0.044 to 0.097 mass % of P; 0.005 to 0.80 mass % of Sn; 0.00005 to 0.0050 mass % of O; and at least any one of 0.01 to 0.15 mass % of Ni and 0.005 to 0.07 mass % of Fe, wherein a content [Co] mass % of Co, a content [Ni] mass % of Ni, a content [Fe] mass % of Fe, and a content [P] mass % of P satisfy a relationship of $2.9 \leq ([Co]+0.85\times[Ni]+0.75\times[Fe]-0.007)/([P]-0.008) \leq 6.1$ and a relationship of $0.015 \leq 1.5\times[Ni]+3\times[Fe] \leq [Co]$, and the remainder includes Cu and inevitable impurities.

With such a configuration, precipitates of Co, P, and the like become fine by Ni and Fe, thereby improving strength and heat resistance for the high strength and high conductivity copper alloy pipe, rod, or wire.

In the high strength and high conductivity copper alloy pipe, rod, or wire, it is preferable to further include at least any one of Zn of 0.003 to 0.5 mass %, Mg of 0.002 to 0.2 mass %, Ag of 0.003 to 0.5 mass %, Al of 0.002 to 0.3 mass %, Si of 0.002 to 0.2, Cr of 0.002 to 0.3 mass %, Zr of 0.001 to 0.1 mass %. With such a configuration, S mixed in the course of recycling a Cu material is made harmless by Zn, Mg, Ag, Al, Si, Cr, and Zr, intermediate temperature embrittlement is prevented, and the alloy is further strengthened, thereby improving ductility and strength of the high strength and high conductivity copper alloy pipe, rod, or wire.

In the high strength and high conductivity copper alloy pipe, rod, or wire, it is preferable that a billet be heated to 840 to 960° C. before the hot extruding process, and an average cooling rate from 840° C. after the hot extruding process or a temperature of an extruded material to 500° C. is 15° C./second or higher, and it is preferable that a heat treatment TH1 at 375 to 630° C. for 0.5 to 24 hours be performed after the hot extruding process, or is performed before and after the cold drawing/wire drawing process or during the cold drawing/wire drawing process when a cold drawing/wire drawing process is performed after the hot extruding process. With such a configuration, an average grain size is small, and precipitates are finely precipitated, thereby improving strength for the high strength and high conductivity copper alloy pipe, rod, or wire.

In the high strength and high conductivity copper alloy pipe, rod, or wire, it is preferable that substantially circular or substantially oval fine precipitates be uniformly dispersed, and it is preferable that an average grain diameter of the precipitates be between 1.5 and 20 nm, or at least 90% of the total precipitates have a size of 30 nm or less. With such a configuration, fine precipitates are uniformly dispersed. Accordingly, strength and heat resistance are high, and conductivity is satisfactory.

In the high strength and high conductivity copper alloy pipe, rod, or wire, it is preferable that an average grain size at the time of completing the hot extruding process be between 5 and 75 μm. With such a configuration, the average grain size is small, thereby improving strength for the high strength and high conductivity copper alloy pipe, rod, or wire.

In the high strength and high conductivity copper alloy pipe, rod, or wire, it is preferable that when a total processing rate of the cold drawing/wire drawing process until the heat treatment TH1 after the hot extruding process is higher than 75%, a recrystallization ratio of matrix in a metal structure after the heat treatment TH1 be 45% or lower, and an average grain size of a recrystallized part be 0.7 to 7 μm. With such a configuration, when the total cold working processing rate of the cold drawing/wire drawing process after the hot extruding process to the precipitation heat treatment process is higher than 75% in a thin wire, a thin rod, and a thin pipe, the recrystallization ratio of matrix in the metal structure after the precipitation heat treatment process is 45% or lower. When the average grain size of the recrystallized part is 0.7 to 7 μm, ductility, a repetitive bending property is improved without decreasing the final strength of the high strength and high conductivity copper alloy pipe, rod, or wire.

In the high strength and high conductivity copper alloy pipe, rod, or wire, it is preferable that a ratio of (minimum tensile strength/maximum tensile strength) in variation of tensile strength in an extruding production lot be 0.9 or higher, and a ratio of (minimum conductivity/maximum conductivity) in variation of conductivity is 0.9 or higher. With such a configuration, the variation of tensile strength and conductivity is small, thereby improving quality of the high strength and high conductivity copper alloy pipe, rod, or wire.

In the high strength and high conductivity copper alloy pipe, rod, or wire, it is preferable that conductivity be 45 (% IACS) or higher, and a value of ($R^{1/2}$×S×(100+L)/100) be 4300 or more, where R (% IACS) is conductivity, S ($N/mm^2$) is tensile strength, and L (%) is elongation. With such a configuration, the value of ($R^{1/2}$×S×(100+L)/100) is 4300 or more, and a balance between strength and conductivity is excellent. Accordingly, it is possible to reduce the diameter or thickness of the pipe, rod, or wire, and thus it is possible to reduce a cost.

In the high strength and high conductivity copper alloy pipe, rod, or wire, it is preferable that tensile strength at 400° C. be 200 ($N/mm^2$) or higher. With such a configuration, high-temperature strength is high, and thus it is possible to use the pipe, rod, or wire under a high temperature.

In the high strength and high conductivity copper alloy pipe, rod, or wire, it is preferable that Vickers hardness (HV) after heating at 700° C. for 120 seconds be 90 or higher or at least 80% of the Vickers hardness before the heating, an average grain diameter of precipitates in a metal structure after the heating be 1.5 to 20 nm or at least 90% of the total precipitates have a size of 30 nm or less, and a recrystallization ratio in the metal structure after the heating be 45% or lower. With such a configuration, heat resistance is excellent, and thus it is possible to process and use the pipe, rod, or wire in a circumstance under a high temperature. In addition, decrease in strength is small after processing for a short time under a high temperature. Accordingly, it is possible to reduce the diameter or thickness of the pipe, rod, or wire, and thus it is possible to reduce the cost.

In the high strength and high conductivity copper alloy pipe, rod, or wire, it is preferable that the pipe, rod, or wire be used for cold forging or pressing. Since fine precipitates are uniformly dispersed by cold forging or pressing, strength becomes high and conductivity becomes satisfactory by process hardening. In addition, even in a press product and a forged product, high strength is kept in spite of exposure to a high temperature.

In the high strength and high conductivity copper alloy pipe, rod, or wire, it is preferable that a cold wire drawing process or a pressing process be performed, and a heat treatment TH2 at 200 to 700° C. for 0.001 seconds to 240 minutes be performed during the cold wire drawing process or the pressing process and/or after the cold wire drawing process or the pressing process. With such a configuration, flexibility and conductivity of the wire are excellent. Particularly, ductility, flexibility, and conductivity become low when a cold working processing rate is increased by wire drawing, pressing, or the like, but ductility, flexibility, and conductivity are improved by performing the heat treatment TH2. In this specification, good flexibility means that bending can be repeated more than 18 times in case of a wire having an outer diameter of 1.2 mm.

BEST MODE FOR CARRYING OUT THE INVENTION

Figure 1:
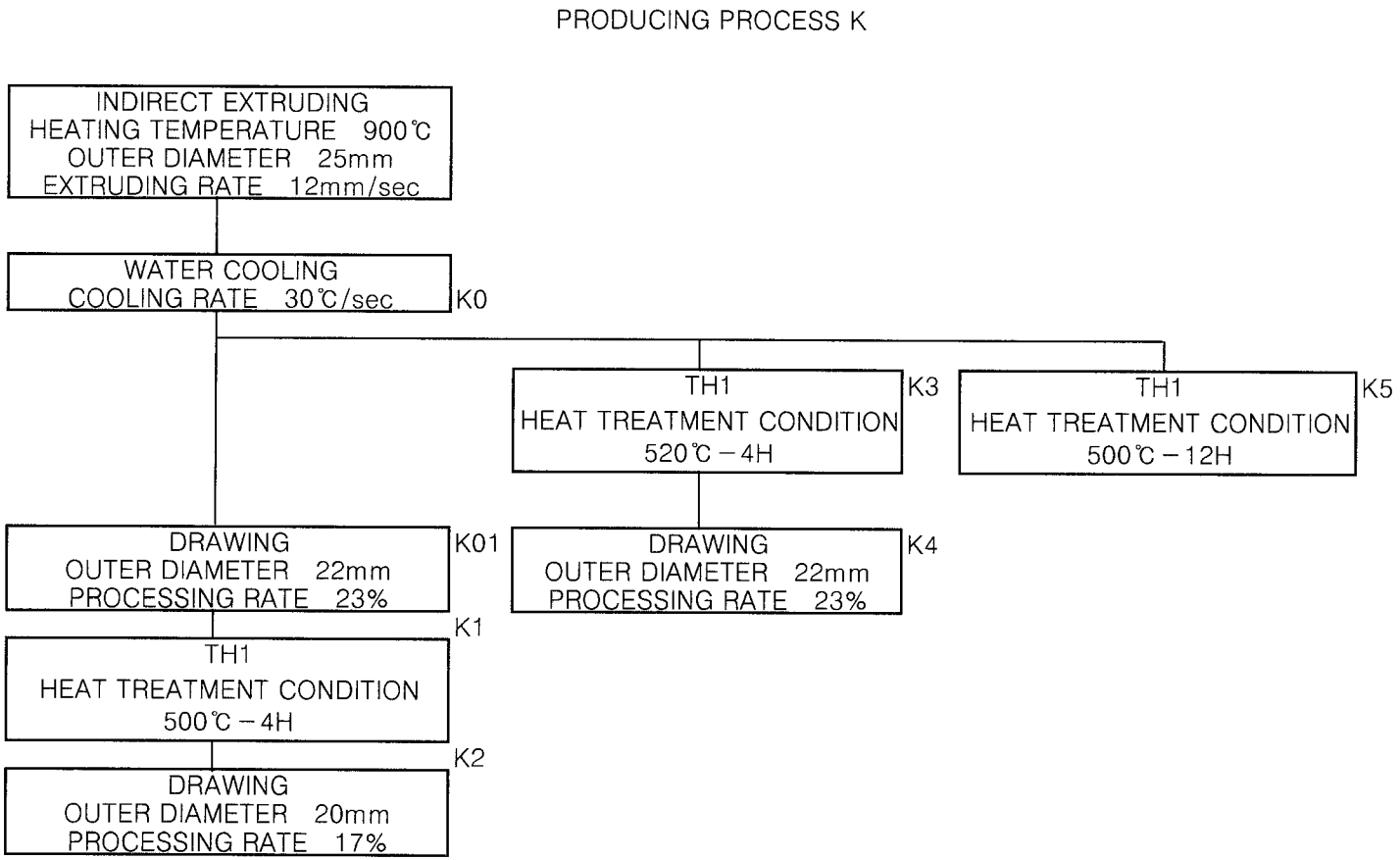
FIG. 1 is a flowchart of a producing process K of a high performance copper pipe, rod, or wire according to an embodiment of the invention.

A high performance copper pipe, rod, or wire according to an embodiment of the invention will be described. In the invention, a first invention alloy, a second invention alloy, and a third invention alloy having alloy compositions in high performance copper pipe, rod, or wire according to first to fourth aspects are proposed. In the alloy compositions described in the specification, a symbol for element in parenthesis such as [Co] represents a content (mass %) of the element. Invention alloy is the general term for the first to third invention alloys.

The first invention alloy is an alloy composition that contains 0.13 to 0.33 mass % of Co (preferably 0.15 to 0.32 mass %, more preferably 0.16 to 0.29 mass %), 0.044 to 0.097 mass % of P (preferably 0.048 to 0.094 mass %, more preferably 0.051 to 0.089 mass %), 0.005 to 0.80 mass % of Sn (preferably 0.005 to 0.70 mass %; more preferably 0.005 to 0.095 mass % in a case where particular high strength is not necessary while high electrical and thermal conductivity is necessary, and further more preferably 0.01 to 0.045 mass %; in a case where strength is necessary, more preferably 0.10 to 0.70 mass %, further more preferably 0.12 to 0.65 mass %, and most preferably 0.32 to 0.65 mass %), and 0.00005 to 0.0050 mass % of O, in which a content [Co] mass % of Co and a content [P] mass % of P satisfy a relationship of X1=([Co]−0.007)/([P]−0.008) where X1 is 2.9 to 6.1, preferably 3.1 to 5.6, more preferably 3.3 to 5.0, and most preferably 3.5 to 4.3, and the remainder including Cu and inevitable impurities.

The second invention alloy has the same composition ranges of Co, P, and Sn as those of the first invention alloy, and is an alloy composition that further contains at least any one of 0.01 to 0.15 mass % of Ni (preferably 0.015 to 0.13 mass %, more preferably 0.02 to 0.09 mass %) and 0.005 to 0.07 mass % of Fe (preferably 0.008 to 0.05 mass %, more preferably 0.012 to 0.035 mass %), in which a content [Co] mass % of Co, a content [Ni] mass % of Ni, a content [Fe] mass % of Fe, and a content [P] mass % of P satisfy a relationship of X2=([Co]+0.85×[Ni]+0.75×[Fe]−0.007)/([P]−0.008) where X2 is 2.9 to 6.1, preferably 3.1 to 5.6, more preferably 3.3 to 5.0, and most preferably 3.5 to 4.3 and a relationship of X3=1.5×[Ni]+3×[Fe], X3 is 0.015 to [Co], preferably 0.025 to (0.85×[Co]), and more preferably 0.04 to (0.7×[Co]), and the remainder including Cu and inevitable impurities.

The third invention alloy is an alloy composition that further contains, in addition to the composition of the first invention alloy or the second invention alloy, at least any one of 0.003 to 0.5 mass % of Zn, 0.002 to 0.2 mass % of Mg, 0.003 to 0.5 mass % of Ag, 0.002 to 0.3 mass % of Al, 0.002 to 0.2 mass % of Si, 0.002 to 0.3 mass % of Cr, and 0.001 to 0.1 mass % of Zr.

Next, a process of producing the high performance copper pipe, rod, or wire will be described. A raw material is melted to cast a billet, and then the billet is heated to perform a hot extruding process, thereby producing a rod, a pipe, a buss bar, a polygonal rod, or a profile bar having a complicated shape in the sectional view. The rod or the pipe is additionally drawn by a drawing process to make the rod and the pipe thin and to make the rod or the pipe into a wire by a wire drawing process (a drawing/wire drawing process is the general term of the drawing process of drawing the rod and the wire drawing process of drawing the wire). Only a hot extruding process may be performed without the drawing/wire drawing process.

A heating temperature of the billet is 840 to 960° C., and an average cooling rate from 840° C. after the extruding or a temperature of the extruded material to 500° C. is 15° C./second or higher. A heat treatment TH1 at 375 to 630° C. for 0.5 to 24 hours may be performed after the hot extruding process. The heat treatment TH1 is mainly for precipitation. The heat treatment TH1 may be performed during the drawing/wire drawing process or after the drawing/wire drawing process and may be performed more than one time. The heat treatment TH1 may be performed after pressing or forging of the rod. In addition, a heat treatment TH2 at 200 to 700° C. for 0.001 seconds to 240 minutes may be performed after the drawing/wire drawing process. The heat treatment TH2 is firstly for restoration of ductility and flexibility of a thin wire, a thin rod, and the like according to the TH1 or those damaged by a high cold working process. The heat treatment TH2 is secondly for heat treatment restoration for restoration of conductivity damaged by the high cold working process, and may be performed more than one time. After the heat treatment, the drawing/wire drawing process may be performed again.

Next, the reason of adding each element will be described. Co is satisfactorily 0.13 to 0.33 mass %, preferably 0.15 to 0.32 mass %, and most preferably 0.16 to 0.29 mass %. High strength, high conductivity, and the like cannot be obtained by independent addition of Co. However, when Co is added together with P and Sn, high strength and high heat resistance are obtained without decreasing thermal and electrical conductivity. The independent addition of Co slightly increases the strength, and does not cause a significant effect. When the content is over the upper limit, the effects are saturated and the conductivity is decreased. When the content is below the lower limit, the strength and the heat resistance do not become high even when Co is added together with P. In addition, the desired metal structure is not formed after the heat treatment TH1.

P is satisfactorily 0.044 to 0.097 mass %, preferably 0.048 to 0.094 mass %, and most preferably 0.051 to 0.089 mass %. When P is added together with Co and Sn, it is possible to obtain high strength and high heat resistance without decreasing thermal and electrical conductivity. The independent addition of P improves fluidity and strength and causes grain sizes to be fine. When the content is over the upper limit, the effects (high strength, high heat resistance) are saturated and the thermal and electrical conductivity is decreased. In addition, cracking easily occurs at the time of casting or extruding. In addition, ductility, particularly, repetitive bending workability is deteriorated. When the content is below the lower limit, the strength and the heat resistance do not become high, and the desired metal structure is not formed after the heat treatment TH1.

When Co and P are added together in the above-described composition ranges, strength, heat resistance, high-temperature strength, wear resistance, hot deformation resistance, deformability, and conductivity become satisfactory. When either of Co and P in the composition is low in content, a significant effect is not exhibited in any of the above-described characteristics. When the content is too large, problems occur such as deterioration of hot deformability, increase of hot deformation resistance, hot process crack, bending process crack, and the like, as in the case of the independent addition of each element. Both Co and P are essential elements to achieve the object of the invention, and improve strength, heat resistance, high-temperature strength, and wear resistance without decreasing electrical and thermal conductivity under a proper combination ratio of Co, P, and the like. As the contents of Co and P are increased within these composition ranges, precipitates of Co and P are increased and all theses characteristics are improved. Co: 0.13% and P: 0.044% are the minimum contents necessary for obtaining sufficient strength, heat resistance, and the like. Both elements of Co and P suppress recrystallized grain growth after the hot extruding, and keep fine grains by an increasing effect with solid-solution of Sn in matrix as described later, without regard to high temperature from the fore end to the rear end of an extruded rod. At the time of heat treatment, the formation of fine precipitates of Co and P significantly contribute to both characteristics of strength and conductivity, followed by recrystallization of matrix having high heat resistance by Sn. However, when Co is more than 0.33% and P 0.097%, improvement of the effects in the characteristics is not substantially recognized, and the above-described defects rather occur.

Only with precipitates mainly based on Co and P, strength is not enough and heat resistance of matrix is not yet sufficient, thereby obtaining no stability. With solid solution of Sn in matrix, the alloy becomes harder with addition of a small amount of Sn of 0.005 mass % or higher. In addition, Sn makes grains of an extruded material hot-extruded at a high temperature fine to suppress grain growth, and thus keeps fine grains at a high temperature after extrusion but before forced cooling. As described above, strength and heat resistance can be improved by solid solution of Sn while slightly sacrificing conductivity. Sn decreases susceptibility of Co, P, and the like to solution. In the high temperature state of forced cooling after the extrusion, and in the course of forced cooling for about 20° C./second, Sn retains most of Co and P in a solid solution state. In addition, at the time of heat treatment, Sn has an effect of dispersing the precipitates, mainly based on Co and P, more finely and uniformly. In addition, there is an effect on wear resistance depending on strength and hardness.

Sn is required to fall within the above-described composition range (0.005 to 0.80 mass %). However, in a case where particularly high strength is not necessary and high electrical and thermal conductivity are necessary, the content is satisfactorily 0.005 to 0.095 mass %, and most preferably 0.01 to 0.045 mass %. The particularly high electrical conductivity means that the conductivity is higher than electrical conductivity 65% IACS of pure aluminum. In the present case, the particularly high electrical conductivity indicates 65% IACS or higher. In case of laying emphasis upon strength, the content is satisfactorily 0.1 to 0.70 mass %, and more satisfactorily 0.32 to 0.65 mass %. Heat resistance is improved by adding a small amount of Sn, thereby making grains of a recrystallized part fine and improving strength, bending workability, flexibility, and impact resistance.

When the content of Sn is below the lower limit (0.005 mass %), strength, bending workability and particularly, heat resistance of matrix deteriorate. When the content is over the upper limit (0.80 mass %), thermal and electrical conductivity is decreased and hot deformation resistance is increased. Accordingly, it is difficult to perform a hot-extruding process at an high extruding ratio. In addition, heat resistance of matrix is rather decreased. Wear resistance depends on hardness and strength, and thus it is preferable to contain a large amount of Sn. When a content of oxygen is over 0.0050 mass %, P and the like are likely to combine with oxygen rather than Co and P. In addition, there are risks of deterioration of ductility and flexibility, and hydrogen embrittlement in high temperature heating. Accordingly, the content of oxygen is necessarily 0.0050 mass % or less.

To obtain high strength and high conductivity as the object of the invention, a combination ratio of Co, Ni, Fe, and P, and size and distribution of precipitates are very important. Diameters of spherical or oval precipitates of Co, Ni, Fe, and P such as $Co_xP_y$, $Co_xNi_yP_x$, and $Co_xFe_yP_x$ are 1.5 to 20 nm, or 90%, preferably at least 95% of the precipitates are 0.7 to 30 nm or 2.5 to 30 nm (30 nm or less), when defined two-dimensionally on a plane surface as an average size of the precipitates like several nm to about 10 nm. The precipitates are uniformly precipitated, thereby obtaining high strength. In addition, precipitates of 0.7 and 2.5 nm is the smallest size capable of being measured with high precision, when observed with 750,000-fold magnification or 150,000-fold magnification using a general transmission electron microscope TEM and its dedicated software. Accordingly, if precipitates having a diameter of less than 0.7 or less than 2.5 nm could be observed and measured, a preferable ratio of precipitates having diameters of 0.7 to 30 nm or 2.5 to 30 nm should be changed. The precipitates of Co, P, and the like improve high-temperature strength at 300° C. or 400° C. required for welding tips or the like. When exposed to a high temperature of 700° C., generation of recrystallized grains is suppressed by the precipitates of Co, P, and the like or by precipitation of Co, P, and the like in the solid solution state, thereby keeping high strength. Most of the precipitates remain and stay fine, thereby keeping high conductivity and high strength. Since wear resistance depends on hardness and strength, the precipitates of Co, P, and the like are effective on wear resistance.

The contents of Co, P, Fe, and Ni have to satisfy the following relationships. Among the content [Co] mass % of Co, the content [Ni] mass % of Ni, the content [Fe] mass % of Fe, and the content [P] mass % of P, as X1=([Co]−0.007)/([P]−0.008), X1 is 2.9 to 6.1, preferably 3.1 to 5.6, more preferably 3.3 to 5.0, and most preferably 3.5 to 4.3. In case of adding Ni and Fe, as X2=([Co]+0.85×[Ni]+0.75×[Fe]−0.007)/([P]−0.008), X2 is 2.9 to 6.1, preferably 3.1 to 5.6, more preferably 3.3 to 5.0, and most preferably 3.5 to 4.3. When X1 and X2 are over the upper limits, thermal and electrical conductivity is decreased. Accordingly, heat resistance and strength are decreased, grain growth is not suppressed, and hot deformation resistance is increased. When X1 and X2 are below the lower limits, thermal and electrical conductivity is decreased. Accordingly, heat resistance is decreased, and thus hot and cold ductility is deteriorated. Particularly, necessary high thermal and electrical conductivity, strength, and balance with ductility deteriorate.

Even if a combination ratio of each element such as Co is the same as a configuration ratio in a compound, not all the content is combined. In the above-described formula, ([Co]−0.007) means that Co remains in a solid solution state by 0.007 mass %, and ([P]−0.008) means that P remains in a solid solution state in matrix by 0.008 mass %. That is, when a precipitation heat treatment is performed with a precipitation heat treatment condition and combination of Co and P that can be industrially performed in the invention, about 0.007% of Co and about 0.008% of P do not form precipitates and remain in a solid solution state in matrix. Accordingly, a mass ratio of Co and P has to be determined by subtracting 0.007% and 0.008% from mass concentrations of Co and P, respectively. The precipitates of Co and P, where a mass concentration ratio of Co:P is substantially 4.3:1 to 3.5:1, are $Co_2P$, $Co_{2.a}P$, $Co_{1.b}P$, or the like. When fine precipitates based on $Co_2P$, $Co_{2.a}P$, $Co_{1.b}P$, or the like are not formed, high strength and high electrical conductivity as the main subject of the invention cannot be obtained.

That is, there is insufficiency in determination of the composition of Co and P, or the ratio of mere Co and P, and the conditions such as ([Co]−0.007)/([P]−0.008)=2.9 to 6.1 (preferably 3.1 to 5.6, more preferably 3.3 to 5.0, and most preferably 3.5 to 4.3) are indispensable. When ([Co]−0.007) and ([P]−0.008) are more preferable or most preferable ratios, desired fine precipitates are formed and thus the condition becomes critical for a high conductivity and high strength material. Meanwhile, when ([Co]−0.007) and ([P]−0.008) are away from the present claims, preferable ranges, or most preferable ratios, either Co or P does not form precipitates and becomes solid solution state. Accordingly, a high strength material cannot be obtained and conductivity is decreased. In addition, precipitates having undesired composition ratio are formed, and sizes of precipitates are increased. Moreover, such precipitates do not contribute to strength so much, and thus a high conductivity and high strength material cannot be achieved.

Independent addition of elements of Fe and Ni does not contribute to the improvement of characteristics such as heat resistance and strength so much, and also decreases conductivity. However, Fe and Ni replace a part of functions of Co under the co-addition of Co and P. In the above-described formula ([Co]+0.85×[Ni]+0.75×[Fe]−0.007), a coefficient 0.85 of [Ni] and a coefficient 0.75 of [Fe] represent ratios of Ni and Fe combined with P when a combining ratio of Co and P is 1. That is, in the formula, "−0.007" and "−0.008" of ([Co]+0.85×[Ni]+0.75×[Fe]−0.007) and ([P]−0.008, respectively, mean that not all Co and P are formed into precipitates even when Co, Ni, Fe, and P are ideally combined and are subjected to a precipitation heat treatment under an ideal condition. When the precipitation heat treatment is performed under a precipitation heat treatment condition with combination of Co, Ni, Fe, and P which can be industrially performed in the invention, about 0.007% of ([Co]+0.85×[Ni]+0.75×[Fe]) and about 0.008% of P do not form precipitates and remain in a solid solution state in matrix. Accordingly, a mass ratio of Co or the like and P has to be determined by subtracting 0.007% and 0.008% from mass concentrations of ([Co]+0.85×[Ni]+0.75×[Fe]) and P, respectively. The thus-obtained precipitates of Co or the like and P, where a mass concentration ratio of Co:P becomes about 4.3:1 to 3.5:1, need to be $Co_2P$, $Co_{2.a}P$, or $Co_{1.b}P$ mainly and also $Co_xNi_yFe_zP_A$, $Co_xNi_yP_z$, $Co_xFe_yP_z$, and the like obtained by substituting a part of Co with Ni and Fe. When fine precipitates, $Co_2P$ or $Co_{2.x}P_y$ basically, are not formed, high strength and high electrical conductivity as the main subject cannot be obtained.

That is, there is insufficiency with determination of the composition of Co and P, or the ratio of mere Co and P, and ([Co]+0.85×[Ni]+0.75×[Fe]−0.007)/([P]−0.008)=2.9 to 6.1 (preferably 3.1 to 5.6, more preferably 3.3 to 5.0, and most preferably 3.5 to 4.3) becomes an indispensable condition. When ([Co]−0.007) and ([P]−0.008) are more preferable or most preferable ratios, desired fine precipitates are formed and thus the condition becomes critical for a high conductivity and high strength material. When the condition is away from the present claims, preferable ranges, or most preferable ratios, either Co or the like or P does not form precipitates and becomes solid solution state. Accordingly, a high strength material cannot be obtained and conductivity is decreased. In addition, precipitates having undesired composition ratio are formed, and sizes of precipitates are increased. Moreover, such precipitates do not contribute to strength so much, and a high conductivity and high strength material cannot be achieved.

Meanwhile, when another element is added to copper, conductivity is decreased. For example, when any one of Co, Fe, and P is added to pure copper by 0.02 mass %, thermal and electrical conductivity is decreased by about 10%. However, when Ni is added by 0.02 mass %, thermal and electrical conductivity are decreased only by about 1.5%. In the invention alloy, when a precipitation heat treatment is performed under a precipitation heat treatment condition, about 0.007% of C and about 0.008% of P do not form into precipitates and remain in matrix in a solid solution state. Accordingly, the upper limit of conductivity is 89% IACS or lower. Depending on the additive amount or the combination ratio, conductivity becomes substantially 87% IACS or lower. However, for example, conductivity 80% IACS is substantially the same as that of pure copper C1220 in which P is added by 0.03%, and is higher than conductivity 65% IACS of pure aluminum by 15% IACS, which can still be recognized as high conductivity. Thermal conductivity of the invention alloy is maximum 355 W/m·K and is substantially 349 W/m·K or lower at 20° C., from the solid solution state of Co and P, in the same manner as conductivity.

When the values X1 and X2 of the above-described formulas of Co, P, and the like fall out of the most preferable range, the amount of precipitates is decreased, uniform dispersion and super-refinement of the precipitates are deteriorated. Accordingly, excessive Co, P, or the like comes into solid solution state in matrix without being precipitated, and strength or heat resistance is decreased, thereby decreasing thermal and electrical conductivity. When Co, P, and the like are appropriately combined and fine precipitates are uniformly distributed, a significant effect in ductility such as flexibility is exhibited by a synergetic effect with Sn.

Fe and Ni replace a part of functions of Co, and cause to more effectively combine Co with P. The single addition of either Fe and Ni decreases conductivity, and thus does not contribute to improvement of characteristics such as heat resistance and strength so much. However, the single addition of Ni improves a stress relaxation resistance required for connectors or the like. In addition, Ni has the function of replacing Co under the co-addition of Co and P, and the decrease of conductivity by Ni is small. Accordingly, Ni can minimized the decrease of conductivity even when the value of the formula $([Co]+0.85\times[Ni]+0.75\times[Fe]-0.007)/([P]-0.008)$ falls out of the middle value of 2.9 to 6.1. In addition, Ni has an effect of suppressing diffusion of Sn even when a temperature during usage is increased in Sn-coated connectors or the like. However, when Ni is excessively added by 0.15 mass % or higher or the value of the formula $X3=1.5\times[Ni]+3\times[Fe]$ is over [Co], the composition of precipitates is gradually changed. Accordingly, Ni does not contribute to improvement of strength or heat resistance, and further hot deformation resistance is increased, thereby deteriorating conductivity. In consideration of this point, it is preferable that Ni be added by the above-described Ni content or fall within the preferable range in the formula of X3.

A small amount of Fe together with Co and P improves strength, increases non-recrystallized structure, and makes the recrystallized part fine. However, when Fe is excessively added by 0.07 mass % or higher or the value of the formula $X3=1.5\times[Ni]+3\times[Fe]$ is over [Co], the composition of precipitates is gradually changed. Accordingly, Fe does not contribute to improvement of strength or heat resistance, and further hot deformation resistance is increased, thereby deteriorating conductivity. In consideration of this point, it is preferable that Fe be added by the above-described Fe content or fall within the preferable range in the formula of X3.

Zn, Mg, Ag, Al, and Zr render S mixed in the course of recycle of copper harmless, decrease intermediate temperature embrittlement, and improve ductility and heat resistance. Zn of 0.003 to 0.5 mass %, Mg of 0.002 to 0.2 mass %, Ag of 0.003 to 0.5 mass %, Al of 0.002 to 0.3 mass %, Si of 0.002 to 0.2 mass %, Cr of 0.002 to 0.3 mass %, Zr of 0.001 to 0.1 mass % strengthen the alloy substantially without decreasing conductivity within the ranges thereof. Zn, Mg, Ag, and Al improve strength of the alloy by solid solution hardening, and Zr improves strength of the alloy by precipitation hardening. Zn improves solder wetting property and a brazing property. Zn or the like has an effect of promoting uniform precipitation of Co and P. Ag further improves heat resistance. When the contents of Zn, Mg, Ag, Al, Si, Cr, and Zr are below the lower limits of the composition ranges, the above-described effects are not exhibited. When the contents are over the upper limits, the above-described effects are saturated and conductivity is decreased. Accordingly, hot deformation resistance is increased, thereby deteriorating deformability. In addition, the content of Zn is preferably 0.045 mass % or less in consideration of an influence on a product and an influence on a device due to vaporization of Zn, when the produced high performance copper alloy rod, wire, a press-formed article thereof, or the like is brazed in a vacuum melting furnace, when it is used under vacuum, or when it is used under a high temperature. In addition, when an extruding ratio is high at the time of extruding the pipe or rod, addition of Cr, Zr, and Ag causes hot deformation resistance to increase, thereby deteriorating deformability. Therefore, more preferably, the content of Cr is 0.1 mass % or less, the content of Zr is 0.04 mass % or less, and the content of Ag is 0.3 mass % or less.

Next, working processes will be described. A heating temperature of a billet at hot extruding needs to be 840° C. necessary for sufficiently solid-dissolving Co, P, and the like. When the temperature is higher than 960° C., grains of an extruded material are coarsened. When the temperature at the time of starting the extruding is higher than 960° C., the temperature decreases during the extrusion. Accordingly, a difference occurs between degrees of grains at the extruding starting part and the extruding completing part, and thus uniform materials cannot be obtained. When the temperature is lower than 840° C., solution (solid solution) of Co and P is insufficient, and precipitation hardening is insufficient even when performing an appropriate heat treatment in the after-process. The billet heating temperature is preferably 850 to 945° C., more preferably 865 to 935° C., and most preferably 875 to 925° C. When the content of Co+P is 0.25 mass % or less, the temperature is 870 to 910° C. When the content of Co+P is over 0.25 mass % and 0.33 mass % or less, the temperature is 880 to 920° C. When the content of Co+P is over 0.33 mass %, the temperature is 890 to 930° C. That is, the optimal temperature is changed according to the content of Co+P, even though the difference is minor. The reason is because Co and P are sufficiently solid-dissolved at a low temperature in the above-described temperature ranges when Co, P, the like are in an appropriate range and the content of Co+P is small, but a temperature of solid-dissolving Co and P is increased when the content of Co+P is increased. When the temperature is over 960° C., the solution is saturated. In addition, even in the invention alloy, when the temperature of the rod during the extruding and just after the extruding is increased, grain growth is remarkably promoted, and the grains are rapidly coarsened, thereby deteriorating mechanical characteristics.

Considering decrease in temperature of the billet during the extruding, the temperature of the billet corresponding to the later half of the extruding has to be set higher than that of the leading end and the center portion by 20 to 30° C. by induction heating of a billet heater or the like. To prevent the temperature of extruding the extruded material from decreasing, it is surely preferable that a temperature of a container be high, satisfactorily 250° C. or higher, and more preferably 300° C. or higher. Similarly, it is preferable that a dummy block be preliminarily heated so that a temperature of the dummy block on the rear end side of the extruding is 250° C. or higher, and preferably 300° C. or higher.

Next, cooling after the extruding will be described. The invention alloy has very low solution sensitivity as compared with Cr—Zr copper or the like, and thus a cooling rate higher than 100° C./second is not particularly necessary. However, even if grain growth rapidly occurs and the solution sensitivity is not high when materials are left under a high temperature for a long time, it is preferable that the cooling rate be higher than 15° C./second when considering the solution state. In hot extruding, the extruded material is in an air cooling state until the material reaches a forced cooling device. Naturally, it is preferable that the time during this be shortened. Particularly, as an extruding ratio H (sectional area of billet/total sectional area of extruding material) is smaller, more time until reaching cooling equipment is necessary. Accordingly, it is preferable that a moving rate of a ram, that is, an extruding rate be raised. When a deformation rate is raised, grains of the extruded material become small. As a diameter of the material is larger, the cooling rate is decreased. In this specification, "solution sensitivity is low" means that atoms solid-dissolved at a high temperature are hardly precipitated even when a cooling rate is low during cooling, and "solution sensitivity is high" means that atoms are easily precipitated when the cooling rate is low.

With these factors, as extruding conditions, the moving rate of the ram (extruding rate of billet) is $30\times H^{-1/3}$ mm/second or higher, more preferably $45\times H^{-1/3}$ mm/second or higher, and most preferably $60\times H^{-1/3}$ mm/second or higher, from a relationship with the extruding ratio H. In a cooling rate of an extruding material for easily diffusing atoms, an average cooling rate from a temperature of a material just after the extruding or 840° C. to 500° C. is 15° C./second or higher, preferably 22° C./second or higher, and more preferably 30° C./second or higher, and it is necessary to satisfy any one of the conditions.

When the extruding rate is increased, a generating site of recrystallization nucleus is expanded to cause grains to be fine at hot extruding completion. In this specification, the hot extruding completion refers to a state where cooling after the hot extruding is completed. In addition, when an air cooling state up to a cooling device is shortened, rather more Co and P are solid-dissolved, and it is possible to suppress grain growth. Accordingly, it is preferable that a distance from the extruding equipment to the cooling device be short, and a cooling method be a method with a high cooling rate such as water cooling.

As described above, when the cooling rate after the extruding is raised, a grain size at the hot extruding completion can be small. The grain size is satisfactorily 5 to 75 μm, preferably 7.5 to 65 μm, and more preferably 8 to 55 μm. Generally, as the grain size is smaller, a mechanical characteristic at a normal temperature becomes more satisfactory. However, when the grain size is too small, heat resistance or a high-temperature characteristic is deteriorated. Accordingly, it is preferable that the grain size be 8 μm or more. When the grain size is over 75 μm, sufficient strength cannot be obtained and fatigue (repetitive bending) strength is decreased. Accordingly, ductility is insufficient, and a surface roughness occurs when performing a bending process or the like. The optimal producing condition is that the extruding is performed at the optimal temperature, the extruding rate is increased (the billet extruding rate is $30\times H^{-1/3}$ mm/second or higher) to break a structure of casting, the generating site of the recrystallization nucleus is expanded, and the air cooling time is shortened to suppress the grain growth. The cooling is rapid cooling such as water cooling. Since the grain size is largely affected by the extruding ratio H, the grain size becomes smaller as the extruding ratio H becomes higher.

Next, the heat treatment TH1 will be described. A basic condition of the heat treatment TH1 is at 375 to 630° C. for 0.5 to 24 hours. As the processing rate of the cold working process after the hot extruding becomes higher, a precipitation site of compounds of Co, P, and the like is increased, and Co, P, and the like are precipitated at a low temperature, thereby increasing strength. When the cold working processing rate is 0%, the condition is at 450 to 630° C. for 0.5 to 24 hours, and preferably at 475 to 550° C. for 2 to 12 hours. In addition, to obtain higher conductivity, for example, a two-step heat treatment at 525° C. for 2 hours and at 500° C. for 2 hours is effective. When the processing rate before the heat treatment is increased, the precipitation site is increased. Accordingly, in case of a processing rate of 10 to 50%, the optimal heat treatment condition is changed toward a low temperature of 10 to 20° C. A preferable condition is at 420 to 600° C. for 1 to 16 hours, and more preferably at 450 to 530° C. for 2 to 12 hours.

In addition, a temperature, a time, and a processing rate are more clarified. As a temperature T (° C.), a time (hour), and a processing rate RE (%), when a value of $(T-100\times t^{-1/2}-50\times \mathrm{Log}((100-RE)/100))$ is a heat treatment index TI, $400\leq TI\leq 540$ is satisfactory, preferably $420\leq TI\leq 520$, and most preferably $430\leq TI\leq 510$. In this case, Log is natural logarithm. For example, when the heat treatment time is extended, the temperature is changed toward a low temperature, but an influence on the temperature is substantially given as a reciprocal of a square root of a time. In addition, as the processing rate is increased, the precipitation site is increased and movement of atoms is increased, and thus it is easy to perform precipitation. Accordingly, the optimal heat treatment temperature is changed toward a low temperature. Herein, the process ratio RE is (1−(sectional area of pipe, rod, or wire after process)/(sectional area of pipe, rod, or wire before process))×100%. When the cold working process and the heat treatment TH1 are performed more than one time, a total cold working processing rate from the extruded material is applied to RE.

When the heat treatment TH1 is performed during the drawing/wire drawing process, it is preferable that the processing rate until the heat treatment TH1 after the extruding be over the processing rate after the heat treatment TH1 to have higher conductivity and ductility. Precipitation heat treatment may be performed more than one time. In such a case, it is preferable that the total cold working processing rate until the final precipitation heat treatment be over the processing rate after the heat treatment TH1. The cold working process after the extruding causes atoms of Co, P, and the like to move easily in the heat treatment TH1, thereby promoting precipitation of Co, P, and the like. As the processing rate becomes higher, the precipitation is performed by a low-temperature heat treatment. In the cold working process after the heat treatment TH1, strength is improved by process hardening, but ductility is decreased. In addition, conductivity is significantly decreased. Considering the overall balance of conductivity, ductility, and strength, it is preferable that the processing rate after the heat treatment TH1 be lower than the processing rate before the heat treatment. When an intensive process at the total cold working processing rate higher than 90% until the final wire is performed after the extruding, ductility is insufficient. Considering ductility, the following more preferable precipitation heat treatment is necessary.

That is, fine grains with low dislocation density or recrystallized grains are generated in a metal structure of matrix, thereby restoring ductility of the matrix. In the specification, both the fine grains and the recrystallized grains are referred to as recrystallized grains. When grain sizes thereof are large, or when a ratio occupied by them is high, the matrix becomes too soft. In addition, the precipitates are grown to increase the average grain diameter of the precipitates, and strength of the final wire is decreased. Accordingly, the ratio occupied by the recrystallized grains of the matrix at the time of the precipitation heat treatment is 45% or lower, preferably 0.3 to 30%, and more preferably 0.5 to 15% (the remainder is non-recrystallized structure), and the average grain size of the recrystallized grains is 0.7 to 7 μm, preferably 0.7 to 5 μm, and more preferably 0.7 to 4 μm.

The above-described fine grains are too small, and thus it may be difficult to distinguish the grains from the rolling structure by a metal microscope. However, using EBSP (Electron Back Scattering diffraction Pattern), it is possible to observe the fine grains with a little deformation at a low dislocation density due to a random direction centered on an original grain boundary extending mainly in the rolling direction. In the invention alloy, the fine grains or the recrystallized grains are generated by the cold working process at a processing rate of 75% or higher and the precipitation heat treatment. Ductility of the process-hardened material is improved by the fine recrystallized grains without decreasing strength. Also in case of a press product and a cold-forged product, the heat treatment TH1 may be put in the step of a rod, and the heat treatment may be put in after pressing and forging. Finally, over 630° C. or the temperature condition of the heat treatment TH1, for example, in case of performing a brazing process, the heat treatment TH1 may be unnecessary. In the heat treatment condition, the total cold working processing rate from the extruded material is applied to RE similarly in both cases of performing the heat treatment and performing no heat treatment at the step of a rod.

In a two-dimensional observing plane, substantially circular or substantially oval fine precipitates, which have an average grain size of 1.5 to 20 nm or in which at least 90% of the precipitates are 0.7 to 30 nm or 2.5 to 30 nm (30 nm or less), are uniformly dispersed and obtained by the heat treatment TH1. The precipitates are uniformly and finely distributed and become the same size. As the diameter of the precipitates become smaller, the sizes of the recrystallized grains become smaller, thereby improving strength and heat resistance. The average grain diameter of the precipitates is satisfactorily 1.5 to 20 nm, and preferably 1.7 to 9.5 nm. When the heat treatment TH1 is performed once, or when the cold working processing rate before the heat treatment TH1 is as low as 0 to 50%, particularly, in case of both processes, strength depends mainly on precipitation hardening, and the precipitates have to be fine, with most preferable size of 2.0 to 4.0 nm.

When the total cold working processing rate is 50% or higher, or is 75% or higher, ductility becomes insufficient. Accordingly, matrix has to have ductility at the time of the heat treatment TH1. As a result, it is preferable that the precipitates be most preferably 2.5 to 9 nm, and ductility and conductivity be improved and balanced by sacrificing a little precipitation hardening. A ratio of the precipitates of 30 nm or less is satisfactorily 90% or higher, preferably 95% or higher, and most preferably 98% or higher. In the observation using the TEM (transmission electron microscope), there are various kinds of dislocation in the cold working processed materials, and thus it is difficult to accurately measure sizes of the precipitates. Accordingly, after the extruding, materials subjected to the precipitation heat treatment without the cold working process, or samples in which recrystallized grains or fine grains are generated at the time of the precipitation heat treatment were used. Even when the precipitates were basically subjected to the cold working process, there was not great variation in grain sizes, and the precipitates were not substantially grown under the final restoration heat treatment condition. In 150,000-fold magnification, it was possible to recognize the precipitates up to a diameter of 1 nm, but the precipitates were measured also in 750,000-fold magnification because it was considered that there was a problem in size precision of fine grains of 1 to 2.5 nm.

In the measurement of 150,000-fold magnification, precipitates having diameters smaller than 2.5 nm were excluded (they were not included in calculation) from the precipitates, considering that there was a large margin of error. Also in the measurement of 750,000-fold magnification, precipitates having diameters smaller than 0.7 nm were excluded (not recognized) from the precipitates, because of a large margin of error. Centered on the precipitates having an average grain diameter of about 8 nm, it is considered that precision of measurement in 750,000-fold magnification for precipitates smaller than about 8 nm is satisfactory. Accordingly, a ratio of the precipitates of 30 nm or less indicates accurately 0.7 to 30 nm or 2.5 to 30 nm. The sizes of the precipitates of Co, P, and the like have an influence on strength, high-temperature strength, formation of non-recrystallized structure, fineness of recrystallization structure, and ductility. In addition, naturally, the precipitates do not include crystallized materials created in the casting step.

Daring to define uniform dispersion of precipitates, when the precipitates were observed using the TEM in 150,000-fold magnification or 750,000-fold magnification, a distance between the most adjacent precipitates of at least 90% of precipitates in any area of 1000 nm×1000 nm at a microscope observing position described later (except for particular parts such as the outermost surface) is defined as 150 nm or less, preferably 100 nm or less, and most preferably within 15 times of the average grains size. In any area of 1000 nm×1000 nm at the microscope observing position to be described later, it can be defined that there are at least 25 precipitates or more, preferably 50 or more, most preferably 100 or more, that is, there is no large non-precipitated zone having an influence on characteristics even when taking any micro-part in a standard region, that is, there is no presence of non-uniform precipitated zone.

Next, the heat treatment TH2 will be described. When a high cold working processing rate is given after the precipitation heat treatment like a thin wire, the heat treatment TH2 is performed on a hot-extruded material according to the invention alloy at a temperature equal to or lower than a recrystallization temperature, in the course of a wire drawing process to improve ductility, and then strength is improved when performing the wire drawing process. In addition, when the heat treatment TH2 is performed after the wire drawing process, strength is slightly decreased but ductility such as flexibility is significantly improved. After the heat treatment TH1, when the cold working processing rate is over 30% or 50%, the precipitates of Co, P, and the like become fine in addition to increase of dislocation density caused by the cold working process. Accordingly, electrical conductivity is decreased, and conductivity is decreased by 2% IACS or higher, or 3% IACS or higher. As the processing rate becomes higher, the conductivity is further decreased. In case of the cold working processing rate of 90% or higher, the conductivity is decreased by 4% IACS to 10% IACS. The degree of decrease in conductivity is as large as twice to five times as compared with copper, Cu—Zn alloy, Cu—Sn alloy, and the like. Accordingly, the effect of the TH2 on conductivity is large when the high processing rate is given. In addition, to obtain higher conductivity and higher ductility, it is preferable to perform the heat treatment TH1.

When a wire diameter is 3 mm or less, it is preferable to carry out a heat treatment at 350 to 700° C. for 0.001 seconds to several seconds by continuous annealing equipment in the viewpoint of productivity and a winding behavior at the annealing time. When laying emphasis upon ductility, flexibility, or conductivity at the final cold working processing rate of 60% or higher, it is preferable to extend time and keep at 200° C. to 375° C. for 10 minutes to 240 minutes. In addition, when there is a problem in a remaining stress, the heat treatment TH2 may be performed as stress removing annealing or restoration of ductility and conductivity, at the end, in the same manner as the wire, in a rod and a cold pressing material. Conductivity or ductility is improved by the heat treatment TH2. In a rod, a press product, or the like, a temperature of a material is not increased for a short time, and thus it is preferably kept at 250° C. to 550° C. for 1 minute to 240 minutes.

Characteristic of the high performance copper pipe, rod, or wire according to the embodiment will be described. Generally, for obtaining a high performance copper pipe, rod, or wire, there are several means such as structure control mainly based on grain fineness, solid solution hardening, and aging and precipitation hardening. For the aforesaid structure control, various elements are added. However, for conductivity, when the added elements are solid-dissolved in matrix, conductivity is generally decreased, and conductivity is significantly decreased according to elements. Co, P, and Fe of the invention alloy are elements significantly decreasing conductivity. For example, only with single addition of Co, Fe, and P to pure copper by 0.02 mass %, conductivity is decreased by about 10%. Even in the known aging precipitation alloy, it is impossible to efficiently precipitate added elements completely without solid solution remaining in matrix, and conductivity is decreased by the solid-dissolved elements. In the invention alloy, a peculiar merit is that most of solid-dissolved Co, P, and the like can be precipitated in the later heat treatment when Co, P, and the like as the constituent elements are added according to the above-described formulas, thereby securing high conductivity.

A large amount of Ni, Si, or Ti remains in matrix in titanium copper or Corson alloy (addition of Ni and Si) known as aging hardening copper alloy in addition to Cr—Zr copper as compared with the invention alloy, even when a complete solution-aging process is performed on titanium copper or Corson alloy. As a result, there is a defect that strength is increased while conductivity is decreased. Generally, when a solution treatment (e.g., heating at a typical solution temperature 800 to 950° C. for several minutes or more) at a high temperature necessary for a complete solution-aging precipitation process is performed, rains are coarsened. The coarsening of the grains has a negative influence on various mechanical characteristics. In addition, the solution treatment is restricted in quantity during production, and thus the production costs drastically increase.

In the invention, it was found that a sufficient solution treatment is performed during the hot extruding process by combination of the composition of the invention alloy and the hot extruding process, that structure control of grain fineness is performed, and that Co, P, and the like are finely precipitated in the heat treatment process thereafter.

Hot extruding includes two kinds of extruding methods such as indirect extruding (extruding backward) and direct extruding (extruding forward). A diameter of a general billet (ingot) is 150 to 400 mm and a length is about 400 to 2000 mm. A container of an extruder is loaded with a billet, the container and the billet come into contact with each other, and thus a temperature of the billet is decreased. In addition, a die to extrude material into a predetermined size is provided at the front of the container, and there is a steel block called dummy block at the rear, consequently, the billet is further deprived of its heat. The time of extruding completion is different according to a length of the billet and an extruding size, and a time of about 20 to 200 seconds is necessary to complete the extruding. Meanwhile, the temperature of the billet is decreased, and the temperature of the billet is significantly decreased after the billet is extruded until a length of the remaining billet becomes 250 mm or less, and particularly 125 mm or less, or until the length becomes equivalent to the diameter, particularly the radius of the billet.

For solution, after the extruding, it is preferable to perform immediately rapid cooling, for example, water cooling in a water tank, shower water cooling, and forced air cooling. However, in most cases in terms of the equipment, the extruded material is required to be coiled, and the extruded material needs time of several seconds to ten several seconds, until the extruded material reaches the cooling equipment (cooling while being coiled, water cooling). That is, the extruded material is in an air cooling state with a low cooling rate for about 10 seconds until the rapid cooling just after the extruding. As described above, it is naturally preferable that the extruding be performed in the state with no decrease of the temperature and that the cooling after the extruding be rapid. However, the invention alloy has a characteristic that the precipitation rate of Co, P, and the like is low, and thus solution sufficiently occurs within the range of the general extruding condition. The distance from the position where the extruding is finished to the cooling equipment is preferably about 10 m or less.

In the high performance copper pipe, rod, or wire according to the embodiment, Co, P, and the like are solid-dissolved in the course of the hot extruding process to form fine recrystallized grains by combination of the composition of Co, P, and the like and the hot extruding process. When the heat treatment is performed after the hot extruding process, Co, P, and the like are finely precipitated, thereby obtaining high strength and high conductivity. When a drawing/wire drawing process is added before and after the heat treatment, it is possible to obtain further higher strength without decreasing conductivity, by the process hardening. In addition, when the appropriate heat treatment TH1 is performed, it is possible to obtain high conductivity and high ductility. When a low-temperature annealing process (annealer annealing) is added in the middle or at the end of the process of a wire, atoms are rearranged by restoration or a kind of softening phenomenon, and it is possible to obtain further higher conductivity and ductility. Nevertheless, when strength is not sufficient yet, it is possible to improve strength by increasing the content of Sn, or adding (solid solution hardening) Zn, Ag, Al, Si, Cr, or Mg, depending on the balance with conductivity. The addition of a small amount of Sn, Zn, Ag, Al, Si, Cr, or Mg does not have a significantly negative influence on conductivity, and the addition of a small amount of Zn has an effect of increasing ductility similarly to Sn. The addition of Sn and Ag delays recrystallization, increases heat resistance, and causes the recrystallized part to be refined.

Generally, aging precipitation copper alloy is completely made into solution, and then a process of precipitation is performed, thereby obtaining high strength and high conductivity. Performance of a material made by the same process as the embodiment in which solution is simplified generally deteriorates. However, performance of the pipe, rod, or wire according to the embodiment is equivalent to or higher than that of materials produced by the complete solution-precipitation hardening process at a high cost. Rather, the most significant characteristic is that excellent strength, ductility, and conductivity can be obtained in a balanced state. The pipe, rod, or wire is produced by the hot extruding, and thus a production cost is low.

Among practical alloys, there is only Cr—Zr copper alloy that is high strength and high conductivity copper and solution-aging precipitation alloy. However, hot deformability of Cr—Zr copper at 960° C. or higher is insufficient, and thus the upper temperature limit of solution is largely restricted. The solubility limit of Cr and Zr is rapidly decreased with slight decrease of temperature, and thus the lower temperature limit of solid solution is also restricted. Accordingly, a range of the temperature condition of solution is narrow. Even if Cr—Zr copper is in a solution state at the beginning of extruding, it cannot be sufficiently made into solution by decrease of temperature in the middle period and the later period of extruding. In addition, since sensitivity of a cooling rate is high, sufficient solution cannot be performed in a general extruding process. For this reason, even when the extruded material is subjected to an aging process, desired properties cannot be obtained. Further, difference in properties of strength and conductivity depending on a part of extruded material is large, and Cr—Zr copper cannot be used as an industrial material. In addition, Cr—Zr copper includes a large amount of active Zr and Cr, and thus there is limitation on melting and casting. As a result, in the producing process according to the embodiment, it cannot be produced, the material is produced by a hot extruding method, and it is necessary to take strict batch processes for solution-aging precipitation about temperature management at a high temperature, which needs a high cost.

In the embodiment, it is possible to obtain a high performance copper pipe, rod, or wire having high conductivity, strength, and ductility in an excellent balance. In this specification, as an indicator for evaluation in the combination of strength, elongation, and conductivity of the pipe, rod, or wire, a performance index I is defined as follows. When conductivity is R (% IACS), tensile strength is S (N/mm$^2$) and elongation is L (%), the performance index $I=R^{1/2}\times S\times(100+L)/100$. Under the condition that conductivity is 45% IACS or higher, it is preferable that the performance index I be 4300 or more. Since there is a close correlation between thermal conductivity and electrical conductivity, the performance index I also indicates highness or lowness of thermal conductivity.

As a more preferable condition, in a rod, on the assumption that conductivity is 45% IACS or higher, the performance index I is satisfactorily 4600 or more, preferably 4800 or more, and most preferably 5000 or more. Conductivity is preferably 50% IACS or higher, and more preferably 60% IACS or higher. In case of needing high conductivity, conductivity is satisfactorily 65% IACS or higher, preferably 70% IACS or higher, and more preferably 75% IACS or higher. Elongation is preferably 10% or more, and more preferably 20% or more, since cold pressing, forging, rolling, caulking, and the like may be performed.

As a more preferable condition, in a pipe or wire, on the assumption that conductivity is 45% IACS or higher, the performance index I is satisfactorily 4600 or more, preferably 4900 or more, more preferably 5100 or more, and most preferably 5400 or more. Conductivity is preferably 50% IACS or higher, and more preferably 60% IACS or higher. In case of needing high conductivity, conductivity is preferably 65% IACS or higher, more preferably 70% IACS or higher, and most preferably 75% IACS or higher. In addition, when the wire needs to have a bending property or ductility, it is preferable that the performance index I be 4300 or more, and elongation is 5% or more. In the embodiment, a rod having a performance index I of 4300 or more and elongation of 10% or more, and a pipe or wire having a performance index I of 4600 or more were obtained. It is possible to reduce a cost by reducing a diameter of the pipe, rod, or wire. Particularly, for high conductivity, on the assumption that conductivity is 65% IACS or higher, conductivity is preferably 70% IACS or higher, and most preferably 75% IACS, and the performance index I is satisfactorily 4300 or more, preferably 4600 or more, and more preferably 4900 or more. In the embodiment, a pipe, rod, or wire having conductivity of 65% IACS or higher and a performance index I of 4300 or more were obtained as described later. The pipe, rod, or wire has conductivity higher than that of pure aluminum, and has high strength. Accordingly, it is possible to reduce a cost by reducing a diameter of the pipe, rod, or wire in a member where high current flows.

In the pipe, rod, or wire produced by extruding, it is preferable that variation (hereinafter, the variation is referred to as variation in extruding production lot) of conductivity and mechanical properties in a lengthwise direction of the pipe, rod, or wire extruded from one and the same billet be small. In the variation in extruding production lot, a ratio of (minimum tensile strength/maximum tensile strength) of the pipe, rod, or wire after the final process or of a material after heat treatment is satisfactorily 0.9 or more. In conductivity, a ratio of (minimum conductivity/maximum conductivity) is satisfactorily 0.9 or more. Each of the ratio of (minimum tensile strength/maximum tensile strength) and the ratio of (minimum conductivity/maximum conductivity) are preferably 0.925 or more, and more preferably 0.95 or more. In the embodiment, it is possible to raise the ratio of (minimum tensile strength/maximum tensile strength) and the ratio of (minimum conductivity/maximum conductivity), thereby improving quality. When Cr—Zr copper having high solution sensitivity is produced by the producing process according to the embodiment, the ratio of (minimum tensile strength/maximum tensile strength) is 0.7 to 0.8, and variation is large. In addition, generally, in most popular copper alloy C3604 (60Cu-37Zn-3Pb) produced by hot extruding of copper alloy, for example, at a leading end and a trailing end of extruding, a strength ratio thereof is normally about 0.9 by an extruding temperature difference, metal flow of extruding, and the like. In addition, pure copper: tough pitch copper C1100, which is not subjected to precipitation hardening, also has a value close to 0.9 by a grain size difference. In addition, a temperature of a leading end (head) portion just after the extruding is generally higher than a temperature of trailing end (tail) portion by 30 to 180° C.

For high temperature usage, a welding tip or the like is required to have high strength at 300° C. or 400° C. When strength at 400° C. is 200 N/mm$^2$ or higher, there is no problem in practice. However, to obtain high-temperature strength and long life, the strength is preferably 220 N/mm$^2$ or higher, more preferably 240 N/mm$^2$ or higher, and most preferably 260 N/mm$^2$ or higher. The high performance copper pipe, rod, or wire according to the embodiment has strength of 200 N/mm$^2$ or higher at 400° C., and thus it can be used in a high temperature state. Most of precipitates of Co, P, and the like are not solid-dissolved again at 400° C. for several hours, and most of diameters thereof are not changed. Since Sn is solid-dissolved in matrix, movement of atoms becomes inactive. Accordingly, even when the pipe, rod, or wire is heated to 400° C., recrystallized grains are not generated in a state where diffusion of atoms is not active yet. In addition, when deformation is applied thereto, the pipe, rod, or wire exhibits resistance against deformation by the precipitates of Co, P, and the like. When the grain size is 5 to 75 μm, it is possible to obtain satisfactory ductility. The grain size is preferably 7.5 to 65 μm, and most preferably 8 to 55 μm.

For high temperature usage, compositions and processes are determined by balance of high-temperature strength, wear resistance (substantially in proportion to strength), and conductivity required on the assumption of high strength and high conductivity. Particularly, to obtain strength, the cold drawing is applied before and/or after the heat treatment. As the total cold working processing rate becomes higher, a higher strength material is obtained. However, balance with ductility is important. To secure elongation of 10% or more, it is preferable that the total drawing processing rate be 60% or lower or the drawing processing rate after the heat treatment be 30% or lower. A trolley line and a welding tip are consumables, but it is possible to extend the life thereof by using the invention. The high performance copper pipe, rod, or wire according to the embodiment is very suitable for trolley lines, welding tips, electrodes, and the like.

The high performance copper pipe, rod, or wire according to the embodiment has high heat resistance, and Vickers hardness (HV) after heating at 700° C. for 120 seconds is 90 or higher, or at least 80% of the value of Vickers hardness before the heating. In addition, an average grain diameter of the precipitates in a metal structure after the heating is 1.5 to 20 nm, at least 90% of the total precipitates is 30 nm or less, or recrystallization ratio in the metal structure are 45% or lower. A more preferable condition is that the average grain size is 3 to 15 nm, at least 95% of the total precipitates are 30 nm or lower, or 30% or lower of a recrystallization ratio in a metal structure. In case of exposure to a high temperature of 700° C., precipitates of about 3 nm become large. However, they do not substantially disappear and exist as fine precipitates of 20 nm or less. Accordingly, it is possible to keep high strength and high conductivity by preventing recrystallization. As for a casting product, a cold pressing product, and a pipe, rod, or wire which are not subjected to the heat treatment TH1, Co, P, and the like in a solid solution state are finely precipitated once during the heating at 700° C., and the precipitates are grown with lapse of time. However, the precipitates do not substantially disappear and exist as fine precipitates of 20 nm or less. Accordingly, it is possible to obtain the same high strength and high conductivity as those of the rod or the like which is subjected to the heat treatment TH1. Therefore, it is possible to use it in circumstance exposed to a high temperature, thereby obtaining high strength even after brazing used for bonding. A brazing material is, for example, silver brazing BAg-7 (40 to 60% of Ag, 20 to 30% of Cu, 15 to 30% of Zn, 2 to 6% of Sn) described in JIS Z 3261, and a solidus temperature is 600 to 650° C. and a liquidus temperature is 640 to 700° C. For example, in a railroad motor, a rotor bar or an end ring is assembled by brazing. However, since these members have high strength and high conductivity even after the brazing, the members can endure high-speed rotation of the motor.

The high performance copper pipe, rod, or wire according to the embodiment has excellent flexibility, and thus is suitable for a wire harness, a connector line, a robot wire, an airplane wire, and the like. In balance of electrical characteristics, strength, and ductility, usage is divided into two ways that conductivity is to be 50% IACS or higher for high strength or that conductivity is to be 65% IACS or higher, preferably 70% IACS or higher, or most preferably 75% IACS or higher although strength is slightly decreased. Compositions and processing conditions can be determined according to the usage.

The high performance copper pipe, rod, or wire according to the embodiment is most suitable for electrical usage such as a power distribution component, a terminal, or a relay produced by forging or pressing. Hereinafter, a compression process is the general term of forging, pressing, and the like. With high strength and ductility, the high performance copper pipe, rod, or wire according to the embodiment is of utility value for metal fittings of faucets or nuts, due to no concern of stress corrosion cracking. It is preferable to use a high strength and high conductivity material, which is subjected to a heat treatment and a cold drawing at the step of a material, even depending on a product shape (complexity, deformation) and ability of a press or the like. The cold drawing processing rate of a material is appropriately determined by ability of a press and a product shape. When a compression process with low press ability or a very high processing rate is loaded, the drawing is fixed with a processing rate of, for example, about 20%, without a heat treatment after the hot extruding.

Since the material after the drawing is soft, the material can be formed into complicated shapes in cold by the compressing process, and a heat treatment is performed after the forming. In low-power processing equipment, strength of a material before the heat treatment is low, and formability is good. Accordingly, it is possible to easily perform the forming. When the heat treatment is performed after the cold forging or pressing, conductivity becomes high. Therefore, high-power equipment is not necessary, and a cost is reduced. In addition, when a brazing process is performed at a temperature higher than the temperature of the heat treatment TH1, for example, at 700° C., after the forging or press forming, it is not necessary to perform the heat treatment TH1, particularly, in a pipe, rod, or wire of a material. Since Co and P in a solution state are precipitated to increase heat resistance of matrix by solid solution of Sn, generation of recrystallized grains in matrix is delayed, thereby increasing conductivity.

The heat treatment condition after the compression process is preferably a low temperature as compared with the heat treatment condition performed after the hot extruding, before, after, or during the drawing/wire drawing process. The reason is because when a cold working process with a high processing rate is locally performed in the compression process, the heat treatment is performed on the basis of the cold working processed part. Accordingly, when the processing rate is high, the heat treatment condition is changed toward a low temperature side. A preferable condition is at 380 to 630° C. for 15 to 240 minutes. In the relational formula of the condition of the heat treatment TH1, the total processing rate from the hot extruding material to the compression processing material is applied to RE. That is, assuming that the value of the relational formula $(T-100\times t^{-1/2}-50\times \mathrm{Log}((100-RE)/100))$ is a heat treatment index TI, the index TI is satisfactorily $400\leq TI\leq 540$, preferably $420\leq TI\leq 520$, and most preferably $430\leq TI\leq 510$. When the heat treatment is performed on a rod of a material, the heat treatment is not necessarily required. However, the heat treatment is performed mainly for restoration, improvement of conductivity, and removal of remaining stress. In that case, a preferable condition is at 300 to 550° C. for 5 to 180 minutes.

Example

A high performance copper pipe, rod, or wire was produced using the above-described first invention alloy, second invention alloy, third invention alloy, and comparative copper alloy. Table 1 shows compositions of alloys used to produce the high performance copper pipe, rod, or wire.

TABLE 1

| | Alloy | Chemical Composition (mass %) | | | | | | | | | | | | | | | | |
|---|---|---|---|---|---|---|---|---|---|---|---|---|---|---|---|---|---|---|
| | No. | Cu | Co | P | Sn | O | Ni | Fe | Zn | Mg | Zr | Ag | Al | Si | Cr | X1 | X2 | X3 |
| First | 11 | Rem. | 0.27 | 0.078 | 0.045 | 0.0005 | | | | | | | | | | 3.76 | | |
| Inv. | 12 | Rem. | 0.16 | 0.054 | 0.030 | 0.0004 | | | | | | | | | | 3.33 | | |
| Alloy | 13 | Rem. | 0.21 | 0.059 | 0.18 | 0.0007 | | | | | | | | | | 3.98 | | |
| Second | 21 | Rem. | 0.22 | 0.074 | 0.030 | 0.0005 | 0.06 | | | | | | | | | | 4.00 | 0.09 |
| Inv. | 22 | Rem. | 0.18 | 0.063 | 0.50 | 0.0005 | | 0.02 | | | | | | | | | 3.42 | 0.06 |
| Alloy | 23 | Rem. | 0.29 | 0.089 | 0.022 | 0.0004 | 0.08 | | | | | | | | | | 4.33 | 0.12 |
| | 24 | Rem. | 0.22 | 0.065 | 0.030 | 0.0007 | 0.02 | | | | | | | | | | 4.04 | 0.03 |
| Third | 31 | Rem. | 0.23 | 0.069 | 0.09 | 0.0005 | 0.03 | | 0.05 | | | | | | | | 4.07 | 0.05 |
| Inv. | 32 | Rem. | 0.25 | 0.07 | 0.030 | 0.0005 | | | 0.03 | | | | | | | 3.92 | | |
| Alloy | 33 | Rem. | 0.29 | 0.071 | 0.09 | 0.0005 | 0.05 | 0.02 | | 0.02 | | | | | | | 5.40 | 0.14 |
| | 34 | Rem. | 0.30 | 0.069 | 0.041 | 0.0005 | | | | | 0.01 | | | | | 4.80 | | |
| | 35 | Rem. | 0.19 | 0.062 | 0.018 | 0.0004 | 0.02 | | 0.1 | 0.05 | | | | | | | 3.70 | 0.03 |
| | 36 | Rem. | 0.25 | 0.078 | 0.08 | 0.0006 | 0.07 | | 0.18 | | | | | | | | 4.32 | 0.11 |
| | 371 | Rem. | 0.24 | 0.069 | 0.023 | 0.0005 | | | | | | 0.12 | | | | 3.82 | | |
| | 372 | Rem. | 0.27 | 0.081 | 0.039 | 0.0004 | 0.03 | | | | | 0.04 | | | | | 3.95 | 0.05 |
| | 373 | Rem. | 0.25 | 0.066 | 0.033 | 0.0003 | | | | | | | 0.02 | | | 4.19 | | |
| | 374 | Rem. | 0.24 | 0.067 | 0.021 | 0.0005 | | | | | | | | 0.01 | | 3.95 | | |
| | 375 | Rem. | 0.25 | 0.071 | 0.044 | 0.0005 | | | | | | | | | 0.08 | 3.86 | | |
| Comp. | 41 | Rem. | 0.10 | 0.045 | 0.03 | 0.0005 | | | | | | | | | | 2.51 | | |
| Alloy | 42 | Rem. | 0.14 | 0.031 | 0.00 | 0.0007 | | | | | | | | | | 5.78 | | |
| | 43 | Rem. | 0.09 | 0.046 | 0.03 | 0.0005 | | 0.06 | | | | | | | | | 3.37 | 0.18 |
| | 44 | Rem. | 0.24 | 0.045 | 0.00 | 0.0005 | | | | | | | | | | 6.30 | | |
| | 45 | Rem. | 0.21 | 0.047 | 0.08 | 0.0004 | 0.06 | | | | | | | | | | 6.51 | 0.09 |
| | 46 | Rem. | 0.19 | 0.05 | 0.99 | 0.0004 | | | | | | | | | | 4.36 | | |
| | 47 | Rem. | 0.13 | 0.051 | 0.04 | 0.0005 | 0.03 | 0.06 | | | | | | | | | 4.50 | 0.23 |
| | 48 | Rem. | 0.14 | 0.065 | 0.05 | 0.0005 | 0.01 | | | | | | | | | | 2.48 | 0.02 |
| | 49 | Rem. | 0.22 | 0.12 | 0.03 | 0.0005 | | | | | | | | | | 1.90 | | |
| C1100 | 51 | Rem. | | | | 0.028 | | | | | | | | | | | | |
| CrZr—Cu | 52 | Rem. | | | | 0.85Cr—0.08Zr | | | | | | | | | | | | |

X1 = ([Co] − 0.007)/([P] − 0.008)

X2 = ([Co] + 0.85[Ni] + 0.75[Fe] − 0.007)/([P] − 0.008)

X3 = 1.5[Ni] + 3[Fe]

A high performance copper pipe, rod, or wire was produced by a plurality of processes using any alloy of Alloy No. 11 to 13 of the first invention alloy, Alloy No. 21 to 24 of the second invention alloy, Alloy No. 31 to 36 and 371 to 375 of the third invention alloy, Alloy No. 41 to 49 having a composition similar to the invention alloy as comparative alloy, Alloy No. 51 of tough pitch copper C1100, and Alloy No. 52 of conventional Cr—Zr copper.

FIG. 1 to FIG. 9 show flows of producing processes of the high performance pipe, rod, or wire, and Table 2 and Table 3 show conditions of the producing processes.

TABLE 2

| Proc. No. | Billet Heating Temp. ° C. | Extruding Method | Extruding Size mm | Extruding Rate mm/sec | $30 \times H^{-1/3}$ mm/sec | Cooling Method | Cooling Rate ° C./sec | Heat Treat. ° C.-hour |
|---|---|---|---|---|---|---|---|---|
| K1 | 900 | Indirect | 25 | 12 | 6.5 | Water Cooling | 30 | |
| K2 | 900 | Indirect | 25 | 12 | 6.5 | Water Cooling | 30 | |
| K3 | 900 | Indirect | 25 | 12 | 6.5 | Water Cooling | 30 | 520-4 |
| K4 | 900 | Indirect | 25 | 12 | 6.5 | Water Cooling | 30 | 520-4 |
| K5 | 900 | Indirect | 25 | 12 | 6.5 | Water Cooling | 30 | 500-12 |
| K01 | 900 | Indirect | 25 | 12 | 6.5 | Water Cooling | 30 | |
| K0 | 900 | Indirect | 25 | 12 | 6.5 | Water Cooling | 30 | |
| L1 | 825 | Indirect | 25 | 12 | 6.5 | Water Cooling | 30 | |
| L2 | 860 | Indirect | 25 | 12 | 6.5 | Water Cooling | 30 | |
| L3 | 925 | Indirect | 25 | 12 | 6.5 | Water Cooling | 30 | |
| L4 | 975 | Indirect | 25 | 12 | 6.5 | Water Cooling | 30 | |
| N1 | 900 | Indirect | 35 | 16 | 8.3 | Water Cooling | 21 | |
| N11 | 900 | Indirect | 35 | 16 | 8.3 | Water Cooling | 21 | 515-2, 500-6 |
| N2 | 900 | Direct | 35 | 18 | 8.3 | Shower Water Cooling | 17 | |
| N21 | 900 | Direct | 35 | 18 | 8.3 | Shower Water Cooling | 17 | 515-2, 500-6 |
| N3 | 900 | Indirect | 17 | 10 | 5.1 | Water Cooling | 40 | |
| N31 | 900 | Indirect | 17 | 10 | 5.1 | Water Cooling | 40 | 530-3 |
| P1 | 900 | Indirect | 25 | 20 | 10.8 | Water Cooling | 50 | |
| P2 | 900 | Indirect | 25 | 5 | 2.7 | Water Cooling | 13 | |
| P3 | 900 | Indirect | 25 | 12 | 6.5 | Forced Air Cooling | 18 | |
| P4 | 900 | Indirect | 25 | 12 | 6.5 | Air Cooling | 10 | |
| Q1 | 900 | Indirect | 25 | 12 | 6.5 | Water Cooling | 30 | |
| Q2 | 900 | Indirect | 25 | 12 | 6.5 | Water Cooling | 30 | |
| Q3 | 900 | Indirect | 25 | 12 | 6.5 | Water Cooling | 30 | |
| R1 | 900 | Direct (Pipe) | Out. 65, Thick. 6 | 17 | 8.7 | Rapid Water Cooling | 80 | 520-4 |
| R2 | 900 | Direct (Pipe) | Out. 65, Thick. 6 | 17 | 8.7 | Rapid Water Cooling | 80 | |
| M1 | 900 | Indirect | 25 | 12 | 6.5 | Water Cooling | 30 | |
| M2 | 900 | Indirect | 25 | 12 | 6.5 | Water Cooling | 30 | |
| M3 | 900 | Indirect | 25 | 12 | 6.5 | Water Cooling | 30 | |
| M4 | 900 | Indirect | 25 | 12 | 6.5 | Water Cooling | 30 | |
| M5 | 900 | Indirect | 25 | 12 | 6.5 | Water Cooling | 30 | |
| M6 | 900 | Indirect | 25 | 12 | 6.5 | Water Cooling | 30 | |
| T1* | 900 | Indirect | 25 | 12 | 6.5 | Water Cooling | 30 | 520-4 |

TABLE 2-continued

| | | | | | | | | |
|---|---|---|---|---|---|---|---|---|
| T2* | 900 | Indirect | 25 | 12 | 6.5 | Water Cooling | 30 | 520-4 |
| T3* | 900 | Indirect | 11 | 9 | 4.8 | Water Cooling | 30 | 520-4 |

| Proc. No. | Heat Treat. Index TI | Drawing/ Wire Drawing Size mm | Drawing Proc. Rate % | Heat Treat. ° C.-hour | Heat Treat. Index TI | Drawing/ Wire Drawing Size mm | Drawing Proc. Rate % |
|---|---|---|---|---|---|---|---|
| K1 | | 22 | 23 | 500-4 | 456 | | |
| K2 | | 22 | 23 | 500-4 | 456 | 20 | 17 |
| K3 | 470 | | | | | | |
| K4 | 470 | 22 | 23 | | | | |
| K5 | 471 | | | | | | |
| K01 | | 22 | 23 | | | | |
| K0 | | | | | | | |
| L1 | | 22 | 23 | 500-4 | 456 | | |
| L2 | | 22 | 23 | 500-4 | 456 | | |
| L3 | | 22 | 23 | 500-4 | 456 | | |
| L4 | | 22 | 23 | 500-4 | 456 | | |
| N1 | | 31 | 22 | 500-2, 480-4 | 457 | | |
| N11 | 468 | | | | | | |
| N2 | | 31 | 22 | 500-2, 480-4 | 457 | | |
| N21 | 468 | | | | | | |
| N3 | | 14.5 | 27 | 500-4 | 457 | | |
| N31 | 472 | | | | | | |
| P1 | | 22 | 23 | 500-4 | 456 | | |
| P2 | | 22 | 23 | 500-4 | 456 | | |
| P3 | | 22 | 23 | 500-4 | 456 | | |
| P4 | | 22 | 23 | 500-4 | 456 | | |
| Q1 | | 20 | 36 | 490-4 | 450 | | |
| Q2 | | 20 | 36 | 490-4 | 450 | 18.5 | 14 |
| Q3 | | 18 | 48 | 475-4 | 439 | | |
| R1 | 470 | | | | | | |
| R2 | | Out. 50, Thick. 4 | 48 | 460-6 | 433 | | |
| M1 | | 22 | 23 | 360-15 | 340 | | |
| M2 | | 22 | 23 | 400-4 | 356 | | |
| M3 | | 22 | 23 | 475-12 | 452 | | |
| M4 | | 22 | 23 | 590-4 | 546 | | |
| M5 | | 22 | 23 | 620-0.3 | 443 | | |
| M6 | | 22 | 23 | 650-0.8 | 544 | | |
| T1* | 470 | | | | | | |
| T2* | 470 | 22 | 23 | | | | |
| T3* | 470 | 2.8 | 23 | TH2 350° C.-10 Min | | | |

*T1, T2, T3: Water Cooling, Heating at 900° C. for 10 min, and Water Cooling, to be Solution

TABLE 3

| Proc. No. | Billet Heating Temp. ° C. | Extruding Method | Extruding Size mm | Extruding Rate mm/sec | $30 \times H^{-1/3}$ mm/sec | Cooling Method | Cooling Rate ° C./sec | Heat Treat. TH1 ° C.-hour | Heat Treat. Index TI | Drawing/ Wire Drawing Size mm |
|---|---|---|---|---|---|---|---|---|---|---|
| S1 | 910 | Indirect | 11 | 9 | 4.8 | Water Cooling | 30 | | | 8 |
| S2 | 910 | Indirect | 11 | 9 | 4.8 | Water Cooling | 30 | | | 8 |
| S3 | 910 | Indirect | 11 | 9 | 4.8 | Water Cooling | 30 | | | 8 |
| S4 | 910 | Indirect | 11 | 9 | 4.8 | Water Cooling | 30 | | | 8 |
| S5 | 910 | Indirect | 11 | 9 | 4.8 | Water Cooling | 30 | | | 8 |
| S6 | 910 | Indirect | 11 | 9 | 4.8 | Water Cooling | 30 | 520-4 | 470 | 2.8 |
| S7 | 910 | Indirect | 11 | 9 | 4.8 | Water Cooling | 30 | 490-4 | 440 | 1.2 |
| S8 | 910 | Indirect | 11 | 9 | 4.8 | Water Cooling | 30 | | | 4 |

TABLE 3-continued

| | | | | | | | | | | |
|---|---|---|---|---|---|---|---|---|---|---|
| S9 | 910 | Indirect | 11 | 9 | 4.8 | Water Cooling | 30 | | | 4 |

| Proc. No. | Proc. Rate % | Heat Treat. TH1 ° C.-hour | Heat Treat. Index TI | Drawing/ Wire Drawing Size mm | Proc. Rate % | Heat Treat. TH1 ° C.-hour | Heat Treat. Index TI | Heat Treat. TH2 ° C.-min | Drawing/ Wire Drawing Size mm | Heat Treat. TH2 ° C.-min |
|---|---|---|---|---|---|---|---|---|---|---|
| S1 | 47 | 480-4 | 444 | 2.8 | | | | | | |
| S2 | 47 | 480-4 | 444 | 2.8 | | | | 325-20 | | |
| S3 | 47 | 480-4 | 444 | 2.8 | | | | | 1.2 | |
| S4 | 47 | 480-4 | 444 | 2.8 | | | | 350-10 | 1.2 | |
| S5 | 47 | 480-4 | 444 | 2.8 | | | | 350-10 | 1.2 | 420-0.3 |
| S6 | 94 | | | | | | | 375-5 | | |
| S7 | 98.8 | 425-2 | 450 | | | | | | | |
| S8 | 87 | 470-4 | 464 | 1.2 | 98.8 | 425-1 | 421 | | | |
| S9 | 87 | 470-4 | 464 | 1.2 | | | | 360-50 | | |

FIG. 1 shows a configuration of a producing process K. In the producing process K, a raw material was melted by an electric furnace of a real operation, a composition was adjusted, and thus a billet having an outer diameter of 240 mm and a length of 700 mm was produced. The billet was heated at 900° C. for 2 minutes, and a rod having an outer diameter of 25 mm was extruded by an indirect extruder. Extruding ability of the indirect extruder was 2750 tons (in the following processes, the extruding ability is the same in the indirect extruder). A temperature of a container of the extruder was 400° C., a temperature of a dummy block was 350° C., and a preheated dummy block was used. In the embodiment including the following processes, a temperature of a container and a temperature of a dummy block were the same. An extruding rate (moving speed of ram) was 12 mm/second, and cooling was performed by water cooling in a coil winder away from extruding dies by about 10 m (hereinafter, a series of processes from the melting hereto is referred to as a process K0). A temperature of the extruded material was measured at a part away from the extruding dies by about 3 m. As a result, a material temperature of an extruding leading end (head) portion was 870° C., a temperature of an extruding middle portion was 840° C., and a temperature of an extruding trailing end (tail) portion was 780° C. The leading end and trailing end portions are positions away from the most leading end and the latest end by 3 m. As described above, a large difference in temperature of 90° C. occurred between the leading end and the trailing end of extruding. An average cooling rate from 840° C. to 500° C. after the hot extruding was about 30° C./second. Thereafter, drawing is performed to be an outer diameter of 22 mm (process K01), a heat treatment TH1 at 500° C. for 4 hours was performed (process K1), and then drawing was performed to be an outer diameter of 20 mm (process K2) by a cold drawing process. After the process K0, a heat treatment TH1 at 520° C. for 4 hours was performed (process K3), and then drawing was performed to be an outer diameter of 22 mm (process K4). In addition, after the process K0, a heat treatment TH1 at 500° C. for 12 hours was performed (process K5). In C1100, a heat treatment at 150° C. for 2 hours was performed in the process K1, but there was no precipitated element. Accordingly, a heat treatment TH1 was not performed (the same will be applied to other producing processes described later).

Figure 2:
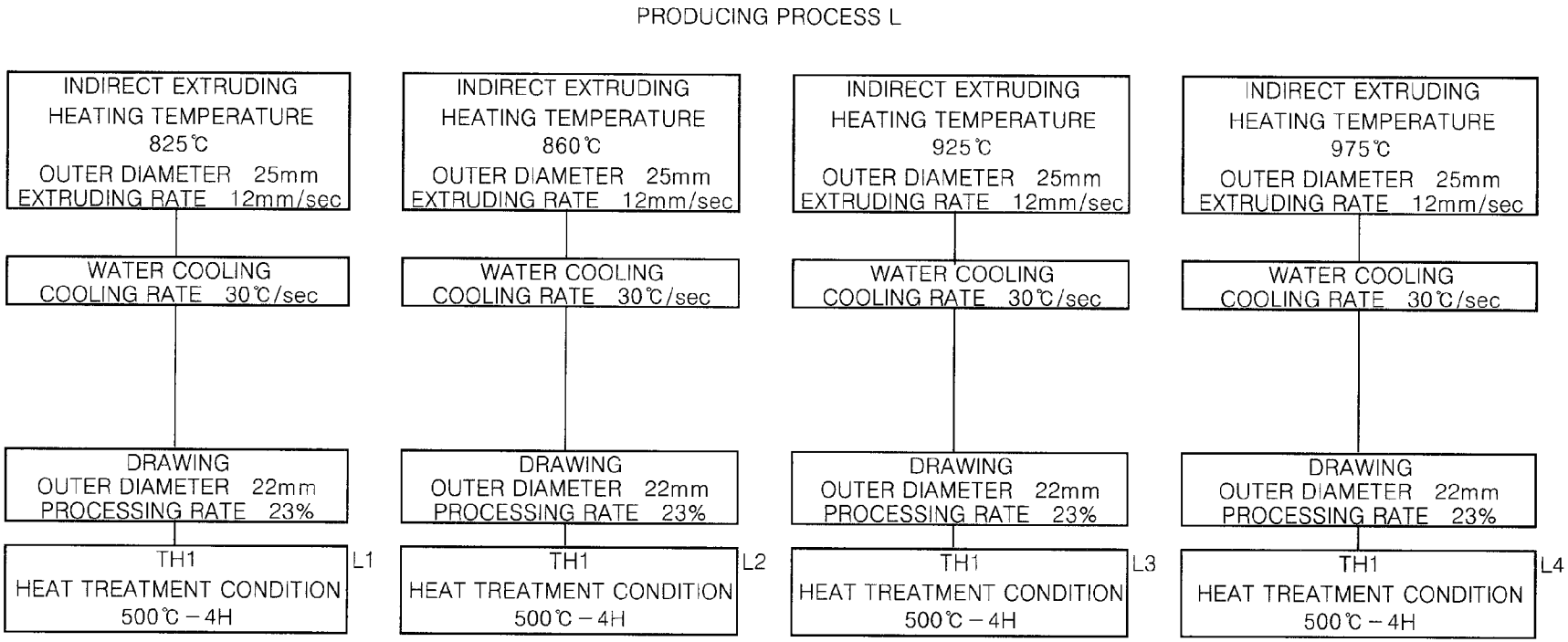
FIG. 2 is a flowchart of a producing process L of the high performance copper pipe, rod, or wire.

FIG. 2 shows a configuration of a producing process L. In the producing process L, a heating temperature of the billet is different from that of the producing process K1. The heating temperature was 825° C. in a process L1, 860° C. in a process L2, 925° C. in a process L3, and 975° C. in a process L4.

Figure 3:
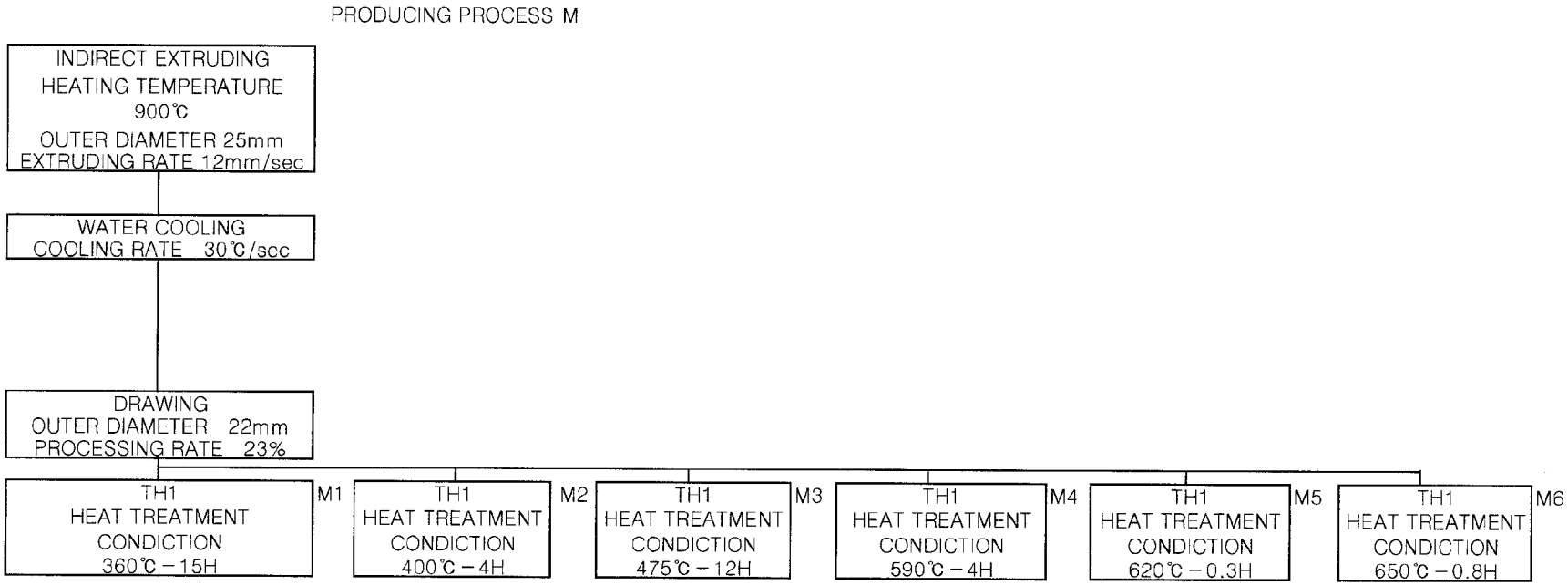
FIG. 3 is a flowchart of a producing process M of the high performance copper pipe, rod, or wire.

FIG. 3 shows a configuration of a producing process M. In the producing process M, a temperature condition of the heat treatment TH1 is different from that of the producing process K1. The temperature condition was at 360° C. for 15 hours in a process M1, at 400° C. for 4 hours in a process M2, at 475° C. for 12 hours in a process M3, at 590° C. for 4 hours in a process M4, at 620° C. for 0.3 hours in a process M5, and at 650° C. for 0.8 hours in a process M6.

Figure 4:
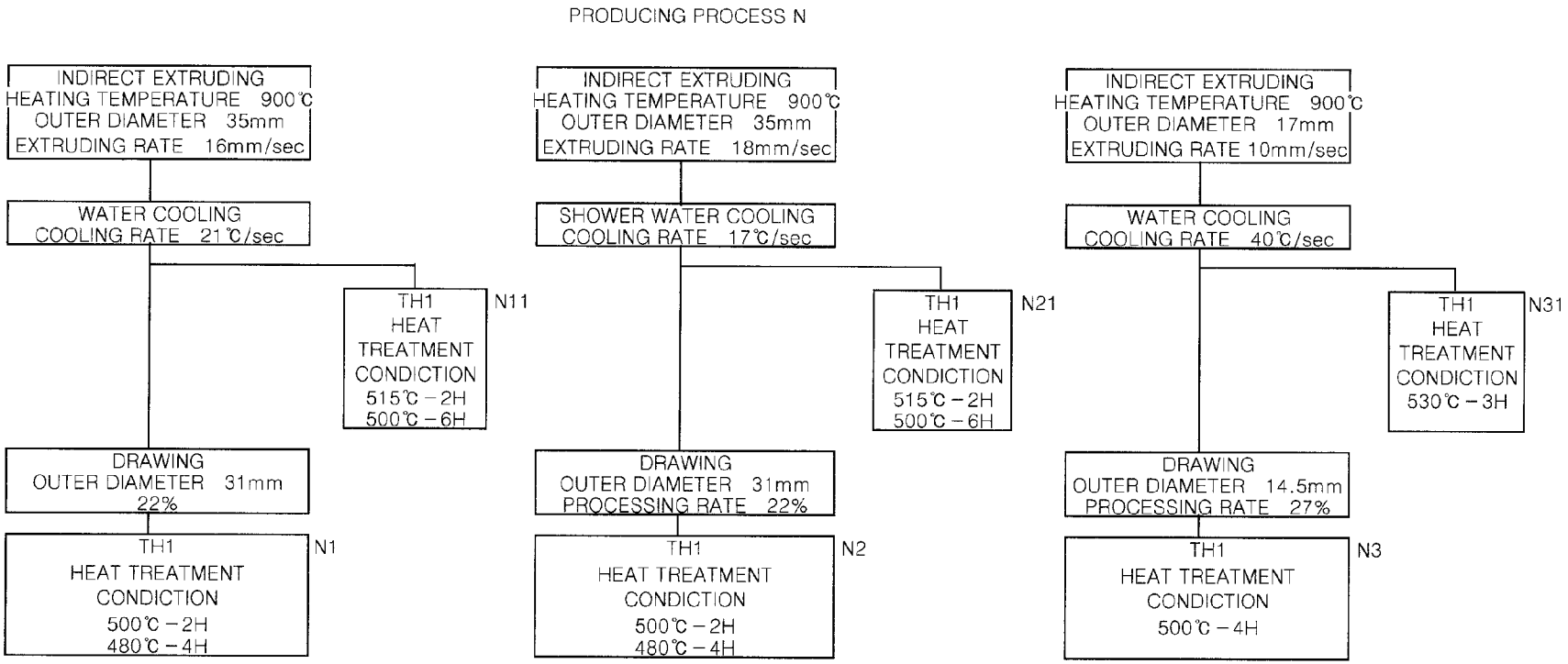
FIG. 4 is a flowchart of a producing process N of the high performance copper pipe, rod, or wire.

FIG. 4 shows a configuration of a producing process N. In the producing process N, a hot extruding condition and a condition of the heat treatment TH1 are different from those of the producing process K1. In a process N1, a billet was heated at 900° C. for 2 minutes, and a rod having an outer diameter of 35 mm was extruded by the indirect extruder. An extruding rate was 16 mm/second, and cooling was performed by water cooling. A cooling rate was about 21° C./second. Thereafter, drawing was performed to be an outer diameter of 31 mm by a cold drawing process, a heat treatment TH1 at 500° C. for 2 hours and subsequently at 480° C. for 4 hours was performed. In addition, after the water cooling in the process N1, a heat treatment TH1 at 515° C. for 2 hours and subsequently at 500° C. for 6 hours was performed (process N11). In a process N2, a billet was heated at 900° C. for 2 minutes, and a rod having an outer diameter of 35 mm was extruded by the direct extruder. Extruding ability of the direct extruder was 3000 tons (in the following processes, the extruding ability is the same in the direct extruder). An extruding rate was 18 mm/second, and cooling was performed by shower water cooling. A cooling rate was about 17° C./second. Thereafter, drawing was performed to be an outer diameter of 31 mm by a cold drawing process, and a heat treatment TH1 at 500° C. for 2 hours and subsequently at 480° C. for 4 hours was performed. After the water cooling in the process N2, a heat treatment TH1 at 515° C. for 2 hours and subsequently at 500° C. for 6 hours was performed (process N21). In a process N3, a billet was heated at 900° C. for 2 minutes, and a rod having an outer diameter of 17 mm was extruded by the indirect extruder. An extruding rate was 10 mm/second, and cooling was performed by water cooling. A cooling rate was about 40° C./second. Thereafter, drawing was performed to be an outer diameter of 14.5 mm by a cold drawing process, and a heat treatment TH1 at 500° C. for 4 hours was performed. After the water cooling in the process N3, a heat treatment TH1 at 530° C. for 3 hours was performed (process N31).

Figure 5:
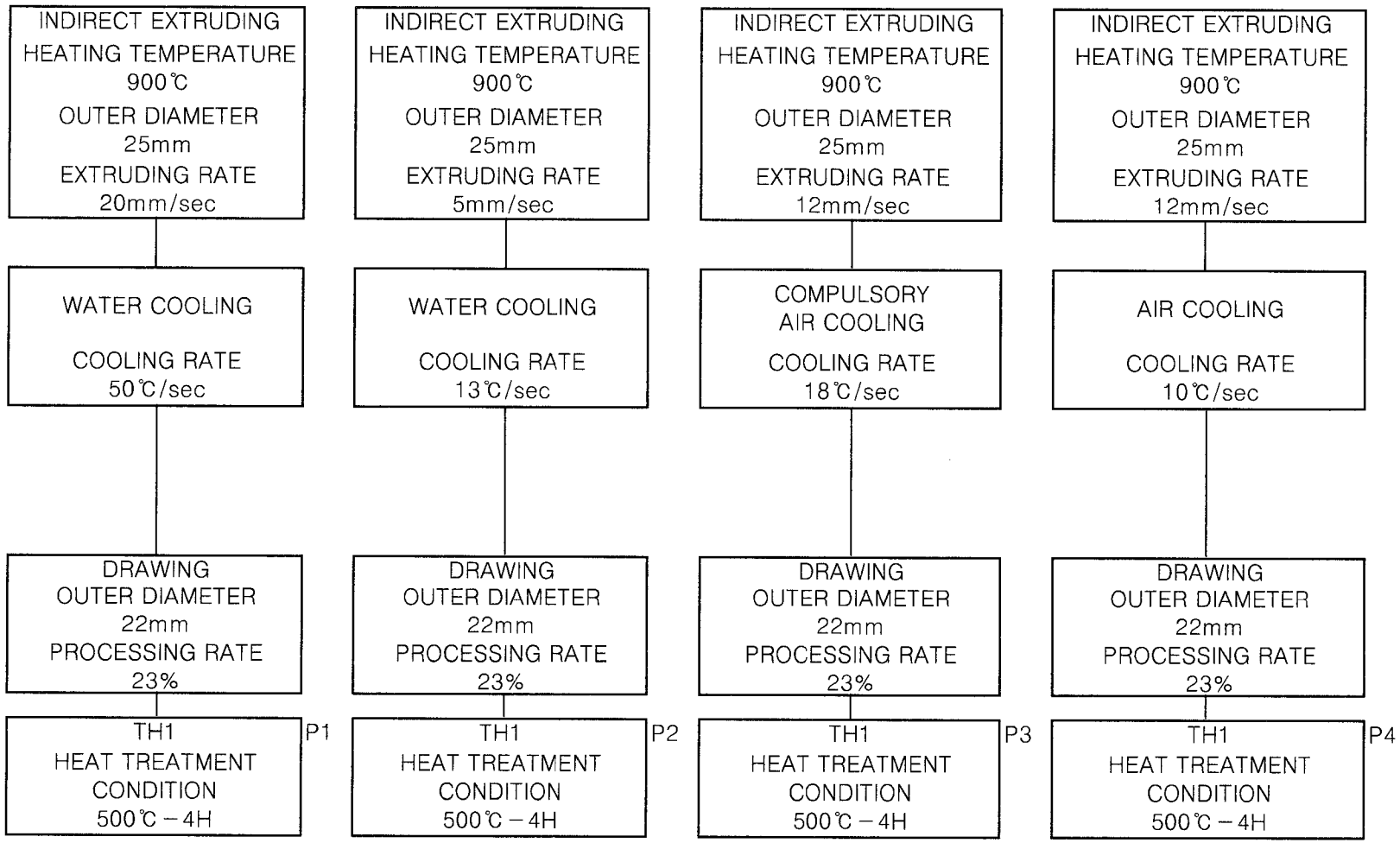
FIG. 5 is a flowchart of a producing process P of the high performance copper pipe, rod, or wire.

FIG. 5 shows a configuration of a producing process P. In the producing process P, a cooling condition after extruding is different from that of the producing process K1. In a process P1, a billet was heated at 900° C. for 2 minutes, and a rod having an outer diameter of 25 mm was extruded by the indirect extruder. An extruding rate was 20 mm/second, and cooling was performed by water cooling. A cooling rate was about 50° C./second. Thereafter, drawing was performed to be an outer diameter of 22 mm by a cold drawing process, and a heat treatment TH1 at 500° C. for 4 hours was performed. In processes P2 to P4, the extruding and cooling conditions were changed different from those in the process P1. In the process P2, an extruding rate was 5 mm/second, and cooling was performed by water cooling. A cooling rate was about 13° C./second. In the process P3, an extruding rate was 12 mm/second, and cooling was performed by forced air cooling. A cooling rate was about 18° C./second. In the process P4, an extruding rate was 12 mm/second, and cooling was performed by air cooling. A cooling rate was about 10° C./second.

Figure 6:
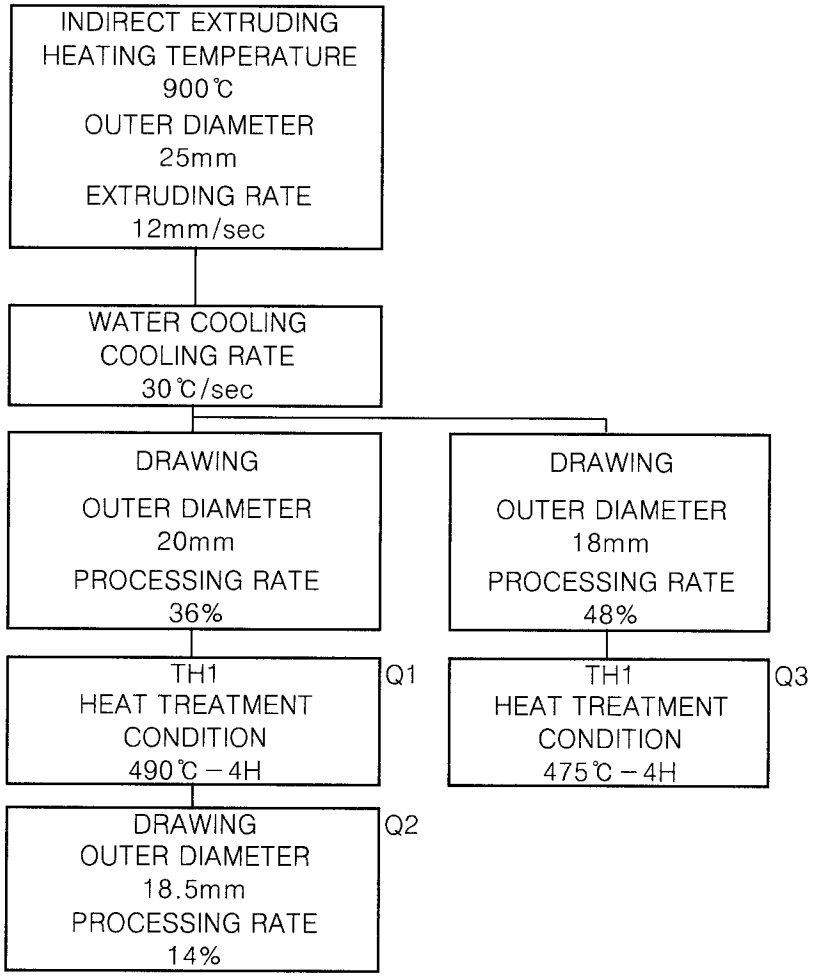
FIG. 6 is a flowchart of a producing process Q of the high performance copper pipe, rod, or wire.

FIG. 6 shows a configuration of a producing process Q. In the producing process Q, a condition of cold drawing is different from that of the producing process K1. In a process Q1, a billet was heated at 900° C. for 2 minutes, and a rod having an outer diameter of 25 mm was extruded by the indirect extruder. An extruding rate was 12 mm/second, and cooling was performed by water cooling. A cooling rate was about 30° C./second. Thereafter, drawing was performed to be an outer diameter of 20 mm by a cold drawing process, and a heat treatment TH1 at 490° C. for 4 hours was performed. In a process Q2, drawing was performed to be an outer diameter of 18.5 mm by a cold drawing process after the heat treatment TH1 in the process Q1. In a process Q3, drawing was performed to be an outer diameter of 18 mm by a cold drawing process after the water cooling in the process Q1, and a heat treatment TH1 at 475° C. for 4 hours was performed.

Figure 7:
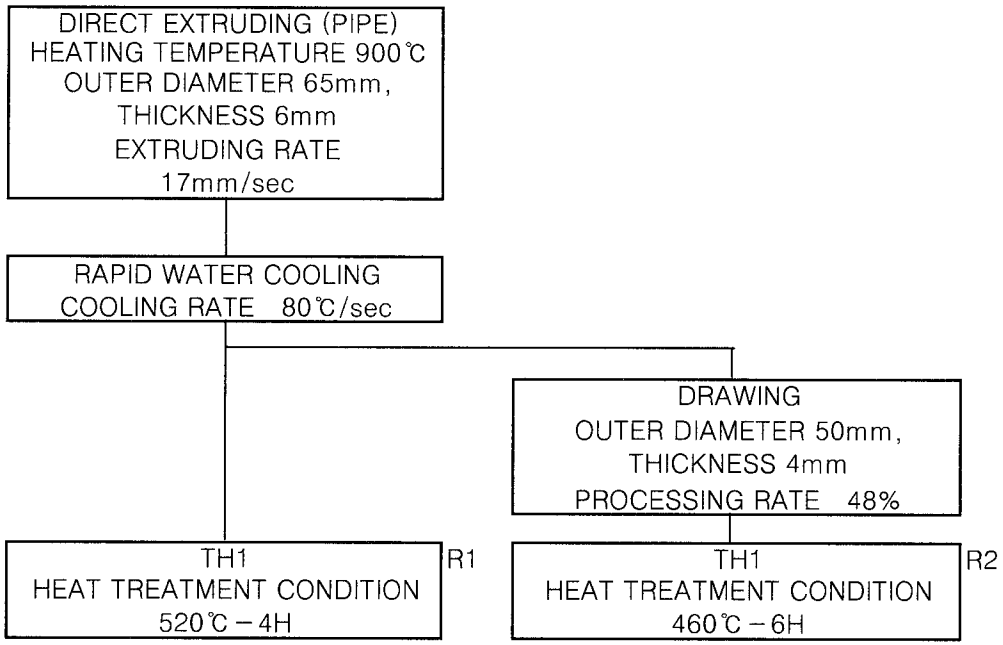
FIG. 7 is a flowchart of a producing process R of the high performance copper pipe, rod, or wire.

FIG. 7 shows a configuration of a producing process R. In the producing process R, a pipe was produced. In a process R1, a billet was heated at 900° C. for 2 minutes, and a pipe having an outer diameter of 65 mm and a thickness of 6 mm was extruded by a direct extruder of 3000 tons. An extruding rate was 17 mm/second, and cooling was performed by rapid water cooling. A cooling rate was about 80° C./second. Thereafter, a heat treatment TH1 at 520° C. for 4 hours was performed. In a process R2, drawing was performed to be an outer diameter of 50 mm and a thickness of 4 mm by a cold drawing process after the rapid water cooling in the process R1, and then a heat treatment TH1 at 460° C. for 6 hours was performed.

Figure 8:
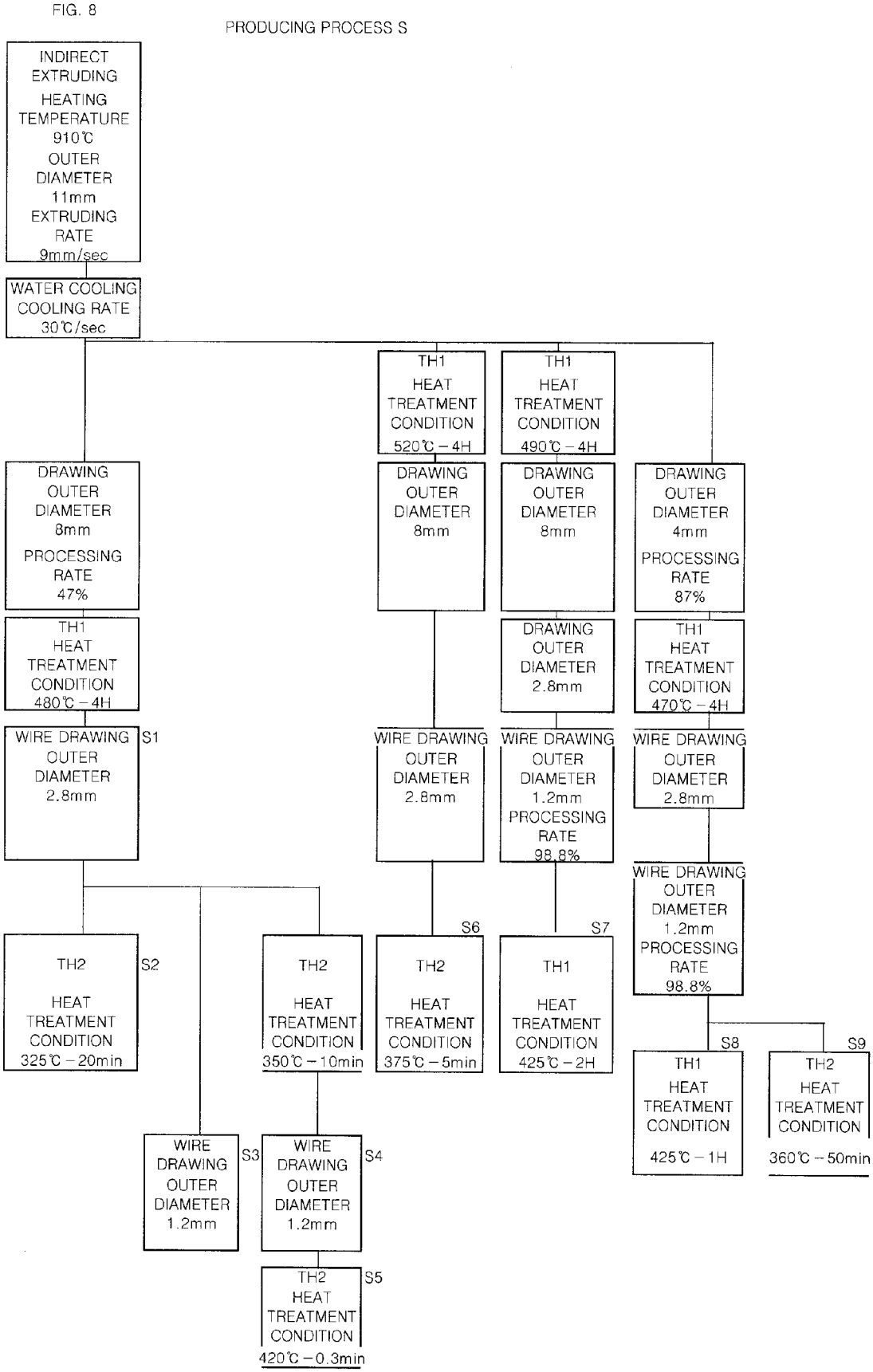
FIG. 8 is a flowchart of a producing process S of the high performance copper pipe, rod, or wire.

FIG. 8 shows a configuration of a producing process S. In the producing process S, a wire was produced. In a process S1, a billet was heated at 910° C. for 2 minutes, and a rod having an outer diameter of 11 mm was extruded by the indirect extruder. An extruding rate was 9 mm/second, and cooling was performed by water cooling. A cooling rate was about 30° C./second. Thereafter, drawing was performed to be an outer diameter of 8 mm by a cold drawing process, a heat treatment TH1 at 480° C. for 4 hours was performed, and wire drawing was performed to be an outer diameter of 2.8 mm by a cold wire drawing process. After the process S1, a heat treatment TH2 at 325° C. for 20 minutes was performed (process S2). However, in case of C1100, when the same heat treatment TH2 is performed, recrystallization occurs. Accordingly, a heat treatment at 150° C. for 20 minutes was performed. After the process S1, subsequently, a cold wire drawing process was performed up to an outer diameter of 1.2 mm (process S3). After the process S1, a heat treatment TH2 at 350° C. for 10 minutes was performed, subsequently, a cold wire drawing process was performed up to an outer diameter of 1.2 mm (process S4), and a heat treatment TH2 at 420° C. for 0.3 minutes was performed (process S5). After the water cooling in the process S1, a heat treatment TH1 at 520° C. for 4 hours was performed, wire drawing was performed sequentially to be an outer diameter of 8 mm and 2.8 mm by a cold drawing/wire drawing process, and a heat treatment TH2 at 375° C. for 5 minutes was performed (process S6). After the water cooling in the process S1, a heat treatment TH1 at 490° C. for 4 hours was performed, wire drawing was performed sequentially to be an outer diameter of 8 mm, 2.8 mm, and 1.2 mm by a cold drawing/wire drawing process, and a heat treatment TH1 at 425° C. for 2 hours was performed (process S7). After the water cooling in the process S1, wire drawing was performed to be an outer diameter of 4 mm by a cold drawing process, a heat treatment TH1 at 470° C. for 4 hours was performed, additionally, wire drawing was performed sequentially to be an outer diameter of 2.8 mm and 1.2 mm, and a heat treatment TH1 at 425° C. for 1 hour was performed (process S8). After the wire drawing to the outer diameter of 1.2 mm in the process S8, a heat treatment TH2 at 360° C. for 50 minutes was performed (process S9).

Figure 9:
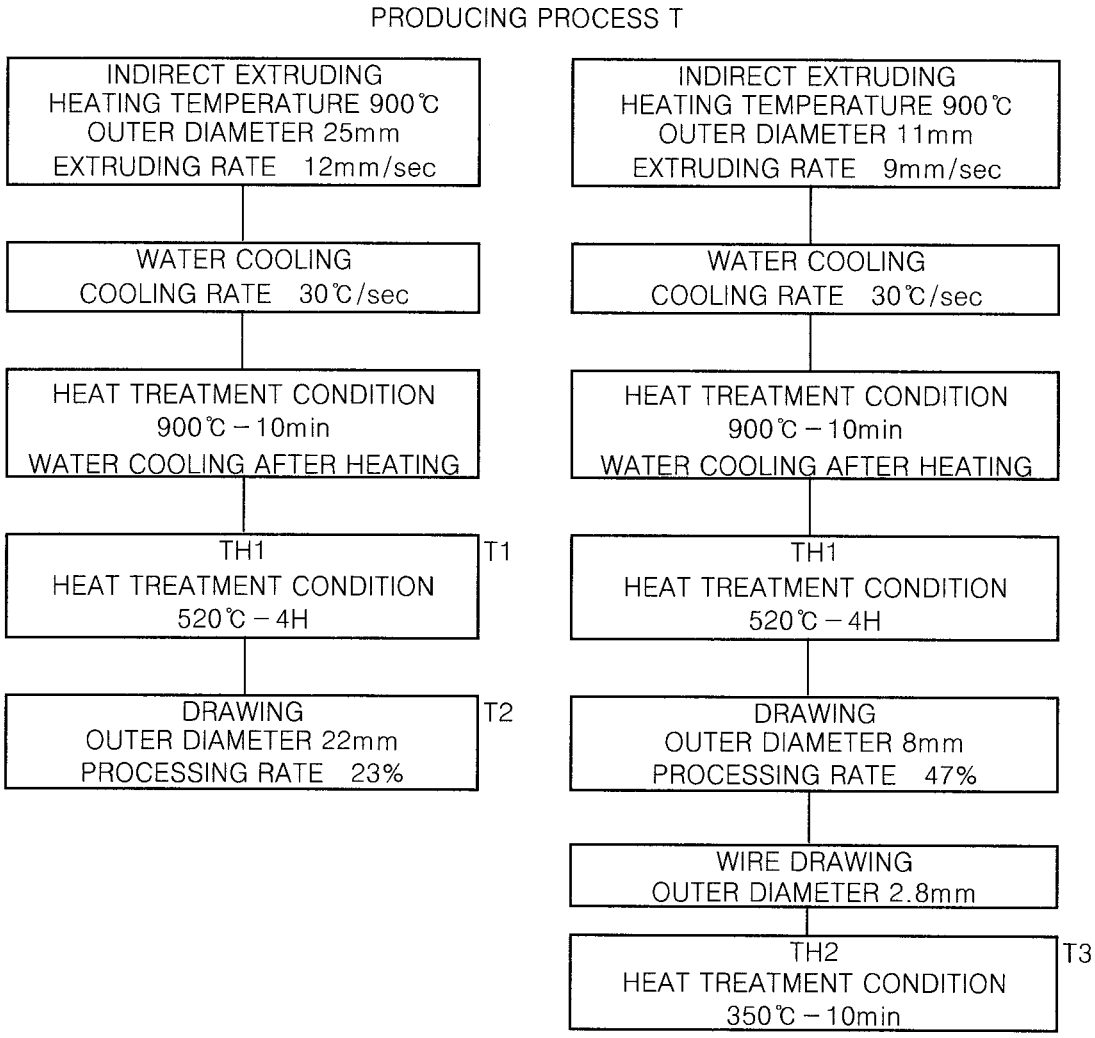
FIG. 9 is a flowchart of a producing process T of the high performance copper pipe, rod, or wire.

FIG. 9 shows a configuration of a producing process T. The producing process T is a process of producing a rod and a wire having a solution-precipitation process, and was performed for comparison with the producing method according to the embodiment. In producing a rod, a billet was heated at 900° C. for 2 minutes, a rod having an outer diameter of 25 mm was extruded by the indirect extruder. An extruding rate was 12 mm/second, and cooling was performed by water cooling. A cooling rate was about 30° C./second. Subsequently, heating at 900° C. for 10 minutes was performed, water cooling was performed at a cooling rate of about 120° C./second, and solution was performed. Thereafter, a heat treatment TH1 for 520° C. for 4 hours was performed (process T1), and drawing was performed to be an outer diameter of 22 mm by a cold drawing process (process T2). In producing a wire, a billet was heated at 900° C. for 2 minutes, a rod having an outer diameter of 11 mm was extruded by the indirect extruder. An extruding rate was 9 mm/second, and cooling was performed by water cooling. A cooling rate was about 30° C./second. Subsequently, heating at 900° C. for 10 minutes was performed, water cooling was performed at a cooling rate of about 150° C./second, and solution was performed. Thereafter, a heat treatment TH1 for 520° C. for 4 hours was performed, drawing was performed to be an outer diameter of 8 mm by a cold drawing process, wire drawing was performed to be an outer diameter of 2.8 mm by a cold wire drawing process, and a heat treatment TH2 at 350° C. for 10 minutes was performed (process T3).

As assessment of the high performance copper pipe, rod, or wire produced by the above-described method, tensile strength, Vickers hardness, elongation, Rockwell hardness, the number of repetitive bending times, conductivity, heat resistance, 400° C. high-temperature tensile strength, and Rockwell hardness and conductivity after cold compression were measured. In addition, a grain size, a diameter of precipitates, and a ratio of precipitates having a size of 30 nm or less were measured by observing a metal structure.

Measurement of tensile strength was performed as follows. As for a shape of test pieces, in rods, 14A test pieces of (square root of sectional area of test piece parallel portion)×5.65 as a gauge length of JIS Z 2201 were used. In wires, 9B test pieces of 200 mm as a gauge length of JIS Z 2201 were used. In pipes, 14C test pieces of (square root of sectional area of test piece parallel portion)×5.65 as a gauge length of JIS Z 2201 were used.

Measurement of the number of repetitive bending times was performed as follows. A diameter RA of a bending part was 2×RB (outer diameter of wire), bending was performed by 90 degrees, the time of returning to an original position was defined as once, and additionally bending was performed on the opposite side by 90 degrees, which were repeated until breaking.

In measurement of conductivity, a conductivity measuring device (SIGMATEST D2.068) manufactured by FOERSTER JAPAN limited was used in case of rods having a diameter of 8 mm or more and cold compression test pieces. In case of wires and rods having a diameter less than 8 mm, conductivity was measured according to JIS H 0505. At that time, in measurement of electric resistance, a double bridge was used. In this specification, "electrical conductivity" and "conductivity" are used as the same meaning. Thermal conductivity and electrical conductivity are intimately related to each other. Accordingly, the higher conductivity is, the higher thermal conductivity is.

For heat resistance, test pieces cut so that process-completed rods have a length of 35 mm (300 mm for tensile test in Table 10 described later) and compressed test pieces having a height of 7 mm by cold compression of process-completed rods were prepared, they were immersed in a salt bath (NaCl and $CaCl_2$ are mixed at about 3:2) of 700° C. for 120 seconds, they are cooled (water cooling), and then Vickers hardness, a recrystallization ratio, conductivity, an average grains diameter of precipitates, and a ratio of precipitates having a diameter of 30 nm or less were measured. The compressed test pieces were obtained by cutting rods by a length of 35 mm and compressing them using an Amsler type all-round tester to 7 mm (processing rate of 80%). In the processes K1, K2, K3, and K4, heat resistance were tested by the test pieces of the rods. In the process K0 and K01, heat resistance was tested by the compressed test pieces. A heat treatment was not performed on both of processed products after compression.

Measurement of 400° C. high-temperature tensile strength was performed as follows. After keeping at 400° C. for 10 minutes, a high-temperature tensile test was performed. A gauge length was 50 mm, and a test piece was processed by lathe machining to be an outer diameter of 10 mm.

Cold compression was performed as follows. A rod was cut by a length of 35 mm, which was compressed from 35 mm to 7 mm (processing rate of 80%) by the Amsler type all-round tester. As for rods in the processes K0 and K01 which were not subjected to the heat treatment TH1, a heat treatment at 450° C. for 80 minutes was performed as an after-process heat treatment after the compression, and Rockwell hardness and conductivity were measured. As for rods in the processes other than the processes K0 and K01, Rockwell hardness and conductivity were measured after the compression.

Measurement of grain size was performed by metal microscope photographs on the basis of methods for estimating average grain size of wrought copper in JIS H 0501. Measurement of an average recrystallized grain size and a recrystallization ratio was performed by metal microscope photographs of 500-fold magnification, 200-fold magnification, 100-fold magnification, and 75-fold magnification, by selecting appropriate magnifications according to grain size. Measurement of an average recrystallization grain size was performed basically by comparison methods. In measurement of a recrystallization ratio, non-recrystallized grains and recrystallized grains (including fine grains) were distinguished from each other, the recrystallized parts were binarized by image processing software "WinROOF", an area ratio thereof was set as a recrystallization ratio. When it was difficult to perform distinguishing from a metal microscope, an FE-SEM-EBSP method was used. From a grain boundary MAP of 2000-fold magnification or 500-fold magnification for analysis, grains including a grain boundary having a directional difference by 15° or more were marked with a Magic Marker, which were binarized by the image analysis software "WinROOF", and then a recrystallization ratio was calculated. The measurement limit is substantially 0.2 μm, and even when there were recrystallized grains of 0.2 μm or less, they were not applied to the measured value.

In measurement of diameters of precipitates, transmission electron images of TEM (Transmission Electron Microscope) of 150,000-fold magnification and 750,000 fold magnification were binarized by the image processing software "WinROOF" to extract precipitates, and an average value of areas of the precipitates was calculated, thereby measuring an average grain diameter. As for the measurement position, assuming that r is a radius in the rod or wire, two points at positions of 1r/2 and 6r/7 from the center of the rod or wire were taken, and then an average value thereof was calculated. In the pipe, assuming that h is a thickness, two points at positions of 1h/2 and 6h/7 from an inside of the pipe were taken, and then an average value thereof was calculated. When potential exists in a metal structure, it is difficult to measure the size of precipitates. Accordingly, measurement was performed using the rod or wire in which the heat treatment TH1 was performed on the extruded material, for example, the rod or wire on which the process K3 was completed. As for the heat resistance test performed at 700° C. for 120 seconds, measurement was performed at the recrystallized parts. Although a ratio of the number of precipitates of 30 nm or less was performed from each diameter of precipitates, it was determined that there were large errors about precipitates having a grain diameter less than 2.5 nm in the transmission electron images of TEM of 150,000-fold magnification, which were excluded from the precipitates (they were not applied to calculation). Also in measurement of 750,000-fold magnification, it was determined that there were large errors about precipitates having a grain diameter less than 0.7 nm, and thus they were excluded from the precipitates (not recognized). Centered on the precipitates having an average grain diameter of about 8 nm, it is considered that precision of measurement in 750,000-fold magnification for precipitates smaller than about 8 nm is satisfactory. Accordingly, a ratio of the precipitates of 30 nm or less indicates accurately 0.7 to 30 nm or 2.5 to 30 nm.

Measurement of wear resistance was performed as follow. A rod having an outer diameter of 20 mm was subjected to a cutting process, a punching process, and the like, and thus a ring-shaped test piece having an outer diameter of 19.5 mm and a thickness (axial directional length) of 10 mm was obtained. Then, the test piece was fitted and fixed to a rotation shaft, and a roll (outer diameter 60.5 mm) manufactured by SUS304 including Cr of 18 mass %, Ni of 8 mass %, and Fe as the remainder was brought into rotational contact with an outer peripheral surface of the ring-shaped test piece with load of 5 kg applied, and the rotation shaft was rotated at 209 rpm while multi oil was dripped onto the outer peripheral surface of the test piece (in early stage of test, the test surface excessively got wet, and then the multi oil was supplied by dripping 10 mL per day). The rotation of the test piece was stopped at the time when the number of rotations of the test piece reached 100,000 times, and a difference in weight before and after the rotation of the test piece, that is, wear loss (mg) was measured. It can be said that wear resistance of copper alloy is excellent as the wear loss is less.

Results of the above-described tests will be described. Tables 4 and 5 show a result in the process K0.

TABLE 4

| | | | | Extruding Completion | | After Final Process | | | | | | |
|---|---|---|---|---|---|---|---|---|---|---|---|---|
| | | | | | | | Precipitates | | | | | |
| | Alloy No. | Proc. No. | Test No. | Outer Diameter mm | Avg. Grain Size μm | Final Outer Diameter mm | Avg. Grain Diameter nm | Ratio of 30 nm or less % | Tensile Strength N/mm$^2$ | Vickers Hardness HV | Elongation % | Rockwell Hardness HRB |
| First Inv. Alloy | 11 | K0 | G1 | 25 | 35 | 25 | | | 260 | 55 | 55 | 12 |
| Second Inv. Alloy | 21 | K0 | G2 | 25 | 40 | 25 | | | 255 | 53 | 56 | 10 |
| | 22 | K0 | G3 | 25 | 35 | 25 | | | 264 | 60 | 56 | 12 |
| Third Inv. Alloy | 31 | K0 | G4 | 25 | 35 | 25 | | | 265 | 56 | 57 | 12 |
| | 35 | K0 | G5 | 25 | 45 | 25 | | | 254 | 50 | 53 | 8 |
| Comp. Alloy | 372 | K0 | G11 | 25 | 30 | 25 | | | 265 | 56 | 55 | 10 |
| | 41 | K0 | G6 | 25 | 85 | 25 | | | 250 | 48 | 48 | 6 |
| | 42 | K0 | G7 | 25 | 90 | 25 | | | 251 | 48 | 46 | 5 |
| CrZr—Cu | 52 | K0 | G8 | 25 | 65 | 25 | | | 255 | 65 | 53 | 12 |

TABLE 5

| | | | | After Final Process | | | | |
|---|---|---|---|---|---|---|---|---|
| | | | | | | | After Heating 700° C. 120 sec | |
| | Alloy No. | Proc. No. | Test No. | Repetitive Bending Times | Conductivity % IACS | Performance Index I | Vickers Hardness HV | Recrystallization Ratio % |
| First Inv. Alloy | 11 | K0 | G1 | | 42 | 2612 | 125 | 20 |
| Second Inv. Alloy | 21 | K0 | G2 | | 43 | 2609 | 116 | 25 |
| | 22 | K0 | G3 | | 37 | 2505 | | |
| Third Inv. Alloy | 31 | K0 | G4 | | 41 | 2664 | 121 | 20 |
| | 35 | K0 | G5 | | 44 | 2578 | 110 | 30 |
| Comp. Alloy | 372 | K0 | G11 | | 44 | 2725 | | |
| | 41 | K0 | G6 | | 52 | 2668 | | |
| | 42 | K0 | G7 | | 55 | 2718 | 63 | 100 |
| CrZr—Cu | 52 | K0 | G8 | | 45 | 2617 | | |

| | | After Final Process | | | | | | |
|---|---|---|---|---|---|---|---|---|
| | | After Heating 700° C. 120 sec | | | | | | |
| | Alloy No. | Conductivity % IACS | Avg. Grain Diameter of Precipitates nm | Ratio of Precipitates of 30 nm or less % | 400° C. High Temp. Tensile Strength N/mm$^2$ | After Cold Compression Rockwell Hardness HRB | After Cold Compression Conductivity % IACS | wear Loss mg |
| First Inv. Alloy | 11 | 69 | 4.6 | 99 | | 85 | 76 | |
| Second Inv. Alloy | 21 | 70 | 5.2 | 100 | | 86 | 78 | |
| | 22 | | | | | 89 | 60 | |
| Third Inv. Alloy | 31 | 67 | 5.0 | 100 | | 85 | 72 | |
| | 35 | | | | | 85 | 76 | |
| Comp. Alloy | 372 | | | | | 86 | 77 | |
| | 41 | | | | | 62 | 74 | |
| | 42 | 66 | 29 | 40 | | 58 | 78 | |
| CrZr—Cu | 52 | | | | | 80 | 86 | |

The invention alloy has an average grain size smaller than that of the comparative alloy or Cr—Zr copper. Tensile strength or hardness of the invention alloy is slightly higher than that of the comparative alloy, but an elongation value is clearly higher than that and conductivity is lower than that. There are a few cases that the pipe, rod, or wire is used in the extruding-completed state, the pipe, rod, or wire is used after performing various kinds of processes. Accordingly, it is preferable that the pipe, rod, or wire be soft in the extruding-completed state, and conductivity may be low. When the heat treatment is performed after the cold compression, hardness becomes higher than that of the comparative alloy. Conductivity of the invention alloy except for No. 22 alloy in which Sn concentration is high becomes 70% IACS or higher. In the high temperature test of 700° C. using the compressed test pieces which are not subjected to a heat treatment, conductivity becomes 65% IACS or higher, that is, conductivity is improved by about 25% IACS as compared with the case before the heating. Vickers hardness is 110 or more, and a recrystallization ratio is as low as about 20%, which are more excellent than those of the comparative alloy. It is considered that the reason is because most of Co, P, and the like in a solid solution state are precipitated, conductivity becomes high, an average grain diameter of the precipitates is as fine as about 5 nm, and thus recrystallization is prevented.

Tables 6 and 7 show a result in the process K01.

TABLE 6

| | | | | Extruding | | After Final Process | | | | | | |
|---|---|---|---|---|---|---|---|---|---|---|---|---|
| | | | | Completion | | | Precipitates | | | | | |
| | Alloy No. | Proc. No. | Test No. | Outer Diameter mm | Avg. Grain Size μm | Final Outer Diameter mm | Avg. Grain Diameter nm | Ratio of 30 nm or less % | Tensile Strength N/mm$^2$ | Vickers Hardness HV | Elongation % | Rockwell Hardness HRB |
| First Inv. Alloy | 11 | K01 | G11 | 25 | 35 | 22 | | | 350 | 101 | 27 | 53 |
| Second Inv. Alloy | 21 | K01 | G12 | 25 | 40 | 22 | | | 343 | 99 | 27 | 52 |
| Third Inv. Alloy | 31 | K01 | G13 | 25 | 35 | 22 | | | 348 | 101 | 28 | 53 |
| | 371 | K01 | G16 | 25 | 30 | 22 | | | 364 | 104 | 27 | 54 |
| Comp. Alloy | 45 | K01 | G14 | 25 | 70 | 22 | | | 312 | 86 | 25 | 45 |
| C1100 | 51 | K01 | G15 | 25 | 120 | 22 | $Cu_2O$ of 2 μm formed | | 309 | 85 | 23 | 41 |

TABLE 7

| | | | | After Final Process | | | After Heating 700° C. 120 sec | |
|---|---|---|---|---|---|---|---|---|
| | Alloy No. | Proc. No. | Test No. | Repetitive Bending Times | Conductivity % IACS | Performance Index I | Vickers Hardness HV | Recrystallization Ratio % |
| First Inv. Alloy | 11 | K01 | G11 | | 42 | 2881 | 127 | 20 |
| Second Inv. Alloy | 21 | K01 | G12 | | 44 | 2890 | | |
| Third Inv. Alloy | 31 | K01 | G13 | | 40 | 2817 | 120 | 20 |
| | 371 | K01 | G16 | | 44 | 3086 | 133 | 10 |
| Comp. Alloy | 45 | K01 | G14 | | 53 | 2839 | 62 | 100 |
| C1100 | 51 | K01 | G15 | | 99 | 3801 | 37 | 100 |

TABLE 7-continued

| | | After Final Process | | | | | | |
|---|---|---|---|---|---|---|---|---|
| | | After Heating 700° C. 120 sec | | | | | | |
| | | | Avg. Grain Diameter | Ratio of Precipitates | 400° C. High Temp. | After Cold Compression | | |
| | Alloy No. | Conductivity % IACS | of Precipitates nm | of 30 nm or less % | Tensile Strength N/mm$^2$ | Rockwell Hardness HRB | Conductivity % IACS | wear Loss mg |
| First Inv. Alloy | 11 | 69 | 4.9 | 99 | | 86 | 77 | |
| Second Inv. Alloy | 21 | | | | | | | |
| Third | 31 | 68 | 5.5 | 99 | | 86 | 73 | |
| Inv. | 371 | | | | | 87 | 79 | |
| Alloy Comp. Alloy | 45 | 59 | | | | 69 | 67 | |
| C1100 | 51 | 101 | | | 66 | 64 | 99 | 670 |

In C1100, an average grain size at the extruding completion is large, and created materials of $Cu_2O$ are generated. In the invention alloy, tensile strength, hardness, or the like is slightly higher than that of the comparative alloy or C1100, and there is a little difference from that in the process K0. Similarly to the process K0, in this step, there is no large difference in the performance index I. However, similarly to the process K0, when the heat treatment is performed after the cold compression, hardness becomes higher than that of the comparative alloy, and conductivity becomes 70% IACS or higher. In the high temperature heat of 700° C. using the compressed test pieces which are not subjected to a heat treatment, conductivity becomes 65% IACS or higher, that is, conductivity is improved by about 25% IACS than the case before heating. Vickers hardness is about 120, and a recrystallization ratio is as low as about 20%. It is considered that conductivity is improved by precipitation, the average grain diameter of the precipitates is as fine as about 5 nm, and thus recrystallization is prevented.

Tables 8 and 9 show a result in the process K1.

TABLE 8

| | | | | Extruding Completion | | After Final Process | | | | | | |
|---|---|---|---|---|---|---|---|---|---|---|---|---|
| | | | | | | | Precipitates | | | | | |
| | Alloy No. | Proc. No. | Test No. | Outer Diameter mm | Avg. Grain Size μm | Final Outer Diameter mm | Avg. Grain Diameter nm | Ratio of 30 nm or less % | Tensile Strength N/mm$^2$ | Vickers Hardness HV | Elongation % | Rockwell Hardness HRB |
| First | 11 | K1 | 1 | 25 | 35 | 22 | | | 448 | 133 | 30 | 67 |
| Inv. | 12 | K1 | 2 | 25 | 55 | 22 | | | 408 | 116 | 31 | 56 |
| Alloy | 13 | K1 | 3 | 25 | 50 | 22 | | | 436 | 124 | 31 | 64 |
| Second | 21 | K1 | 4 | 25 | 40 | 22 | | | 439 | 125 | 30 | 66 |
| Inv. | 22 | K1 | 5 | 25 | 35 | 22 | | | 465 | 140 | 30 | 70 |
| Alloy | 23 | K1 | 6 | 25 | 35 | 22 | | | 460 | 138 | 28 | 69 |
| | 24 | K1 | 7 | 25 | 40 | 22 | | | 435 | 124 | 30 | 65 |
| Third | 31 | K1 | 8 | 25 | 35 | 22 | | | 449 | 132 | 29 | 67 |
| Inv. | 32 | K1 | 9 | 25 | 40 | 22 | | | 447 | 131 | 29 | 66 |
| Alloy | 33 | K1 | 10 | 25 | 50 | 22 | | | 433 | 128 | 28 | 65 |
| | 34 | K1 | 11 | 25 | 50 | 22 | | | 435 | 135 | 28 | 65 |
| | 35 | K1 | 12 | 25 | 45 | 22 | | | 422 | 123 | 30 | 61 |
| | 36 | K1 | 13 | 25 | 35 | 22 | | | 453 | 134 | 30 | 67 |
| | 371 | K1 | 301 | 25 | 30 | 22 | | | 459 | 141 | 30 | 70 |
| | 372 | K1 | 302 | 25 | 30 | 22 | | | 467 | 144 | 28 | 70 |
| | 373 | K1 | 303 | 25 | 35 | 22 | | | 438 | 127 | 31 | 65 |
| | 374 | K1 | 304 | 25 | 35 | 22 | | | 440 | 129 | 30 | 66 |
| | 375 | K1 | 305 | 25 | 30 | 22 | | | 470 | 142 | 28 | 72 |

TABLE 8-continued

| | | | | Extruding | | After Final Process | | | | | | |
|---|---|---|---|---|---|---|---|---|---|---|---|---|
| | | | | Completion | | | Precipitates | | | | | |
| | Alloy No. | Proc. No. | Test No. | Outer Diameter mm | Avg. Grain Size μm | Final Outer Diameter mm | Avg. Grain Diameter nm | Ratio of 30 nm or less % | Tensile Strength N/mm$^2$ | Vickers Hardness HV | Elongation % | Rockwell Hardness HRB |
| Comp. | 41 | K1 | 14 | 25 | 85 | 22 | | | 293 | 80 | 43 | 33 |
| Alloy | 42 | K1 | 15 | 25 | 90 | 22 | | | 287 | 77 | 43 | 30 |
| | 43 | K1 | 16 | 25 | 80 | 22 | | | 343 | 100 | 36 | 46 |
| | 44 | K1 | 17 | 25 | 75 | 22 | | | 355 | 104 | 34 | 48 |
| | 45 | K1 | 18 | 25 | 70 | 22 | | | 363 | 106 | 34 | 51 |
| | 46 | K1 | 19 | 25 | 40 | 22 | | | 483 | 147 | 29 | 75 |
| | 47 | K1 | 20 | 25 | 65 | 22 | | | 347 | 102 | 35 | 46 |
| | 48 | K1 | 21 | 25 | 55 | 22 | | | 380 | 110 | 26 | 53 |
| | 49 | K1 | 22 | 25 | 50 | 22 | | | 410 | 114 | 21 | 60 |
| C1100 | 51 | K1 | 23 | 25 | 120 | 22 | | | 292 | 81 | 26 | 36 |
| CrZr—Cu | 52 | K1 | 24 | 25 | 80 | 22 | | | 438 | 128 | 22 | 63 |

TABLE 9

| | | | | After Final Process | | | After Heating 700° C. 120 sec | |
|---|---|---|---|---|---|---|---|---|
| | Alloy No. | Proc. No. | Test No. | Repetitive Bending Times | Conductivity % IACS | Performance Index I | Vickers Hardness HV | Recrystallization Ratio % |
| First | 11 | K1 | 1 | | 79 | 5176 | 121 | 10 |
| Inv. | 12 | K1 | 2 | | 75 | 4629 | 102 | 25 |
| Alloy | 13 | K1 | 3 | | 71 | 4813 | | |
| Second | 21 | K1 | 4 | | 80 | 5104 | 111 | 10 |
| Inv. | 22 | K1 | 5 | | 60 | 4682 | | |
| Alloy | 23 | K1 | 6 | | 77 | 5167 | 123 | 5 |
| | 24 | K1 | 7 | | 80 | 5058 | 108 | 20 |
| Third | 31 | K1 | 8 | | 77 | 5083 | 115 | 15 |
| Inv. | 32 | K1 | 9 | | 80 | 5158 | 117 | 10 |
| Alloy | 33 | K1 | 10 | | 72 | 4703 | 106 | 25 |
| | 34 | K1 | 11 | | 74 | 4790 | | |
| | 35 | K1 | 12 | | 78 | 4845 | | |
| | 36 | K1 | 13 | | 75 | 5100 | 120 | 10 |
| | 371 | K1 | 301 | | 81 | 5370 | 132 | 0 |
| | 372 | K1 | 302 | | 80 | 5347 | 131 | 0 |
| | 373 | K1 | 303 | | 77 | 5035 | 113 | 10 |
| | 374 | K1 | 304 | | 78 | 5052 | 115 | 10 |
| | 375 | K1 | 305 | | 74 | 5175 | 128 | 5 |
| Comp. | 41 | K1 | 14 | | 76 | 3653 | 60 | 100 |
| Alloy | 42 | K1 | 15 | | 77 | 3601 | 57 | 100 |
| | 43 | K1 | 16 | | 71 | 3931 | 65 | 95 |
| | 44 | K1 | 17 | | 73 | 4064 | 73 | 80 |
| | 45 | K1 | 18 | | 67 | 3982 | 77 | 80 |
| | 46 | K1 | 19 | | 45 | 4180 | | |
| | 47 | K1 | 20 | | 66 | 3806 | 69 | 90 |
| | 48 | K1 | 21 | | 73 | 4091 | | |
| | 49 | K1 | 22 | | 65 | 4000 | | |
| C1100 | 51 | K1 | 23 | | 101 | 3698 | | |
| CrZr—Cu | 52 | K1 | 24 | | 87 | 4984 | 92 | 30 |

TABLE 9-continued

| | | After Final Process | | | | | | |
|---|---|---|---|---|---|---|---|---|
| | | After Heating 700° C. 120 sec | | | 400° C. High Temp. | After Cold Compression | | |
| | Alloy No. | Conductivity % IACS | Avg. Grain Diameter of Precipitates nm | Ratio of Precipitates of 30 nm or less % | Tensile Strength N/mm$^2$ | Rockwell Hardness HRB | Conductivity % IACS | Wear Loss mg |
| First | 11 | 71 | 4.8 | 99 | 275 | 91 | 77 | 65 |
| Inv. | 12 | | | | 245 | | | 84 |
| Alloy | 13 | | | | | 92 | 70 | 56 |
| Second | 21 | 72 | 4.7 | 99 | 267 | 90 | 77 | 76 |
| Inv. | 22 | | | | | 94 | 59 | 42 |
| Alloy | 23 | | | | 288 | | | 58 |
| | 24 | | | | 260 | | | |
| Third | 31 | 69 | 5.0 | 100 | 258 | | | |
| Inv. | 32 | | | | | | | |
| Alloy | 33 | | | | | | | |
| | 34 | | | | | | | |
| | 35 | | | | 255 | | | 82 |
| | 36 | | | | 264 | | | 72 |
| | 371 | | | | 285 | 91 | 79 | 45 |
| | 372 | | | | 290 | | | 62 |
| | 373 | | | | 260 | | | 68 |
| | 374 | | | | 257 | | | 72 |
| | 375 | | | | 278 | | | 57 |
| Comp. | 41 | | | | 102 | 74 | 74 | 503 |
| Alloy | 42 | 67 | 31 | 40 | | 75 | 75 | |
| | 43 | | | | 118 | 79 | 69 | |
| | 44 | | | | 113 | 80 | 72 | 225 |
| | 45 | | | | 135 | 82 | 65 | |
| | 46 | | | | | | | |
| | 47 | | | | 123 | | | 206 |
| | 48 | | | | | | | |
| | 49 | | | | | | | |
| C1100 | 51 | | | | 64 | 64 | 99 | 695 |
| CrZr—Cu | 52 | | | | 234 | 90 | 85 | 70 |

In the invention alloy, an average grain size at the extruding completion is smaller than that of the comparative alloy or C1100, and tensile strength, Vickers hardness, and Rockwell hardness are satisfactory. In addition, elongation is higher than that of C1100. In most of the invention alloy, conductivity is at least 70% of C1100. In the invention alloy, Vickers hardness after heating at 700° C. and high-temperature tensile strength at 400° C. are even higher than those of the comparative alloy or C1100. In the invention alloy, Rockwell hardness after a cold compression is higher than that of the comparative alloy or C1100. Wear loss is even lower than that of the comparative alloy or C1100, and the invention alloy including a large amount of Sn and Ag is satisfactory. The invention alloy is high strength and high conductivity copper alloy, and it is preferable that the invention be, if possible, in the middle of the ranges of the formulas X1, X2, and X3, and the composition ranges.

Table 10 shows tensile strength, elongation, Vickers hardness, and conductivity of rods after heating at 700° C. for 120 seconds after the process K1 and the process K01.

TABLE 10

| | | Heating 700° C. 120 sec After Process K1 | | | | Heating 700° C. 120 sec After Process K10 | | | |
|---|---|---|---|---|---|---|---|---|---|
| | Alloy No. | Tensile Strength N/mm$^2$ | Elongation % | Vickers Hardness HV | Conductivity % IACS | Tensile Strength N/mm$^2$ | Elongation % | Vickers Hardness HV | Conductivity % IACS |
| First Inv. Alloy | 11 | 412 | 33 | 119 | 71 | 414 | 34 | 119 | 70 |
| Second Inv. Alloy | 21 | 396 | 35 | 111 | 72 | 395 | 33 | 113 | 71 |
| Third Inv. Alloy | 31 | 418 | 32 | 116 | 70 | 416 | 31 | 117 | 68 |

In the process K01 in which the heat treatment TH1 is not performed, tensile strength, elongation, Vickers hardness, and conductivity are equivalent to those in the process K1 in which the heat treatment TH1 is performed. In the process K01, even when heating at 700° C. is performed, a recrystallization ratio is low. It is considered that the reason is because precipitation of Co, P, and the like occurs to suppress recrystallization. From this result, when heating at 700° C. for about 120 seconds is performed on a material of the invention alloy, in which a precipitation is not performed, by brazing or the like, it is not necessary to perform the precipitation process.

Tables 11 and 12 show results in the process K2, K3, K4, and K5 together with the result in the process K1.

TABLE 11

| | | | | Extruding | | After Final Process | | | | | | |
|---|---|---|---|---|---|---|---|---|---|---|---|---|
| | | | | Completion | | | Precipitates | | | | | |
| | Alloy No. | Proc. No. | Test No. | Outer Diameter Mm | Avg. Grain Size μm | Final Outer Diameter mm | Avg. Grain Diameter nm | Ratio of 30 nm or less % | Tensile Strength N/mm$^2$ | Vickers Hardness HV | Elongation % | Rockwell Hardness HRB |
| First | 11 | K1 | 1 | 25 | 35 | 22 | | | 448 | 133 | 30 | 67 |
| Inv. | | K2 | 31 | 25 | 35 | 20 | | | 485 | 154 | 21 | 74 |
| Alloy | | K3 | 32 | 25 | 40 | 25 | 3.0 | 100 | 394 | 110 | 39 | 56 |
| | | K4 | 33 | 25 | 35 | 22 | | | 460 | 138 | 22 | 68 |
| | | K5 | 34 | 25 | 35 | 25 | 2.9 | 100 | 400 | 112 | 40 | 57 |
| | 12 | K1 | 2 | 25 | 55 | 22 | | | 408 | 116 | 31 | 56 |
| | | K2 | 35 | 25 | 55 | 20 | | | 432 | 125 | 24 | 65 |
| | | K3 | 36 | 25 | 55 | 25 | 3.2 | 99 | 368 | 108 | 40 | 52 |
| Second | 21 | K1 | 4 | 25 | 40 | 22 | | | 439 | 125 | 30 | 66 |
| Inv. | | K2 | 37 | 25 | 40 | 20 | | | 474 | 149 | 21 | 72 |
| Alloy | | K3 | 38 | 25 | 40 | 25 | 2.6 | 100 | 386 | 107 | 39 | 55 |
| | | K4 | 39 | 25 | 40 | 22 | | | 448 | 132 | 22 | 66 |
| Third | 31 | K1 | 8 | 25 | 35 | 22 | | | 449 | 132 | 29 | 67 |
| Inv. | | K2 | 40 | 25 | 35 | 20 | | | 485 | 150 | 22 | 73 |
| Alloy | | K3 | 41 | 25 | 35 | 25 | 2.8 | 100 | 392 | 108 | 39 | 56 |
| | | K4 | 42 | 25 | 35 | 22 | | | 458 | 138 | 24 | 68 |
| | | K5 | 43 | 25 | 35 | 25 | 2.8 | 100 | 399 | 112 | 40 | 57 |
| | 32 | K1 | 9 | 25 | 40 | 22 | | | 447 | 131 | 29 | 66 |
| | | K3 | 44 | 25 | 40 | 25 | 3.0 | 99 | 393 | 110 | 40 | 54 |
| | | K4 | 45 | 25 | 40 | 22 | | | 456 | 136 | 25 | 68 |
| | 33 | K1 | 10 | 25 | 50 | 22 | | | 433 | 128 | 28 | 65 |
| | | K2 | 46 | 25 | 50 | 20 | | | 470 | 147 | 21 | 72 |
| | 36 | K1 | 13 | 25 | 35 | 22 | | | 453 | 134 | 30 | 67 |
| | | K2 | 47 | 25 | 35 | 22 | | | 490 | 150 | 22 | 74 |
| | 371 | K1 | 301 | 25 | 30 | 22 | | | 459 | 141 | 30 | 70 |
| | | K2 | 306 | 25 | 30 | 20 | | | 496 | 155 | 22 | 76 |
| | | K3 | 307 | 25 | 35 | 25 | 2.7 | 100 | 410 | 113 | 38 | 59 |
| | 372 | K1 | 302 | 25 | 30 | 22 | | | 467 | 144 | 28 | 70 |
| | | K2 | 309 | 25 | 30 | 20 | | | 493 | 153 | 22 | 75 |
| | | K3 | 310 | 25 | 30 | 25 | 2.7 | 100 | 412 | 112 | 39 | 60 |
| | 373 | K1 | 303 | 25 | 35 | 22 | | | 438 | 127 | 31 | 65 |
| | | K2 | 312 | 25 | 35 | 20 | | | 475 | 150 | 24 | 72 |
| Comp. | 41 | K1 | 14 | 25 | 85 | 22 | | | 293 | 80 | 43 | 33 |
| Alloy | | K2 | 48 | 25 | 85 | 20 | | | 337 | 96 | 31 | 45 |
| | | K3 | 49 | 25 | 85 | 25 | 18 | 93 | 287 | 79 | 45 | 32 |
| | | K4 | 50 | 25 | 85 | 22 | | | 329 | 93 | 30 | 44 |
| | 42 | K1 | 15 | 25 | 90 | 22 | | | 287 | 77 | 43 | 30 |
| | | K2 | 51 | 25 | 90 | 20 | | | 335 | 94 | 30 | 44 |
| | | K3 | 52 | 25 | 90 | 25 | 21 | 92 | 267 | 62 | 48 | 10 |
| | 43 | K1 | 16 | 25 | 80 | 22 | | | 343 | 100 | 36 | 46 |
| | | K2 | 53 | 25 | 80 | 20 | | | 385 | 112 | 27 | 53 |
| | | K3 | 54 | 25 | 80 | 25 | | | 316 | 88 | 44 | 42 |
| | 44 | K1 | 17 | 25 | 75 | 22 | | | 355 | 104 | 34 | 48 |
| | | K3 | 55 | 25 | 75 | 25 | | | 340 | 100 | 39 | 45 |
| | 47 | K1 | 20 | 25 | 65 | 22 | | | 347 | 102 | 35 | 46 |
| | | K3 | 56 | 25 | 65 | 25 | 21 | 90 | 330 | 98 | 42 | 44 |
| | 48 | K1 | 21 | 25 | 55 | 22 | | | 380 | 110 | 26 | 53 |
| | | K3 | 57 | 25 | 55 | 25 | | | 351 | 103 | 35 | 48 |
| CrZr—Cu | 52 | K1 | 24 | 25 | 80 | 22 | | | 438 | 128 | 22 | 63 |
| | | K3 | 58 | 25 | 80 | 25 | | | 372 | 106 | 33 | 50 |

TABLE 12

| | | | | After Final Process | | | | | | | | | | | |
|---|---|---|---|---|---|---|---|---|---|---|---|---|---|---|---|
| | | | | | | After Heating 700° C. 120 sec | | | | | | | After Cold Compression | | |
| | Alloy No. | Proc. No. | Test No. | Repetitive Bending Times | Conductivity % IACS | Performance Index I | Vickers Hardness HV | Recrystallization Ratio % | Conductivity % IACS | Avg. Grain Diameter of Precipitates nm | Ratio of Precipitates of 30 nm or less % | 400° C. High Temp. Tensile Strength N/mm$^2$ | Rockwell Hardness HRB | Conductivity % IACS | Wear Loss mg |
| First | 11 | K1 | 1 | | 79 | 5176 | 121 | 10 | 71 | 4.8 | 99 | 275 | 91 | 77 | 65 |
| Inv. | | K2 | 31 | | 78 | 5183 | 133 | | | | | | | | |
| Alloy | | K3 | 32 | | 79 | 4868 | 102 | | 71 | 5.2 | 100 | 229 | 90 | 77 | |
| | | K4 | 33 | | 78 | 4956 | 120 | | | | | | | | |
| | | K5 | 34 | | 80 | 5009 | | | | | | | | | |
| | 12 | K1 | 2 | | 75 | 4629 | | | | | | | | | 84 |
| | | K2 | 35 | | 74 | 4608 | | | | | | | | | |
| | | K3 | 36 | | 76 | 4491 | | | | | | | | | |
| Second | 21 | K1 | 4 | | 80 | 5104 | 111 | 10 | 72 | 4.7 | 99 | 267 | 90 | 77 | 76 |
| Inv. | | K2 | 37 | | 79 | 5098 | | | | | | | | | |
| Alloy | | K3 | 38 | | 80 | 4799 | 100 | | 71 | 4.8 | 100 | 220 | 89 | 77 | |
| | | K4 | 39 | | 79 | 4858 | | | | | | | | | |
| Third | 31 | K1 | 8 | | 77 | 5083 | 115 | 15 | 69 | 5.0 | 100 | 258 | | | |
| Inv. | | K2 | 40 | | 75 | 5124 | 132 | 15 | 68 | 5.1 | 99 | | | | |
| Alloy | | K3 | 41 | | 75 | 4719 | 100 | | | 5.4 | 99 | | | | |
| | | K4 | 42 | | 75 | 4918 | 121 | | | | | 248 | 89 | 73 | |
| | | K5 | 43 | | 77 | 4902 | | | | | | | 89 | 74 | |
| | 32 | K1 | 9 | | 80 | 5158 | 117 | 10 | | | | | | | |
| | | K3 | 44 | | 79 | 4890 | | | | | | | | | |
| | | K4 | 45 | | 78 | 5034 | 120 | 20 | | | | | | | |
| | 33 | K1 | 10 | | 72 | 4703 | 106 | 25 | | | | | | | |
| | | K2 | 46 | | 71 | 4792 | | | | | | | | | |
| | 36 | K1 | 13 | | 75 | 5100 | 120 | 10 | | | | 264 | | | |
| | | K2 | 47 | | 74 | 5142 | | | | | | | | | |
| | 371 | K1 | 301 | | 81 | 5370 | 132 | 0 | | | | 285 | 91 | 79 | 45 |
| | | K2 | 306 | | 80 | 5412 | | | | | | | | | |
| | | K3 | 307 | | 81 | 5092 | 107 | | | 4.5 | | 240 | 91 | 70 | |
| | 372 | K1 | 302 | | 80 | 5347 | 131 | 0 | | | | 290 | | | 62 |
| | | K2 | 309 | | 79 | 5346 | | | | | | | | | |
| | | K3 | 310 | | 79 | 5090 | 105 | | | 4.8 | | | | | |
| | 373 | K1 | 303 | | 77 | 5035 | 113 | 10 | | | | 260 | | | 68 |
| | | K2 | 312 | | 77 | 5168 | | | | | | | | | |

TABLE 12-continued

| | | | | After Final Process | | | | | | | | | | | | |
|---|---|---|---|---|---|---|---|---|---|---|---|---|---|---|---|---|
| | | | | | | | After Heating 700° C. 120 sec | | | | | | | | | |
| | Alloy No. | Proc. No. | Test No. | Repetitive Bending Times | Conductivity % IACS | Performance Index I | Vickers Hardness HV | Recrystallization Ratio % | Conductivity % IACS | Avg. Grain Diameter of Precipitates nm | Ratio of Precipitates of 30 nm or less % | 400° C. High Temp. Tensile Strength N/mm$^2$ | After Cold Compression Rockwell Hardness HRB | After Cold Compression Conductivity % IACS | After Cold Compression Wear Loss mg |
| Comp. Alloy | 41 | K1 | 14 | | 76 | 3653 | 60 | 100 | | | | 102 | 74 | 74 | 503 |
| | | K2 | 48 | | 75 | 3823 | | | | | | | | | |
| | | K3 | 49 | | 75 | 3604 | | | | | | | | | |
| | | K4 | 50 | | 75 | 3704 | 64 | 100 | | | | 105 | | | |
| | 42 | K1 | 15 | | 77 | 3601 | 57 | 100 | 67 | 31 | 40 | | 75 | 75 | |
| | | K2 | 51 | | 76 | 3797 | 59 | 100 | 66 | 38 | 45 | 95 | | | |
| | | K3 | 52 | | 77 | 3468 | | | | | | | | | |
| | 43 | K1 | 16 | | 71 | 3931 | 65 | 95 | | | | 118 | 79 | 69 | |
| | | K2 | 53 | | 70 | 4091 | 68 | | | | | | | | |
| | | K3 | 54 | | 71 | 3834 | | | | | | | | | |
| | 44 | K1 | 17 | | 73 | 4064 | 73 | 80 | | | | 113 | 80 | 72 | 225 |
| | | K3 | 55 | | 73 | 4038 | 75 | 35 | 64 | 35 | 45 | | | | |
| | 47 | K1 | 20 | | 66 | 3806 | 69 | 90 | | | | 123 | | | 206 |
| | | K3 | 56 | | 66 | 3807 | | | | | | | | | |
| | 48 | K1 | 21 | | 73 | 4091 | | | | | | | | | |
| | | K3 | 57 | | 73 | 4049 | | | | | | | | | |
| CrZr—Cu | 52 | K1 | 24 | | 87 | 4984 | 92 | 30 | | | | 234 | 90 | 85 | 70 |
| | | K3 | 58 | | 87 | 4615 | | | | | | 198 | | | |

Figure 10:
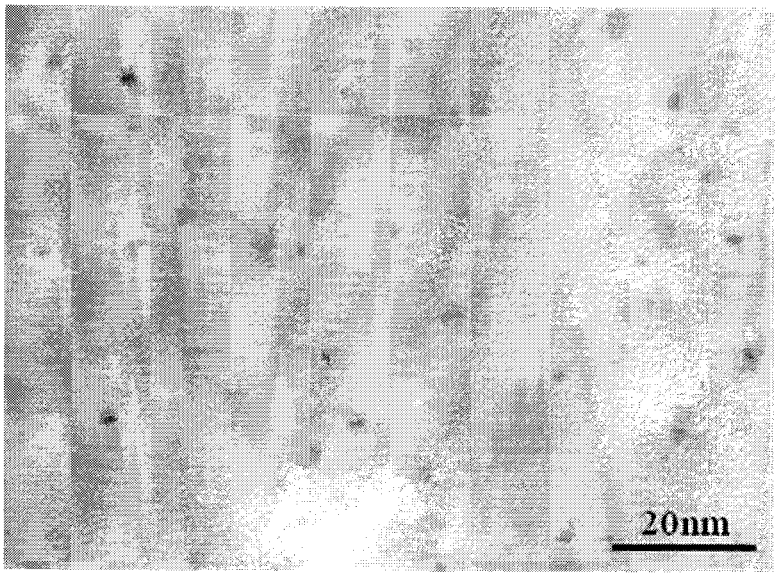
FIG. 10 is a metal structure photograph of precipitates in a process K3 of the high performance copper pipe, rod, or wire.

In the invention alloy, tensile strength, Vickers hardness, and the like are satisfactory even in the processes K3 and K5 in which only the heat treatment TH1 is performed after the extruding. In the invention alloy, elongation becomes low in the processes K2 and K4 in which a drawing process is performed after the heat treatment TH1, but tensile strength or Vickers hardness becomes even higher. In the invention alloy, an average grain diameter of precipitates in the process K3 is small, and a ratio of precipitates of 30 nm or less is low, as compared with those of the comparative alloy. In the invention alloy, mechanical characteristics such as tensile strength and Vickers hardness are more satisfactory than those of the comparative alloy or C1100 in the processes K2, K3, and K4. FIG. 10 is a transmission electron image in the process K3 of Alloy No. 11. An average grain diameter of the precipitates is as fine as 3 nm, and the precipitates are uniformly distributed. In the pipe, rod, or wire in which the invention alloy is produced by the producing process according to the embodiment, as well as the samples in the process K3 of Alloy No. 11, as for all the samples, of which data of diameters of precipitates is described in Table 11, or the later-described Table 21, 24, 25, and 31, a distance between the most adjacent precipitates of 90% or higher was 150 nm or less in any area of 1000 nm×1000 nm. In addition, there were 25 or more precipitates in any area of 1000 nm×1000 nm. That is, it can be said that the precipitates are uniformly distributed.

Figure 11:
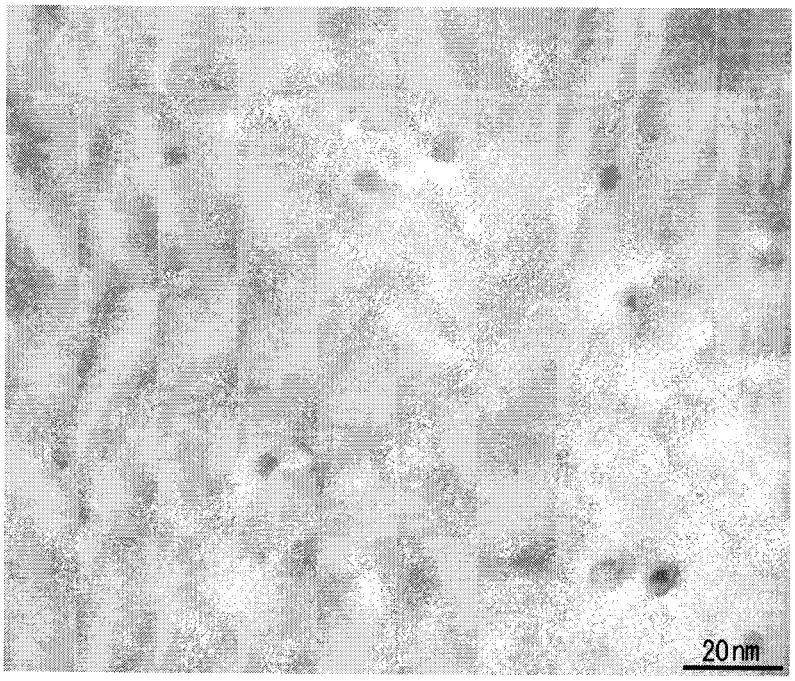
FIG. 11 is a metal structure photograph of precipitates after heating for 120 seconds at 700° C. in a compression process material of a process K0 of the high performance copper pipe, rod, or wire.

In the invention, regardless of the heat treatment TH1 and rod or compression-processed material, an average grain diameter of the precipitates after heating at 700° C. for 120 seconds is as fine as about 5 nm. Accordingly, it is considered that recrystallization is suppressed by the precipitates. FIG. 11 is a transmission electron image after heating at 700° C. for 120 seconds to the compression-processed material in the process K0 of Alloy No. 11. An average diameter of the precipitates is as fine as 4.6 nm, there is substantially no coarse precipitates of 30 nm or more, and the precipitates are uniformly distributed. When heating at 700° C. for 120 seconds is performed after the heat treatment TH1, there are fine precipitates in a state where most of precipitates is not solid-dissolved again. Accordingly, decrease in conductivity is fixed by 10% IACS or lower, even as compared with the state after the heat treatment TH1 (see Test No. 1 and 32 in Tables 11 and 12).

Tables 13 and 14 show results in the processes L1 to L4 together with the result in the process K1.

TABLE 13

| | | | | Extruding | | After Final Process | | | | | | |
|---|---|---|---|---|---|---|---|---|---|---|---|---|
| | | | | Completion | | | Precipitates | | | | | |
| | Alloy No. | Proc. No. | Test No. | Outer Diameter mm | Avg. Grain Size μm | Final Outer Diameter mm | Avg. Grain Diameter nm | Ratio of 30 nm or less % | Tensile Strength N/mm$^2$ | Vickers Hardness HV | Elongation % | Rockwell Hardness HRB |
| First Inv. Alloy | 11 | L1 | 61 | 25 | Partly Non-recrystallized | 22 | | | 375 | 114 | 29 | 51 |
| | | L2 | 62 | 25 | 30 | 22 | | | 422 | 123 | 32 | 63 |
| | | L3 | 63 | 25 | 55 | 22 | | | 455 | 136 | 27 | 68 |
| | | L4 | 64 | 25 | 80 | 22 | | | 436 | 127 | 20 | 66 |
| | | K1 | 1 | 25 | 35 | 22 | | | 448 | 133 | 30 | 67 |
| | 13 | L2 | 65 | 25 | 35 | 22 | | | 422 | 125 | 33 | 63 |
| | | K1 | 3 | 25 | 50 | 22 | | | 436 | 124 | 31 | 64 |
| Second Inv. Alloy | 21 | L1 | 66 | 25 | Non-recrystallized | 22 | | | 370 | 114 | 29 | 51 |
| | | L2 | 67 | 25 | 35 | 22 | | | 420 | 123 | 33 | 64 |
| | | L3 | 68 | 25 | 65 | 22 | | | 444 | 135 | 25 | 67 |
| | | L4 | 69 | 25 | 95 | 22 | | | 422 | 124 | 18 | 65 |
| | | K1 | 4 | 25 | 40 | 22 | | | 439 | 125 | 30 | 66 |
| Third Inv. Alloy | 31 | L1 | 70 | 25 | Non-recrystallized | 22 | | | 380 | 116 | 29 | 53 |
| | | L2 | 71 | 25 | 25 | 22 | | | 431 | 126 | 33 | 67 |
| | | L3 | 72 | 25 | 60 | 22 | | | 455 | 136 | 28 | 69 |
| | | L4 | 73 | 25 | 80 | 22 | | | 426 | 124 | 21 | 64 |
| | | K1 | 8 | 25 | 35 | 22 | | | 449 | 132 | 29 | 67 |

TABLE 14

| | | | | After Final Process | | | | | | | | | |
|---|---|---|---|---|---|---|---|---|---|---|---|---|---|
| | | | | | | After Heating 700° C. 120 sec | | | | After Cold Compression | | |
| | Alloy No. | Proc. No. | Test No. | Repetitive Bending Times | Conductivity % IACS | Performance Index I | Vickers Hardness HV | Recrystallization Ratio % | Avg. Grain Diameter of Precipitates nm | 400° C. High Temp. Tensile Strength N/mm$^2$ | Rockwell Hardness HRB | Conductivity % IACS | Wear Loss mg |
| First Inv. Alloy | 11 | L1 | 61 | | 80 | 4327 | | | | | | | |
| | | L2 | 62 | | 79 | 4951 | | | | 245 | | | |
| | | L3 | 63 | | 78 | 5103 | | | | 276 | | | |
| | | L4 | 64 | | 76 | 4561 | | | | | | | |
| | | K1 | 1 | | 79 | 5176 | 121 | 10 | | 275 | 91 | 77 | 65 |

TABLE 14-continued

| | | | | After Final Process | | | | | | | | | |
|---|---|---|---|---|---|---|---|---|---|---|---|---|---|
| | | | | | | | After Heating 700° C. 120 sec | | | | | | |
| | | | | | | | | | Avg. Grain Diameter | 400° C. High Temp. | After Cold Compression | | |
| | Alloy No. | Proc. No. | Test No. | Repetitive Bending Times | Conductivity % IACS | Performance Index I | Vickers Hardness HV | Recrystallization Ratio % | of Precipitates nm | Tensile Strength N/mm$^2$ | Rockwell Hardness HRB | Conductivity % IACS | Wear Loss mg |
| | 13 | L2 | 65 | | 72 | 4762 | | | | | | | |
| | | K1 | 3 | | 71 | 4813 | | | | | 92 | 70 | 70 |
| Second | 21 | L1 | 66 | | 80 | 4269 | | | | | | | |
| Inv. | | L2 | 67 | | 80 | 4996 | | | | | | | |
| Alloy | | L3 | 68 | | 78 | 4902 | | | | | 85 | 76 | |
| | | L4 | 69 | | 78 | 4398 | | | | | | | |
| | | K1 | 4 | | 80 | 5104 | 111 | | | 267 | 90 | 77 | 76 |
| Third | 31 | L1 | 70 | | 76 | 4273 | | | | | | | |
| Inv. | | L2 | 71 | | 76 | 4997 | | | | | | | |
| Alloy | | L3 | 72 | | 75 | 5044 | | | | | | | |
| | | L4 | 73 | | 74 | 4434 | | | | | | | |
| | | K1 | 8 | | 77 | 5083 | 115 | 15 | 5.0 | 258 | | | |

In the process L1 to the process L4, a heating temperature of a billet is different from that in the process K1. In the process L2 and the process L3, with in an appropriate temperature range for heating (840 to 960° C.), tensile strength, Vickers hardness, and the like are high, similarly to the process K1. On the other hand, in the process L1 lower than the proper temperature, there is a non-recrystallized part at the extruding completion, and tensile strength and Vickers hardness after the final process are low. In the process L4 in which the heating temperature is higher than the proper temperature, an average grain size at the extruding completion is large, and thus tensile strength, Vickers hardness, elongation, and conductivity after the final process are low. It is considered that strength becomes high, since a large amount of Co, P, and the like are solid-dissolved when the heating temperature is high.

Tables 15 and 16 show results in the processes P1 to P4 together with the result in the process K1.

TABLE 15

| | | | | Extruding | | | After Final Process | | | | | |
|---|---|---|---|---|---|---|---|---|---|---|---|---|
| | | | | Completion | | | Precipitates | | | | | |
| | Alloy No. | Proc. No. | Test No. | Outer Diameter mm | Avg. Grain Size μm | Final Outer Diameter mm | Avg. Grain Diameter nm | Ratio of 30 nm or less % | Tensile Strength N/mm$^2$ | Vickers Hardness HV | Elongation % | Rockwell Hardness HRB |
| First | 11 | K1 | 1 | 25 | 35 | 22 | | | 448 | 133 | 30 | 67 |
| Inv. | | P1 | 81 | 25 | 30 | 22 | | | 463 | 141 | 28 | 70 |
| Alloy | | P2 | 82 | 25 | 50 | 22 | | | 395 | 114 | 28 | 56 |
| | | P3 | 83 | 25 | 45 | 22 | | | 420 | 120 | 31 | 62 |
| | | P4 | 84 | 25 | 80 | 22 | | | 377 | 108 | 28 | 50 |
| Second | 21 | K1 | 4 | 25 | 40 | 22 | | | 439 | 125 | 30 | 66 |
| Inv. | | P1 | 85 | 25 | 30 | 22 | | | 455 | 138 | 27 | 70 |
| Alloy | | P2 | 86 | 25 | 60 | 22 | | | 386 | 110 | 28 | 56 |
| | | P3 | 87 | 25 | 50 | 22 | | | 416 | 118 | 30 | 63 |
| | | P4 | 88 | 25 | 90 | 22 | | | 360 | 107 | 28 | 50 |
| Third | 31 | K1 | 8 | 25 | 35 | 22 | | | 449 | 132 | 29 | 67 |
| Inv. | | P1 | 89 | 25 | 30 | 22 | | | 467 | 142 | 29 | 71 |
| Alloy | | P2 | 90 | 25 | 50 | 22 | | | 388 | 111 | 29 | 57 |
| | | P3 | 91 | 25 | 45 | 22 | | | 412 | 116 | 31 | 64 |
| | | P4 | 92 | 25 | 80 | 22 | | | 368 | 106 | 31 | 50 |
| | 32 | K1 | 9 | 25 | 40 | 22 | | | 447 | 131 | 29 | 66 |
| | | P1 | 93 | 25 | 30 | 22 | | | 462 | 136 | 30 | 71 |

TABLE 16

| | | | | After Final Process | | | | | | | | | |
|---|---|---|---|---|---|---|---|---|---|---|---|---|---|
| | | | | | | After Heating 700° C. 120 sec | | | | | After Cold Compression | | |
| | Alloy No. | Proc. No. | Test No. | Repetitive Bending Times | Conductivity % IACS | Performance Index I | Vickers Hardness HV | Recrystallization Ratio % | Avg. Grain Diameter of Precipitates nm | 400° C. High Temp. Tensile Strength N/mm$^2$ | Rockwell Hardness HRB | Conductivity % IACS | wear Loss mg |
| First | 11 | K1 | 1 | | 79 | 5176 | 121 | 10 | | 275 | 91 | 77 | 65 |
| Inv. | | P1 | 81 | | 78 | 5234 | 130 | 5 | | | | | 58 |
| Alloy | | P2 | 82 | | 79 | 4494 | | | | | | | |
| | | P3 | 83 | | 79 | 4890 | | | | | | | |
| | | P4 | 84 | | 79 | 4289 | | | | | | | |
| Sec- | 21 | K1 | 4 | | 80 | 5104 | 111 | | | 267 | 90 | 77 | 76 |
| ond | | P1 | 85 | | 79 | 5136 | 127 | 5 | | | | | |
| Inv. | | P2 | 86 | | 79 | 4391 | | | | | | | |
| Alloy | | P3 | 87 | | 80 | 4837 | | | | | | | |
| | | P4 | 88 | | 79 | 4096 | | | | | | | |
| Third | 31 | K1 | 8 | | 77 | 5083 | 115 | 15 | 5.0 | 258 | | | |
| Inv. | | P1 | 89 | | 75 | 5217 | 128 | 10 | | 270 | | | |
| Alloy | | P2 | 90 | | 76 | 4363 | | | | | | | |
| | | P3 | 91 | | 75 | 4674 | | | | | | | |
| | | P4 | 92 | | 76 | 4203 | | | | | | | |
| | 32 | K1 | 9 | | 80 | 5158 | 116 | | | | | | |
| | | P1 | 93 | | 79 | 5338 | 124 | 5 | | | | | |

In the process P1 to the process P4, an extruding rate and a cooling rate after the extruding are different from those in the process K1. In the process P1, a cooling rate of which is higher than that in the process K1, an average grain size at the extruding completion is small as compared with the result in the process K1, and thus tensile strength, Vickers hardness, and the like are improved after the final process. In the process P2 and the process P4, a cooling rate of which is lower than a proper cooling rate of 15° C./second, an average grain size at the extruding completion is large as compared with the result in the process K1, and thus tensile strength, Vickers hardness, and the like after the final process are decreased. In the process P3 of air cooling, a cooling rate is higher than a proper rate, and thus tensile strength, Vickers hardness, and the like after the final process are satisfactory. From this result, to obtain high strength in the final rod, it is preferable that a cooling rate be high. It is considered that strength becomes high, since a large amount of Co, P, and the like are solid-dissolved when the cooling rate is high. In heat resistance, it is preferable that a cooling rate be high. In the processes K, L, M, N, Q, and R of water cooling, in a relationship of an extruding rate (moving speed of ram, extruding rate of billet) and an extruding ratio H, an extruding rate is in the range from $45\times H^{-1/3}$ mm/second to $60\times H^{-1/3}$ mm/second. On the other hand, in the process P2, an extruding rate is lower than $30\times H^{-1/3}$ mm/second. In the process P1, an extruding rate is higher than $60\times H^{-1/3}$ mm/second. Comparing P1, P2, and K1, tensile strength of process P2 is lowest.

Tables 17 and 18 show the results in the processes M1 to M6 together with the result in the process K1.

TABLE 17

| | | | | Extruding | | After Final Process | | | | | | |
|---|---|---|---|---|---|---|---|---|---|---|---|---|
| | | | | Completion | | | Precipitates | | | | | |
| | Alloy No. | Proc. No. | Test No. | Outer Diameter mm | Avg. Grain Size μm | Final Outer Diameter mm | Avg. Grain Diameter nm | Ratio of 30 nm or less % | Tensile Strength N/mm$^2$ | Vickers Hardness HV | Elongation % | Rockwell Hardness HRB |
| First | 11 | M1 | 101 | 25 | 35 | 22 | | | 403 | 113 | 26 | 54 |
| Inv. | | M2 | 102 | 25 | 35 | 22 | | | 415 | 114 | 26 | 57 |
| Alloy | | M3 | 103 | 25 | 35 | 22 | | | 435 | 128 | 29 | 65 |
| | | M4 | 104 | 25 | 35 | 22 | | | 372 | 103 | 37 | 50 |
| | | M5 | 105 | 25 | 35 | 22 | | | 380 | 107 | 29 | 55 |
| | | M6 | 106 | 25 | 35 | 22 | | | 355 | 102 | 39 | 47 |
| | | K1 | 1 | 25 | 35 | 22 | | | 448 | 133 | 30 | 67 |
| Second | 21 | M1 | 107 | 25 | 40 | 22 | | | 375 | 106 | 27 | 51 |
| Inv. | | M2 | 108 | 25 | 40 | 22 | | | 394 | 110 | 29 | 53 |
| Alloy | | M3 | 109 | 25 | 35 | 22 | | | 414 | 122 | 30 | 62 |
| | | M4 | 110 | 25 | 40 | 22 | | | 366 | 102 | 35 | 49 |
| | | M5 | 111 | 25 | 40 | 22 | | | 368 | 104 | 30 | 50 |
| | | K1 | 4 | 25 | 40 | 22 | | | 439 | 125 | 30 | 66 |
| Third | 31 | M2 | 112 | 25 | 35 | 22 | | | 410 | 112 | 29 | 55 |
| Inv. | | M6 | 113 | 25 | 35 | 22 | | | 344 | 98 | 35 | 46 |
| Alloy | | K1 | 8 | 25 | 35 | 22 | | | 449 | 132 | 29 | 67 |

TABLE 18

| | | | | After Final Process | | | | | | | | | |
|---|---|---|---|---|---|---|---|---|---|---|---|---|---|
| | | | | | | After Heating 700° C. 120 sec | | | | | | | |
| | Alloy No. | Proc. No. | Test No. | Repetitive Bending Times | Conductivity % IACS | Performance Index I | Vickers Hardness HV | Recrystallization Ratio % | Avg. Grain Diameter of Precipitates nm | 400° C. High Temp. Tensile Strength N/mm² | After Cold Compression Rockwell Hardness HRB | After Cold Compression Conductivity % IACS | After Cold Compression wear Loss mg |
| First | 11 | M1 | 101 | | 69 | 4218 | | | | | | | |
| Inv. | | M2 | 102 | | 72 | 4437 | | | | | | | |
| Alloy | | M3 | 103 | | 77 | 4924 | | | | | | | |
| | | M4 | 104 | | 76 | 4443 | | | | | | | |
| | | M5 | 105 | | 74 | 4217 | | | | | 87 | 72 | |
| | | M6 | 106 | | 72 | 4187 | 81 | | | 154 | | | |
| | | K1 | 1 | | 79 | 5176 | 121 | 10 | | 275 | 91 | 77 | 65 |
| Second | 21 | M1 | 107 | | 71 | 4013 | | | | | | | |
| Inv. | | M2 | 108 | | 75 | 4402 | | | | | | | |
| Alloy | | M3 | 109 | | 80 | 4814 | | | | | | | |
| | | M4 | 110 | | 80 | 4419 | 82 | | | 178 | | | |
| | | M5 | 111 | | 75 | 4143 | | | | | | | |
| | | K1 | 4 | | 80 | 5104 | 111 | | | 267 | 90 | 77 | 76 |
| Third | 31 | M2 | 112 | | 71 | 4457 | | | | | | | |
| Inv. | | M6 | 113 | | 76 | 4049 | | | | | | | |
| Alloy | | K1 | 8 | | 77 | 5083 | 115 | 15 | 5.0 | 258 | | | |

In the process M1 to the process M6, a condition of the heat treatment TH1 is different from that in the process K1. In the process M1 and M2, in which a heat treatment index TI is smaller than a proper condition, in the process M4 and M6 in which a heating temperature index TI is larger than the proper condition, in the process M5, in which a keeping time of the heat treatment is shorter than a proper time, tensile strength, Vickers hardness, and the like after the final process are decreased, as compared with the process M3 and K1 within the proper condition. In addition, balance of tensile strength, conductivity, and elongation (product thereof, and performance index I) is deteriorated. Heat resistance is also deteriorated when the index I is out of the proper condition.

Tables 19 and 20 show the results in the processes Q1, Q2, and Q3 together with the result in the process K1.

TABLE 19

| | | | | Extruding | | After Final Process | | | | | | |
|---|---|---|---|---|---|---|---|---|---|---|---|---|
| | | | | Completion | | | Precipitates | | | | | |
| | Alloy No. | Proc. No. | Test No. | Outer Diameter mm | Avg. Grain Size μm | Final Outer Diameter mm | Avg. Grain Diameter nm | Ratio of 30 nm or less % | Tensile Strength N/mm² | Vickers Hardness HV | Elongation % | Rockwell Hardness HRB |
| First | 11 | K1 | 1 | 25 | 35 | 22 | | | 448 | 133 | 30 | 67 |
| Inv. | | Q1 | 121 | 25 | 35 | 20 | | | 470 | 145 | 26 | 70 |
| Alloy | | Q2 | 122 | 25 | 35 | 17.5 | | | 522 | 153 | 16 | 77 |
| | | Q3 | 123 | 25 | 35 | 18 | | | 488 | 148 | 22 | 74 |
| | 13 | K1 | 3 | 25 | 50 | 22 | | | 436 | 124 | 31 | 64 |
| | | Q1 | 124 | 25 | 50 | 20 | | | 455 | 140 | 26 | 70 |
| | | Q2 | 125 | 25 | 50 | 18.5 | | | 494 | 151 | 19 | 74 |
| | | Q3 | 126 | 25 | 50 | 18 | | | 473 | 148 | 24 | 72 |
| Second | 21 | K1 | 4 | 25 | 40 | 22 | | | 439 | 125 | 30 | 66 |
| Inv. | | Q1 | 127 | 25 | 40 | 20 | | | 457 | 140 | 27 | 70 |
| Alloy | | Q2 | 128 | 25 | 40 | 18.5 | | | 493 | 149 | 18 | 73 |
| | | Q3 | 129 | 25 | 40 | 18 | | | 471 | 145 | 23 | 71 |
| | 23 | K1 | 6 | 25 | 35 | 22 | | | 460 | 133 | 28 | 69 |
| | | Q1 | 130 | 25 | 35 | 20 | | | 477 | 145 | 27 | 72 |
| | | Q2 | 131 | 25 | 35 | 18.5 | | | 514 | 152 | 17 | 76 |
| | | Q3 | 132 | 25 | 35 | 18 | | | 492 | 150 | 23 | 73 |
| Third | 31 | K1 | 8 | 25 | 35 | 22 | | | 449 | 132 | 29 | 67 |
| Inv. | | Q1 | 133 | 25 | 35 | 20 | | | 465 | 143 | 27 | 72 |
| Alloy | | Q2 | 134 | 25 | 35 | 18.5 | | | 500 | 152 | 20 | 76 |
| | | Q3 | 135 | 25 | 35 | 18 | | | 480 | 148 | 24 | 75 |
| | 32 | K1 | 9 | 25 | 40 | 22 | | | 447 | 131 | 29 | 66 |
| | | Q1 | 136 | 25 | 40 | 20 | | | 461 | 135 | 27 | 70 |

TABLE 20

| | | | | After Final Process | | | | | | | | | |
|---|---|---|---|---|---|---|---|---|---|---|---|---|---|
| | | | | | | After Heating 700° C. 120 sec | | | | | | | |
| | Alloy No. | Proc. No. | Test No. | Repetitive Bending Times | Conductivity % IACS | Performance Index I | Vickers Hardness HV | Recrystallization Ratio % | Avg. Grain Diameter of Precipitates nm | 400° C. High Temp. Tensile Strength N/mm$^2$ | After Cold Compression Rockwell Hardness HRB | After Cold Compression Conductivity % IACS | Wear Loss mg |
| First Inv. Alloy | 11 | K1 | 1 | | 79 | 5176 | 121 | 10 | | 275 | 91 | 77 | 65 |
| | | Q1 | 121 | | 78 | 5230 | | | | | | | |
| | | Q2 | 122 | | 77 | 5313 | | | | | | | |
| | | Q3 | 123 | | 79 | 5292 | | | | | | | |
| | 13 | K1 | 3 | | 71 | 4813 | | | | | 92 | 70 | 70 |
| | | Q1 | 124 | | 72 | 4865 | 123 | 15 | | 252 | | | |
| | | Q2 | 125 | | 71 | 4953 | | | | | | | |
| | | Q3 | 126 | | 72 | 4977 | | | | | | | |
| Second Inv. Alloy | 21 | K1 | 4 | | 80 | 5104 | 111 | 10 | | 267 | 90 | 77 | 76 |
| | | Q1 | 127 | | 80 | 5191 | | | | | | | |
| | | Q2 | 128 | | 79 | 5171 | | | | 266 | | | |
| | | Q3 | 129 | | 80 | 5182 | 127 | 15 | | 270 | | | |
| | 23 | K1 | 6 | | 77 | 5167 | 123 | 5 | | 288 | | | 58 |
| | | Q1 | 130 | | 77 | 5316 | 132 | 5 | | | | | |
| | | Q2 | 131 | | 76 | 5243 | | | | | | | |
| | | Q3 | 132 | | 77 | 5310 | 136 | 5 | | | | | |
| Third Inv. Alloy | 31 | K1 | 8 | | 77 | 5083 | 115 | 15 | 5.0 | 258 | | | |
| | | Q1 | 133 | | 75 | 5114 | | | | | | | |
| | | Q2 | 134 | | 75 | 5196 | | | | | | | |
| | | Q3 | 135 | | 75 | 5155 | | | | | | | |
| | 32 | K1 | 9 | | 80 | 5158 | 117 | 10 | | | | | |
| | | Q1 | 136 | | 79 | 5204 | | | | | | | |

In the processes Q1 and Q3, a drawing processing rate after extruding is different from that in the process K1. In the process Q2, a drawing process is additionally performed after the process Q1. In the processes Q1 to Q3, a temperature of the heat treatment TH1 is decreased according to a drawing process ratio. As the drawing processing rate after the extruding becomes higher, tensile strength and Vickers hardness after the final process are improved, and elongation is decreased. When the drawing process is added after the heat treatment TH1, elongation is decreased but tensile strength and Vickers hardness are improved.

Tables 21 and 22 show the results in the processes N1, N11, N2, N21, N3, and N31.

TABLE 21

| | | | | Extruding | | After Final Process | | | | | | |
|---|---|---|---|---|---|---|---|---|---|---|---|---|
| | | | | Completion | | | Precipitates | | | | | |
| | Alloy No. | Proc. No. | Test No. | Outer Diameter mm | Avg. Grain Size μm | Final Outer Diameter mm | Avg. Grain Diameter nm | Ratio of 30 nm or less % | Tensile Strength N/mm$^2$ | Vickers Hardness HV | Elongation % | Rockwell Hardness HRB |
| First Inv. Alloy | 11 | N1 | 141 | 35 | 45 | 31 | | | 434 | 125 | 34 | 64 |
| | | N11 | 142 | 35 | 45 | 35 | 3.5 | 99 | 383 | 107 | 42 | 50 |
| | | N2 | 143 | 35 | 50 | 31 | | | 411 | 117 | 34 | 61 |
| | | N21 | 144 | 35 | 50 | 35 | 8.2 | 97 | 362 | 103 | 43 | 47 |
| | | N3 | 145 | 17 | 25 | 14.5 | | | 460 | 139 | 26 | 69 |
| | | N31 | 146 | 17 | 25 | 17 | 2.8 | 100 | 400 | 113 | 36 | 58 |
| Second Inv. Alloy | 21 | N1 | 147 | 35 | 45 | 31 | | | 417 | 122 | 33 | 63 |
| | | N11 | 148 | 35 | 45 | 35 | 3 | 99 | 377 | 105 | 43 | 51 |
| | | N2 | 149 | 35 | 55 | 31 | | | 406 | 114 | 35 | 62 |
| | | N21 | 150 | 35 | 55 | 35 | 7.2 | 97 | 355 | 102 | 43 | 49 |
| | | N3 | 151 | 17 | 30 | 14.5 | | | 451 | 137 | 26 | 71 |
| | | N31 | 152 | 17 | 30 | 17 | | | 394 | 111 | 35 | 56 |
| Third Inv. Alloy | 31 | N1 | 153 | 35 | 40 | 31 | | | 426 | 123 | 33 | 63 |
| | | N11 | 154 | 35 | 40 | 35 | 3.2 | 99 | 380 | 107 | 44 | 53 |
| | | N2 | 155 | 35 | 50 | 31 | | | 413 | 118 | 34 | 62 |
| | | N21 | 156 | 35 | 50 | 35 | 5.8 | 98 | 367 | 104 | 41 | 49 |
| | | N3 | 157 | 17 | 25 | 14.5 | | | 467 | 142 | 26 | 73 |
| | | N31 | 158 | 17 | 25 | 17 | | | 409 | 116 | 35 | 57 |
| | 36 | N3 | 159 | 17 | 25 | 14.5 | | | 474 | 144 | 26 | 73 |
| | | N31 | 160 | 17 | 25 | 17 | 2.7 | 100 | 416 | 116 | 36 | 58 |

TABLE 22

| | | | | After Final Process | | | | | | | | | |
|---|---|---|---|---|---|---|---|---|---|---|---|---|---|
| | | | | | | After Heating 700° C. 120 sec | | | | | | | |
| | Alloy No. | Proc. No. | Test No. | Repetitive Bending Times | Conductivity % IACS | Performance Index I | Vickers Hardness HV | Recrystallization Ratio % | Avg. Grain Diameter of Precipitates nm | 400° C. High Temp. Tensile Strength N/mm² | After Cold Compression Rockwell Hardness HRB | After Cold Compression Conductivity % IACS | Wear Loss mg |
| First | 11 | N1 | 141 | | 80 | 5202 | 110 | | | 260 | | | |
| Inv. | | N11 | 142 | | 78 | 4803 | 96 | | | 212 | | | |
| Alloy | | N2 | 143 | | 79 | 4895 | | | | | | | |
| | | N21 | 144 | | 79 | 4601 | | | | | 89 | 77 | |
| | | N3 | 145 | | 79 | 5152 | | | | | | | |
| | | N31 | 146 | | 78 | 4804 | | | | | | | |
| Second | 21 | N1 | 147 | | 81 | 4991 | | | | | | | |
| Inv. | | N11 | 148 | | 79 | 4792 | | | | | | | |
| Alloy | | N2 | 149 | | 79 | 4832 | | | | | | | |
| | | N21 | 150 | | 79 | 4512 | | | | | | | |
| | | N3 | 151 | | 80 | 5083 | 123 | 10 | | | | | |
| | | N31 | 152 | | 79 | 4728 | 103 | 10 | | | | | |
| Third | 31 | N1 | 153 | | 75 | 4907 | | | | | | | |
| Inv. | | N11 | 154 | | 74 | 4707 | | | | | 88 | 73 | |
| Alloy | | N2 | 155 | | 75 | 4793 | | | | | | | |
| | | N21 | 156 | | 74 | 4451 | | | | | | | |
| | | N3 | 157 | | 76 | 5130 | | | | | | | |
| | | N31 | 158 | | 74 | 4750 | | | | | | | |
| | 36 | N3 | 159 | | 75 | 5172 | | | | | | | |
| | | N31 | 160 | | 76 | 4932 | | | | | | | |

In the process N1, the heat treatment TH1 is performed in 2 steps. In the process N11, the heat treatment TH1 is performed after extruding. In any one of the processes N1 and N11, satisfactory results are exhibited similarly to the processes K1 and K3. In the processes N2 and N21, extruding is direct extruding, and the 2-step heat treatment TH1 is performed similarly to the processes N1 and N11. Even in case of the direct extruding, satisfactory results are exhibited similarly to the processes K1 and K3. Although sizes and the like are different, the rod of the process N1 has conductivity higher than that of a rod in the process K1. The processes N3 and N31 are the same processes as the processes K1 and K3, and a cooling rate after the extruding is high. Since an average grain size after extruding is small, tensile strength and Vickers hardness after the final process are satisfactory. In the processes N2 and N21, a cooling rate is slightly low. Accordingly, an average grain diameter of precipitates becomes large, and thus tensile strength and Vickers hardness after the final process are slightly low.

Tables 23 and 24 show results in the processes S1 to S9.

TABLE 23

| | | | | Extruding | | After Final Process | | | | | | |
|---|---|---|---|---|---|---|---|---|---|---|---|---|
| | | | | Completion | | | Precipitates | | | | | |
| | Alloy No. | Proc. No. | Test No. | Outer Diameter mm | Avg. Grain Size μm | Final Outer Diameter mm | Avg. Grain Diameter nm | Ratio of 30 nm or less % | Tensile Strength N/mm² | Vickers Hardness HV | Elongation % | Rockwell Hardness HRB |
| First | 12 | S1 | 171 | 11 | 25 | 2.8 | | | 572 | 159 | 1 | |
| Inv. | | S2 | 172 | 11 | 25 | 2.8 | | | 533 | 156 | 5 | |
| Alloy | | S3 | 173 | 11 | 25 | 1.2 | | | 620 | 167 | 1 | |
| | | S4 | 174 | 11 | 25 | 1.2 | | | 621 | 167 | 2 | |
| | | S5 | 175 | 11 | 25 | 1.2 | | | 594 | 163 | 4 | |
| | | S6 | 176 | 11 | 25 | 2.8 | | | 529 | 154 | 5 | |
| | | S7 | 321 | 11 | 25 | 1.2 | | | 505 | 150 | 7 | |
| | | S8 | 322 | 11 | 25 | 1.2 | | | 518 | 152 | 6 | |
| | | S9 | 323 | 11 | 25 | 1.2 | | | 560 | 157 | 5 | |
| | 13 | S5 | 324 | 11 | 25 | 1.2 | | | 633 | 178 | 5 | |
| | | S6 | 325 | 11 | 25 | 2.8 | | | 566 | 159 | 6 | |
| | | S8 | 326 | 11 | 25 | 1.2 | | | 545 | 156 | 7 | |
| | | S9 | 327 | 11 | 25 | 1.2 | | | 600 | 162 | 6 | |
| Second | 21 | S5 | 328 | 11 | 20 | 1.2 | | | 642 | 170 | 5 | |
| Inv. | | S8 | 329 | 11 | 20 | 1.2 | | | 544 | 157 | 6 | |
| Alloy | 24 | S1 | 177 | 11 | 20 | 2.8 | | | 604 | 164 | 2 | |
| | | S2 | 178 | 11 | 20 | 2.8 | | | 570 | 159 | 6 | |
| | | S3 | 179 | 11 | 20 | 1.2 | | | 656 | 175 | 1 | |
| | | S4 | 180 | 11 | 20 | 1.2 | | | 655 | 176 | 2 | |
| | | S5 | 181 | 11 | 20 | 1.2 | | | 627 | 168 | 4 | |

TABLE 23-continued

| | | | | Extruding | | After Final Process | | | | | | |
|---|---|---|---|---|---|---|---|---|---|---|---|---|
| | | | | Completion | | | Precipitates | | | | | |
| | Alloy No. | Proc. No. | Test No. | Outer Diameter mm | Avg. Grain Size μm | Final Outer Diameter mm | Avg. Grain Diameter nm | Ratio of 30 nm or less % | Tensile Strength N/mm$^2$ | Vickers Hardness HV | Elongation % | Rockwell Hardness HRB |
| | | S6 | 182 | 11 | 20 | 2.8 | 3.0 | 99 | 564 | 160 | 5 | |
| | | S7 | 330 | 11 | 20 | 1.2 | | | 516 | 152 | 8 | |
| | | S8 | 331 | 11 | 20 | 1.2 | | | 532 | 154 | 6 | |
| | | S9 | 332 | 11 | 20 | 1.2 | | | 580 | 161 | 4 | |
| Third | 31 | S5 | 333 | 11 | 20 | 1.2 | | | 652 | 171 | 5 | |
| Inv. | | S8 | 334 | 11 | 20 | 1.2 | | | 553 | 158 | 7 | |
| Alloy | 36 | S1 | 183 | 11 | 20 | 2.8 | | | 632 | 169 | 2 | |
| | | S2 | 184 | 11 | 20 | 2.8 | | | 595 | 162 | 6 | |
| | | S3 | 185 | 11 | 20 | 1.2 | | | 690 | 180 | 1 | |
| | | S4 | 186 | 11 | 20 | 1.2 | | | 692 | 180 | 1 | |
| | | S5 | 187 | 11 | 20 | 1.2 | | | 646 | 173 | 5 | |
| | | S6 | 188 | 11 | 20 | 2.8 | | | 595 | 163 | 5 | |
| | | S7 | 335 | 11 | 20 | 1.2 | | | 541 | 155 | 6 | |
| | | S8 | 336 | 11 | 20 | 1.2 | | | 550 | 156 | 6 | |
| | | S9 | 337 | 11 | 20 | 1.2 | | | 598 | 162 | 5 | |
| Comp. | 42 | S1 | 189 | 11 | 65 | 2.5 | | | 478 | 145 | 2 | |
| Alloy | | S2 | 190 | 11 | 65 | 2.5 | | | 443 | 128 | 4 | |
| | | S6 | 191 | 11 | 65 | 2.5 | | | 465 | 137 | 4 | |
| | | S8 | 338 | 11 | 65 | 1.2 | | | 324 | 86 | 14 | |
| | 44 | S1 | 192 | 11 | 50 | 2.5 | | | 512 | 151 | 1 | |
| | | S2 | 193 | 11 | 50 | 2.5 | | | 475 | 145 | 4 | |
| | | S8 | 339 | 11 | 65 | 1.2 | | | 338 | 94 | 13 | |
| C1100 | 51 | S1 | 194 | 11 | 60 | 2.5 | | | 424 | 120 | 1 | |
| | | S2 | 195 | 11 | 60 | 2.5 | | | 404 | 115 | 4 | |

TABLE 24

| | | | | After Final Process | | | | | | | |
|---|---|---|---|---|---|---|---|---|---|---|---|
| | | | | | | | Metal Structure | | After Heating 700° C. 120 sec | | |
| | | | | | | | After Final TH1 | | | | Averg. |
| | Alloy No. | Proc. No. | Test No. | Repetitive Bending Times | Conductivity % IACS | Performance Index I | Avg. Grain Size μm | Recrystallization Ratio % | Vickers Hardness HV | Recrystal-lization Ratio % | Grain Diameter of Precipitates nm |
| First | 12 | S1 | 171 | 14 | 75 | 5003 | | | | | |
| Inv. | | S2 | 172 | 18 | 79 | 4974 | | | | | |
| Alloy | | S3 | 173 | 22 | 75 | 5350 | | | | | |
| | | S4 | 174 | 24 | 76 | 5522 | | | | | |
| | | S5 | 175 | 26 | 79 | 5491 | | | | | |
| | | S6 | 176 | 17 | 79 | 4937 | | | | | |
| | | S7 | 321 | 42 | 81 | 4863 | 3.0 | 20 | | | |
| | | S8 | 322 | 38 | 82 | 4972 | 3.5 | 25 | | | |
| | | S9 | 323 | 31 | 81 | 5292 | | | | | |
| | 13 | S5 | 324 | 28 | 72 | 5640 | | | | | |
| | | S6 | 325 | 18 | 72 | 5091 | | | | | |
| | | S8 | 326 | 39 | 74 | 5016 | 3.5 | 25 | | | |
| | | S9 | 327 | 33 | 73 | 5434 | | | | | |
| Second | 21 | S5 | 328 | 28 | 79 | 5992 | | | | | |
| Inv. | | S8 | 329 | 37 | 82 | 5222 | 2.5 | 15 | | | |
| Alloy | 24 | S1 | 177 | 15 | 79 | 5335 | | | | | |
| | | S2 | 178 | 19 | 81 | 5404 | | | | | |
| | | S3 | 179 | 23 | 79 | 5661 | | | | | |
| | | S4 | 180 | 24 | 80 | 5786 | | | | | |
| | | S5 | 181 | 27 | 81 | 5832 | | | | | |
| | | S6 | 182 | 18 | 81 | 5264 | | | | | |
| | | S7 | 330 | 44 | 81 | 5016 | 2.5 | 15 | | | |
| | | S8 | 331 | 38 | 83 | 5138 | 3.0 | 20 | | | |
| | | S9 | 332 | 29 | 82 | 5462 | | | | | |

TABLE 24-continued

| | | | | After Final Process | | | | | | | |
|---|---|---|---|---|---|---|---|---|---|---|---|
| | | | | | | | Metal Structure | | After Heating 700° C. 120 sec | | |
| | | | | | | | After Final TH1 | | | | Averg. |
| | Alloy No. | Proc. No. | Test No. | Repetitive Bending Times | Conductivity % IACS | Performance Index I | Avg. Grain Size μm | Recrystallization Ratio % | Vickers Hardness HV | Recrystal-lization Ratio % | Grain Diameter of Precipitates nm |
| Third | 31 | S5 | 333 | 29 | 75 | 5929 | | | | | |
| Inv. | | S8 | 334 | 39 | 78 | 5226 | | | | | |
| Alloy | 36 | S1 | 183 | 15 | 73 | 5508 | | | | | |
| | | S2 | 184 | 20 | 76 | 5498 | | | | | |
| | | S3 | 185 | 23 | 70 | 5831 | | | | | |
| | | S4 | 186 | 25 | 72 | 5931 | | | | | |
| | | S5 | 187 | 28 | 76 | 5913 | | | | | |
| | | S6 | 188 | 19 | 75 | 5410 | | | | | |
| | | S7 | 335 | 40 | 77 | 5032 | 1.5 | 10 | | | |
| | | S8 | 336 | 36 | 79 | 5182 | 2.0 | 15 | | | |
| | | S9 | 337 | 30 | 77 | 5510 | | | | | |
| Comp. | 42 | S1 | 189 | 15 | 76 | 4250 | | | | | |
| Alloy | | S2 | 190 | 17 | 76 | 4016 | | | | | |
| | | S6 | 191 | 17 | 77 | 4244 | | | | | |
| | | S8 | 338 | 39 | 79 | 3283 | 15 | 95 | | | |
| | 44 | S1 | 192 | 14 | 71 | 4357 | | | | | |
| | | S2 | 193 | 16 | 73 | 4221 | | | | | |
| | | S8 | 339 | 38 | 76 | 3330 | 15 | 90 | | | |
| C1100 | 51 | S1 | 194 | 13 | 99 | 4261 | | | | | |
| | | S2 | 195 | 15 | 100 | 4202 | | | | | |

The processes S1 to S9 are a process of producing a wire. In the processes S1 to S9, an average grain size of the invention alloy at the extruding completion is smaller than that of the comparative alloy or C1100, and thus tensile strength and Vickers hardness are satisfactory. In the process S2 in which the heat treatment TH2 is performed, the number of repetitive bending times is improved as compared with that in the process S1. Also, in the processes S4, S5, S6, and S9 in which the heat treatment TH2 is performed, the number of repetitive bending times is improved. Particularly, in the process S9 in which a keeping time of the heat treatment TH2 is long, strength is slightly low, but the number of repetitive bending times is large. In the process S3 to the process S6 in which the heat treatments TH1 and TH2 and the wire drawing process are variously combined, the invention alloy exhibits satisfactory tensile strength and Vickers hardness. When the heat treatment TH1 is performed at the heat treatment TH1 completion or in the process close to the final, strength was low, but particularly flexibility was excellent. In the processes S7 and S8 in which the heat treatment TH1 is performed twice, the number of repetitive bending times is particularly improved. When a total wire drawing processing rate before the heat treatment TH1 is high 75% or higher and the heat treatment TH1 is performed, about 15% is recrystallized, but the size of the recrystallized grains is as small as 3 p.m. For this reason, strength is slightly decreased, but flexibility is improved.

Tables 25 and 26 show results in the processes R1 and R2.

TABLE 25

| | | | | Extruding Completion | | After Final Process | | | | | | |
|---|---|---|---|---|---|---|---|---|---|---|---|---|
| | | | | Pipe | | | Precipitates | | | | | |
| | Alloy No. | Proc. No. | Test No. | Outer Diameter × Thickness mm | Avg. Grain Size μm | Final Outer Diameter mm | Avg. Grain Diameter nm | Ratio of 30 nm or less % | Tensile Strength N/mm$^2$ | Vickers Hardness HV | Elongation % | Rockwell Hardness HRB |
| First | 11 | R1 | 201 | 65 × 6 | 30 | | 2.3 | 100 | 410 | 115 | 36 | 59 |
| Inv. | | R2 | 202 | 65 × 6 | 30 | | | | 498 | 151 | 20 | 75 |
| Alloy | | | | | | | | | | | | |
| Second | 21 | R1 | 203 | 65 × 6 | 30 | | 2.4 | 100 | 394 | 110 | 37 | 57 |
| Inv. | | R2 | 204 | 65 × 6 | 30 | | | | 480 | 145 | 21 | 73 |
| Alloy | | | | | | | | | | | | |
| Third | 31 | R1 | 205 | 65 × 6 | 30 | | | | 402 | 113 | 36 | 56 |
| Inv. | | R2 | 206 | 65 × 6 | 30 | | | | 497 | 149 | 20 | 75 |
| Alloy | 371 | R1 | 313 | 65 × 6 | 30 | | 2.4 | 100 | 413 | 114 | 36 | 60 |

TABLE 26

| | | | | After Final Process | | | | | | | | | | |
|---|---|---|---|---|---|---|---|---|---|---|---|---|---|---|
| | | | | | | | After Heating 700° C. 120 sec | | | | | | | |
| | Alloy No. | Proc. No. | Test No. | Repetitive Bending Times | Conductivity % IACS | Performance Index I | Vickers Hardness HV | Recrystallization Ratio % | Avg. Grain Diameter of Precipitates nm | 400° C. High Temp. Tensile Strength N/mm$^2$ | After Cold Compression Rockwell Hardness HRB | After Cold Compression Conductivity % IACS | Wear Loss mg |
| First | 11 | R1 | 201 | | 78 | 4925 | | | | | | | |
| Inv. | | R2 | 202 | | 79 | 5312 | | | | | | | |
| Alloy | | | | | | | | | | | | | |
| Second | 21 | R1 | 203 | | 79 | 4798 | | | | | | | |
| Inv. | | R2 | 204 | | 80 | 5195 | | | | | | | |
| Alloy | | | | | | | | | | | | | |
| Third | 31 | R1 | 205 | | 74 | 4703 | | | | | | | |
| Inv. | | R2 | 206 | | 75 | 5165 | | | | | | | |
| Alloy | 371 | R1 | 313 | | 81 | 5055 | | | | | | | |

The processes R1 and R2 are a process of producing a pipe. In the processes R1 and R2, the invention alloy exhibits satisfactory tensile strength and Vickers hardness, and the size of precipitates is small since a cooling rate after extruding is high.

Tables 27 and 28 show results in the processes T1 and T2 together with the results in the processes K3 and K4.

TABLE 27

| | | | | Extruding | | After Final Process | | | | | | |
|---|---|---|---|---|---|---|---|---|---|---|---|---|
| | | | | Completion | | | Precipitates | | | | | |
| | Alloy No. | Proc. No. | Test No. | Outer Diameter mm | Avg. Grain Size μm | Final Outer Diameter mm | Avg. Grain Diameter nm | Ratio of 30 nm or less % | Tensile Strength N/mm$^2$ | Vickers Hardness HV | Elongation % | Rockwell Hardness HRB |
| First | 11 | T1 | 211 | 25 | 150 | 25 | 2.5 | 100 | 394 | 111 | 31 | 54 |
| Inv. | | T2 | 212 | 25 | 150 | 22 | | | 441 | 129 | 19 | 66 |
| Alloy | | K3 | 32 | 25 | 40 | 25 | 3.0 | 100 | 394 | 110 | 39 | 56 |
| | | K4 | 33 | 25 | 35 | 22 | | | 460 | 138 | 22 | 68 |
| Second | 21 | T1 | 213 | 25 | 180 | 25 | 2.4 | 100 | 380 | 106 | 28 | 55 |
| Inv. | | T2 | 214 | 25 | 180 | 22 | | | 426 | 120 | 18 | 64 |
| Alloy | | K3 | 38 | 25 | 40 | 25 | 2.6 | 100 | 386 | 107 | 39 | 55 |
| | | K4 | 39 | 25 | 40 | 22 | | | 448 | 132 | 22 | 66 |
| Third | 31 | T1 | 215 | 25 | 120 | 25 | | | 390 | 108 | 30 | 54 |
| Inv. | | T2 | 216 | 25 | 120 | 22 | | | 432 | 126 | 19 | 65 |
| Alloy | | K3 | 41 | 25 | 35 | 25 | 2.8 | 100 | 392 | 108 | 39 | 56 |
| | | K4 | 42 | 25 | 35 | 22 | | | 458 | 138 | 24 | 68 |
| CrZr—Cu | 52 | T1 | 217 | 25 | 120 | 25 | | | 380 | 108 | 31 | 49 |
| | | T2 | 218 | 25 | 120 | 22 | | | 441 | 132 | 19 | 58 |

TABLE 28

| | | | | After Final Process | | | | | | | | | | |
|---|---|---|---|---|---|---|---|---|---|---|---|---|---|---|
| | | | | | | | After Heating 700° C. 120 sec | | | | | | | |
| | Alloy No. | Proc. No. | Test No. | Repetitive Bending Times | Conductivity % IACS | Performance Index I | Vickers Hardness HV | Recrystallization Ratio % | Avg. Grain Diameter of Precipitates nm | 400° C. High Temp. Tensile Strength N/mm$^2$ | After Cold Compression Rockwell Hardness HRB | After Cold Compression Conductivity % IACS | Wear Loss mg |
| First | 11 | T1 | 211 | | 79 | 4588 | 102 | | 5.1 | 220 | | | |
| Inv. | | T2 | 212 | | 78 | 4635 | 117 | 10 | | 265 | | | 75 |
| Alloy | | K3 | 32 | | 79 | 4868 | 102 | | 5.2 | 229 | 90 | 77 | |
| | | K4 | 33 | | 78 | 4956 | 120 | | | | | | |

TABLE 28-continued

| | | | | | | After Final Process | | | | | | |
|---|---|---|---|---|---|---|---|---|---|---|---|---|
| | | | | | | After Heating 700° C. 120 sec | | | | | | |
| | | | | | | | | Avg. Grain Diameter | 400° C. High Temp. | After Cold Compression | | |
| | Alloy No. | Proc. No. | Test No. | Repetitive Bending Times | Conductivity % IACS | Performance Index I | Vickers Hardness HV | Recrystallization Ratio % | of Precipitates nm | Tensile Strength N/mm$^2$ | Rockwell Hardness HRB | Conductivity % IACS | Wear Loss mg |
| Second | 21 | T1 | 213 | | 80 | 4350 | | | | | | | |
| Inv. | | T2 | 214 | | 79 | 4468 | | | | | | | |
| Alloy | | K3 | 38 | | 80 | 4799 | | | | | 89 | 77 | |
| | | K4 | 39 | | 79 | 4858 | | | | | | | |
| Third | 31 | T1 | 215 | | 75 | 4391 | 100 | | | 215 | | | |
| Inv. | | T2 | 216 | | 75 | 4452 | 113 | | | 257 | | | |
| Alloy | | K3 | 41 | | 75 | 4719 | | | | | | | |
| | | K4 | 42 | | 75 | 4918 | 120 | | | 248 | 89 | 73 | |
| CrZr—Cu | 52 | T1 | 217 | | 88 | 4670 | | | | 213 | 90 | 87 | |
| | | T2 | 218 | | 87 | 4895 | 99 | 15 | | 254 | 91 | 85 | 65 |

In the processes T1 and T2, solution-aging precipitation is performed. In the processes T1 and T2, an average grain size at the extruding completion is even larger than those in the processes K1 and K2. Tensile strength, Rockwell hardness, and conductivity in the processes T1 and T2 are equivalent to those in the processes K3 and K4. When the processes T1 and T2 are performed using Cr—Zr copper, an average grain size at the extruding completion is even larger as compared with the case of performing the processes K3 and K4 using the invention alloy, tensile strength and Rockwell hardness are slightly low, and conductivity is slightly high. In the general solution-aging precipitation material, grains are coarsened for heating at a high temperature for a long time in solution. On the other hand, Co, P, and the like are sufficiently made into solution, that is, solid-dissolved, and thus it is possible to obtain fine precipitates of Co, P, and the like, depending on the heat treatment thereafter, and aging precipitation, as compared with the embodiment. However, comparing strength after the cold wire drawing and the drawing thereafter, the strength is equivalent to or slightly lower than that of the invention alloy. It is considered that the reason is because the precipitation hardening of the solution-aging precipitation material is higher than that of the invention alloy, but the equivalent strength is exhibited due to minus offset as much as the grains are coarsened.

Tables 29 and 30 show a result in the process T3 together with the result in the process S6.

TABLE 29

| | | | | Extruding | | After Final Process | | | | | | |
|---|---|---|---|---|---|---|---|---|---|---|---|---|
| | | | | Completion | | | Precipitates | | | | | |
| | Alloy No. | Proc. No. | Test No. | Outer Diameter mm | Avg. Grain Size μm | Final Outer Diameter mm | Avg. Grain Diameter nm | Ratio of 30 nm or less % | Tensile Strength N/mm$^2$ | Vickers Hardness HV | Elongation % | Rockwell Hardness HRB |
| First | 12 | T3 | 221 | 11 | 130 | 2.8 | | | 527 | 153 | 3 | |
| Inv. | | S6 | 176 | 11 | 25 | 2.8 | | | 540 | 157 | 6 | |
| Alloy | | | | | | | | | | | | |
| Second | 24 | T3 | 222 | 11 | 120 | 2.8 | 2.4 | 100 | 563 | 160 | 3 | |
| Inv. | | S6 | 182 | 11 | 20 | 2.8 | 2.6 | 99 | 579 | 160 | 7 | |
| Alloy | | | | | | | | | | | | |
| Third | 36 | T3 | 223 | 11 | 110 | 2.8 | | | 585 | 162 | 3 | |
| Inv. | | S6 | 188 | 11 | 20 | 2.8 | | | 595 | 163 | 7 | |
| Alloy | | | | | | | | | | | | |

TABLE 30

| | | | | After Final Process | | | | | | | | | | |
|---|---|---|---|---|---|---|---|---|---|---|---|---|---|---|
| | | | | | | | After Heating 700° C. 120 sec | | | | | | | |
| | | | | | | | | | Avg. Grain Diameter | 400° C. High Temp. | After Cold Compression | | | |
| | Alloy No. | Proc. No. | Test No. | Repetitive Bending Times | Con-ductivity % IACS | Performance Index I | Vickers Hardness HV | Recrystal-lization Ratio % | of Precipitates Nm | Tensile Strength N/mm$^2$ | Rockwell Hardness HRB | Con-ductivity % IACS | Wear Loss mg |
| First Inv. Alloy | 12 | T3 | 221 | 16 | 77 | 4763 | | | | | | | |
| | | S6 | 176 | 18 | 77 | 5023 | | | | | | | |
| Second Inv. Alloy | 24 | T3 | 222 | 16 | 78 | 5121 | | | | | | | |
| | | S6 | 182 | 19 | 81 | 5576 | | | | | | | |
| Third Inv. Alloy | 36 | T3 | 223 | 18 | 75 | 5218 | | | | | | | |
| | | S6 | 188 | 20 | 75 | 5514 | | | | | | | |

The process T3 is a process of producing a wire subjected to solution-aging precipitation. In the process T3, an average grain size at the extruding completion is even larger than that in the process S6. Tensile strength, Vickers hardness, and conductivity in the process T3 are equivalent to those in the process S6, but elongation and repetitive bending in the process S6 are higher than those in the process T3. Similarly to the above-described processes T1 and T2, it is considered that the reason is because the precipitation effect in the process T3 is higher than that in the process S6, but the equivalent strength is exhibited due to minus offset as much as the grains are coarsened. However, elongation and repetitive bending are low since the grains are coarse.

Tables 31 and 32 show data at a head portion, a middle portion, and a tail portion at the same extruding, in the processes K1 and K3 of the invention alloy and Cr—Zr copper.

TABLE 31

| | | | | | | | After Final Process | | | | | | | |
|---|---|---|---|---|---|---|---|---|---|---|---|---|---|---|
| | | | | | Extruding Completion | | | Precipitates | | Tensile Strength Variation | | | | |
| | Alloy No. | Proc. No. | Extruding Length Position | Test No. | Outer Diameter mm | Avg. Grain Size μm | Final Outer Diam-eter mm | Avg. Grain Diam-eter nm | Ratio of 30 nm or less % | N/mm$^2$ | in Extruding Production Lot | Vickers Hardness HV | Elonga-tion % | Rockwell Hardness HRB |
| First Inv. Alloy | 11 | K1 | Head | 231 | 25 | 40 | 22 | | | 450 | 0.99 | 135 | 29 | 67 |
| | | | Middle | 1 | 25 | 35 | 22 | | | 448 | | 133 | 30 | 67 |
| | | | Tail | 232 | 25 | 35 | 22 | | | 444 | | 131 | 30 | 66 |
| | | K3 | Head | 233 | 25 | 40 | 25 | 3.0 | 100 | 396 | 0.98 | 111 | 38 | 56 |
| | | | Middle | 32 | 25 | 40 | 25 | 3.0 | 100 | 394 | | 110 | 39 | 56 |
| | | | Tail | 234 | 25 | 35 | 25 | 3.0 | 99 | 389 | | 110 | 40 | 55 |
| Second Inv. Alloy | 21 | K1 | Head | 235 | 25 | 40 | 22 | | | 443 | 0.99 | 127 | 30 | 66 |
| | | | Middle | 4 | 25 | 40 | 22 | | | 439 | | 125 | 30 | 66 |
| | | | Tail | 236 | 25 | 30 | 22 | | | 437 | | 125 | 29 | 64 |
| | | K3 | Head | 237 | 25 | 40 | 25 | 2.7 | 100 | 388 | 0.98 | 109 | 38 | 55 |
| | | | Middle | 38 | 25 | 40 | 25 | 2.6 | 100 | 386 | | 107 | 39 | 55 |
| | | | Tail | 238 | 25 | 30 | 25 | 2.8 | 99 | 381 | | 107 | 39 | 53 |
| Third Inv. Alloy | 31 | K1 | Head | 239 | 25 | 35 | 22 | | | 448 | 0.99 | 133 | 30 | 66 |
| | | | Middle | 8 | 25 | 35 | 22 | | | 449 | | 132 | 29 | 67 |
| | | | Tail | 240 | 25 | 25 | 22 | | | 443 | | 132 | 30 | 65 |
| | | K3 | Head | 241 | 25 | 35 | 25 | 2.8 | 100 | 395 | 0.99 | 111 | 38 | 57 |
| | | | Middle | 41 | 25 | 35 | 25 | 2.8 | 100 | 392 | | 108 | 39 | 56 |
| | | | Tail | 242 | 25 | 25 | 25 | 3.0 | 99 | 391 | | 110 | 39 | 55 |
| CrZr—Cu | 52 | K1 | Head | 24 | 25 | 80 | 22 | | | 438 | 0.8 | 128 | 22 | 63 |
| | | | Tail | 243 | 25 | Partly Non-recrystal-lized | 22 | | | 349 | | 102 | 23 | 48 |
| | | K3 | Head | 58 | 25 | 80 | 25 | | | 372 | 0.77 | 106 | 33 | 50 |
| | | | Tail | 244 | 25 | Partly Non-recrystal-lized | 25 | | | 285 | | 71 | 42 | 33 |

TABLE 32

| | | | | | Conductivity | | | After Heating 700° C. 120 sec | | | | |
|---|---|---|---|---|---|---|---|---|---|---|---|---|
| | Alloy No. | Proc. No. | Extruding Length Position | Test No. | % IACS | Variation in Extruding Production Lot | Per-form-ance Index I | Vickers Hardness HV | Recrystallization Ratio % | Conductivity % IACS | Avg. Grain Diameter of Precipitates nm | Ratio of Precipitates of 30 nm or less % |
| First | 11 | K1 | Head | 231 | 79 | 0.99 | 5160 | 122 | 10 | | | |
| Inv. | | | Middle | 1 | 79 | | 5176 | 121 | 10 | 71 | 4.8 | 99 |
| Alloy | | | Tail | 232 | 80 | | 5163 | 118 | 10 | | | |
| | | K3 | Head | 233 | 78 | 0.99 | 4826 | 103 | | 70 | 5.0 | 99 |
| | | | Middle | 32 | 79 | | 4868 | 102 | | 71 | 5.2 | 100 |
| | | | Tail | 234 | 79 | | 4841 | 101 | | 70 | 5.3 | 99 |
| Second | 21 | K1 | Head | 235 | 79 | 0.99 | 5119 | | | | | |
| Inv. | | | Middle | 4 | 80 | | 5104 | 111 | 10 | 72 | 4.7 | 99 |
| Alloy | | | Tail | 236 | 80 | | 5042 | | | | | |
| | | K3 | Head | 237 | 79 | 0.99 | 4759 | | | | | |
| | | | Middle | 38 | 80 | | 4799 | | | 71 | 4.8 | 100 |
| | | | Tail | 238 | 79 | | 4707 | | | | | |
| Third | 31 | K1 | Head | 239 | 76 | 0.99 | 5077 | | | | | |
| Inv. | | | Middle | 8 | 77 | | 5083 | 115 | 15 | 69 | 5.0 | 100 |
| Alloy | | | Tail | 240 | 76 | | 5021 | | | | | |
| | | K3 | Head | 241 | 75 | 0.99 | 4721 | 102 | | | | |
| | | | Middle | 41 | 75 | | 4719 | 100 | | | 5.4 | 99 |
| | | | Tail | 242 | 76 | | 4738 | 100 | | | | |
| CrZr—Cu | 52 | K1 | Head | 24 | 87 | 0.95 | 4984 | 92 | 30 | | | |
| | | | Tail | 243 | 83 | | 3911 | 69 | 80 | | | |
| | | K3 | Head | 58 | 87 | 0.94 | 4615 | | | | | |
| | | | Tail | 244 | 82 | | 3665 | | | | | |

| | Alloy No. | Proc. No. | Extruding Length Position | Test No. | 400° C. High Temp. Tensile Strength N/mm$^2$ | After Cold Compression Rockwell Hardness HRB | After Cold Compression Conductivity % IACS | Wear Loss mg |
|---|---|---|---|---|---|---|---|---|
| First | 11 | K1 | Head | 231 | 278 | 91 | 77 | 63 |
| Inv. | | | Middle | 1 | 275 | 91 | 77 | 65 |
| Alloy | | | Tail | 232 | 270 | 91 | 77 | 72 |
| | | K3 | Head | 233 | 224 | 90 | 77 | |
| | | | Middle | 32 | 229 | 90 | 77 | |
| | | | Tail | 234 | 222 | 90 | 77 | |
| Second | 21 | K1 | Head | 235 | 262 | 90 | 77 | |
| Inv. | | | Middle | 4 | 267 | 90 | 77 | 76 |
| Alloy | | | Tail | 236 | 258 | 90 | 77 | |
| | | K3 | Head | 237 | | 89 | 77 | |
| | | | Middle | 38 | | 89 | 77 | |
| | | | Tail | 238 | | 89 | 77 | |
| Third | 31 | K1 | Head | 239 | | | | |
| Inv. | | | Middle | 8 | 258 | | | |
| Alloy | | | Tail | 240 | | | | |
| | | K3 | Head | 241 | 218 | 89 | 73 | 72 |
| | | | Middle | 41 | | | | |
| | | | Tail | 242 | 215 | 89 | 73 | 75 |
| CrZr—Cu | 52 | K1 | Head | 24 | 234 | 90 | 85 | 70 |
| | | | Tail | 243 | 167 | 86 | 80 | 254 |
| | | K3 | Head | 58 | 198 | | | |
| | | | Tail | 244 | 155 | | | |

In any one of the processes K1 and K3, Cr—Zr copper has a difference in an average grain size at the extruding completion at the head portion and the tail portion, and a large difference in mechanical characteristics such as tensile strength was found. In any one of the processes K1 and K3, the invention alloy has a little difference in an average grain size at the extruding completion at the head portion, the middle portion, and the tail portion, and mechanical characteristics such as tensile strength were uniform. In the invention alloy, there is a little variation in extruding production lot of mechanical characteristics.

In the above-described examples, pipes, rods, or wires were obtained, in which substantially circular or substantially oval fine precipitates are uniformly dispersed, an average grain diameter of the precipitates is 1.5 to 20 nm, or at least 90% of the total precipitates have a size of 30 nm or less, an average grain diameter of most of the precipitates is in the preferable range of 1.5 to 20 nm, and at least 90% of the total precipitates have a size of 30 nm or less (see Test No. 32 and 34 in Tables 11 and 12, and transmission electron microscope image in FIG. 10, etc.).

Pipes, rods, or wires were obtained in which an average grain size at the extruding completion is 5 to 75 μm (see Test No. 1, 2, and 3 in Tables 8 and 9, etc.).

Pipes, rods, or wires were obtained in which a total processing rate of the cold drawing/wire drawing process until the heat treatment TH1 after the hot extruding is over 75%, a recrystallization ratio of matrix in a metal structure after the heat treatment TH1 is 45% or lower, and an average grain size of the recrystallized part is 0.7 to 7 μm (see Test No. 321 and 322 in Tables 23 and 24, etc.).

Pipes, rods, or wires were obtained in which a ratio of (minimum tensile strength/maximum tensile strength) in variation of tensile strength in an extruding production lot is 0.9 or higher, and a ratio of (minimum conductivity/maximum conductivity) in variation of conductivity is 0.9 or higher (see Test No. 231, 1, and 232 in Tables 31 and 32, etc.).

Pipes, rods, or wires were obtained in which conductivity is 45 (% IACS) or higher, and a value of the performance index I is 4300 or more (see Test No. 1 to 3 in Tables 8 and 9, Test No. 171 to 188 and Test No. 321 to 337 in Tables 23 and 24, Test No. 201 to 206, and 313 in Tables 25 and 26, etc.). In addition, pipes, rods, or wires were obtained in which conductivity is 65 (% IACS) or higher, and a value of the performance index I is 4300 or more (see Test No. 1 and 2 in Tables 8 and 9, Test No. 171 to 188, and Test No. 321 to 337 in Tables 23 and 24, Test No. 201 to 206, and 313 in Tables 25 and 26, etc.).

Pipes, rods, or wires were obtained in which tensile strength at 400° C. is 200 ($N/mm^2$) or higher (see Test No. 1 in Tables 8 and 9, etc.).

Pipes, rods, or wires were obtained in which Vickers hardness (HV) after heating at 700° C. for 120 seconds is 90 or higher, or at least 80% of a value of Vickers hardness before the heating (see Test No. 1, 31, and 32 in Tables 11 and 12, etc.). In addition, precipitates in a metal structure after the heating become larger than those before the heating. However, an average grain diameter of the precipitates is 1.5 to 20 nm, or at least 90% of the total precipitates are 30 nm or less, a recrystallization ratio in the metal structure is 45% or lower, and excellent heat resistance was exhibited.

Wires were obtained in which flexibility is excellent by performing a heat treatment at 200 to 700° C. for 0.001 seconds to 240 minutes during and/or after the cold wire drawing process (see Test No. 172, 174, 175, and 176 in Tables 23 and 24, etc.).

Wires were obtained in which an outer diameter is 3 mm or less, and flexibility is excellent (see Tables 23 and 24).

The followings can be said from the above-described examples. In C1100, there are grains of $Cu_2O$, but the grains do not contribute to strength since the grains are as large as 2 μm, and an influence on the metal structure is small. For this reason, high-temperature strength is low, and a grain diameter is large. Accordingly, it cannot be said that repetitive bending workability is satisfactory (see Test No. G15 in Tables 6 and 7, Test No. 23 in Tables 8 and 9, etc.).

In Alloy No. 41 to 49 of the comparative alloy, Co, P, and the like do not satisfy the proper range, and balance of the combined amount is not satisfactory. Accordingly, diameters of the precipitates of Co, P, and the like are large, and the amount thereof is small. For this reason, sizes of recrystallized grains are large, strength, heat resistance, and high-temperature strength are low, and wear loss is large (see Test No. 14 to 22 in Tables 8 and 9, Test No. 48 to 57 in Tables 11 and 12, etc.).

In the comparative alloy, hardness is low although a cold compression is performed (see Test No. 14 to 18 in Tables 8 and 9, etc.). In the invention alloy, sizes of recrystallized grains are small. When solution is performed as much as the producing process according to the embodiment and then an aging process is performed, solid-dissolved Co, P, and the like are finely precipitated and high strength can be obtained. In addition, most of them are precipitated, and thus high conductivity is obtained. Since the precipitates are small, a repetitive bending property is excellent (see Test No. 1 to 13 in Tables 8 and 9, Test No. 31 to 47 in Tables 11 and 12, Test No. 171 to 188 in Tables 23 and 24, etc.).

In the invention alloy, Co, P, and the like are finely precipitated. Accordingly, movement of atoms is obstructed, heat resistance of matrix is also improved by Sn, there is a little structural variation even at a high temperature of 400° C., and high strength is obtained (see Test No. 1 and 4 in Tables 8 and 9, etc.).

In the invention alloy, tensile strength and hardness are high, and thus wear resistance is high and wear loss is small (see Test No. 1 to 6 in Tables 8 and 9, etc.).

In the invention alloy, strength of the final material is improved by performing a heat treatment at a low temperature in the course of the process. It is considered that the reason is because the heat treatment is performed after a high plasticity process, and thus atoms are rearranged according to atomic level. When the heat treatment at a low temperature is performed at the last, strength is slightly decreased, but excellent flexibility is exhibited. This phenomenon can not be seen in the known C1100. Accordingly, the invention alloy is very advantageous in the field in which flexibility is required.

When Cr—Zr copper was produced by the producing process according to the embodiment, a remarkable difference occurred in strength between the head portion and the tail portion of the extruding after aging, and strength of the tail portion is badly low. A ratio of the strength is about 0.8. In addition, characteristics other than heat resistance of the tail portion are deteriorated. On the other hand, in the invention alloy, a ratio of the strength is about 0.98, and uniform characteristics are exhibited (see Tables 31 and 32).

In addition, the invention is not limited to the configurations of the above-described various embodiments, and may be variously modified within the technical scope of the invention. For example, a washing process may be performed at any part in the course of the process.

INDUSTRIAL APPLICABILITY

As described above, the high performance copper pipe, rod, or wire according to the invention has high strength and high conductivity, and thus is suitable for connectors, bus bars, buss bars, relays, heat sinks, air conditioner pipes, and electric components (fixers, fasteners, electric wiring tools, electrodes, relays, power relays, connection terminals, male terminals, commutator segments, rotor bars or end rings of motors, etc.). In addition, flexibility is excellent, and thus it is most suitable for wire harnesses, robot cables, airplane cables, wiring materials for electronic devices, and the like. In addition, high-temperature strength, strength after high-temperature heating, wear resistance, and durability are excellent, and thus it is most suitable for wire cutting (electric discharging) lines, trolley lines, welding tips, spot welding tips, spot welding electrodes, stud welding base points, discharging electrodes, rotor bars of motors, and electric components (fixers, fasteners, electric wiring tools, electrodes, relays, power relays, connection terminals, male terminals, commutator segments, rotor bars, end rings, etc.), air conditioner pipes, pipes for freezers and refrigerators, and the like. In addition, workability such as forging and pressing is excellent, and thus it is most suitable for hot forgings, cold forgings, rolling threads, bolts, nuts, electrodes, relays, power relays, contact points, piping components, and the like.

The present application claims the priority of Japanese Patent Application 2008-087339, the entire contents of which is incorporated herein by reference.

The invention claimed is:

1. A copper alloy pipe, rod, or wire, having an alloy composition comprising:

0.13 to 0.33 mass % of Co;

0.044 to 0.097 mass % of P;

0.005 to 0.80 mass % of Sn;

0.00005 to 0.0050 mass % of O, wherein a content [Co] mass % of Co and a content [P] mass % of P satisfy a relationship of $2.9 \leq ([Co]-0.007)/([P]-0.008) \leq 6.1$;

the remainder includes Cu and inevitable impurities; and circular or oval fine precipitates are uniformly dispersed in the copper alloy, the precipitates comprise Co and P as main components, and an average grain diameter of the precipitates is 1.5 to 20 nm or at least 90% of the total precipitates have a size of 30 nm or less.

2. The copper alloy pipe, rod, or wire according to claim 1, wherein the alloy composition further comprises at least any one of 0.003 to 0.5 mass % of Zn, 0.002 to 0.2 mass % of Mg, 0.003 to 0.5 mass % of Ag, 0.002 to 0.3 mass % of Al, 0.002 to 0.2 mass % of Si, 0.002 to 0.3 mass % of Cr, and 0.001 to 0.1 mass % of Zr.

3. A copper alloy pipe, rod, or wire, having an alloy composition comprising:

0.13 to 0.33 mass % of Co;

0.044 to 0.097 mass % of P;

0.005 to 0.80 mass % of Sn;

0.00005 to 0.0050 mass % of O;

at least any one of 0.01 to 0.15 mass % of Ni and 0.005 to 0.07 mass % of Fe, wherein a content [Co] mass % of Co, a content [Ni] mass % of Ni, a content [Fe] mass % of Fe, and a content [P] mass % of P satisfy a relationship of $2.9 \leq ([Co]+0.85\times[Ni]+0.75\times[Fe]-0.007)/([P]-0.008) \leq 6.1$ and a relationship of $0.015 \leq 1.5\times[Ni]+3\times[Fe] \leq [Co]$;

the remainder includes Cu and inevitable impurities, and circular or oval fine precipitates are uniformly dispersed in the copper alloy, the precipitates comprise Co and P as main components and further comprise either one or both of Ni and Fe, and an average grain diameter of the precipitates is 1.5 to 20 nm or at least 90% of the total precipitates have a size of 30 nm or less.

4. The copper alloy pipe, rod, or wire according to claim 3, wherein the alloy composition further comprises at least any one of 0.003 to 0.5 mass % of Zn, 0.002 to 0.2 mass % of Mg, 0.003 to 0.5 mass % of Ag, 0.002 to 0.3 mass % of Al, 0.002 to 0.2 mass % of Si, 0.002 to 0.3 mass % of Cr, 0.001 to 0.1 mass % of Zr.

5. The copper alloy pipe, rod, or wire according to claim 1, made by a process wherein a billet is heated to 840 to 960° C. before a hot extruding process, and an average cooling rate from 840° C. after the hot extruding process or a temperature of an extruded material to 500° C. is 15° C./second or higher, and wherein a heat treatment at 375° C. to 630° C. for 0.5 to 24 hours is performed after the hot extruding process, or is performed before and after a cold drawing/wire drawing process or during the cold drawing/wire drawing process when the cold drawing/wire drawing process is performed after the hot extruding process.

6. The copper alloy pipe, rod, or wire according to claim 1, made by a process wherein an average grain size at the time of completing a hot extruding process is 5 to 75 μm.

7. The copper alloy pipe, rod, or wire according to claim 5, wherein when a total processing rate of the cold drawing/wire drawing process until the heat treatment after the hot extruding process is higher than 75%, a recrystallization ratio of matrix in a metal structure after the heat treatment is 45% or lower, and an average grain size of a recrystallized part is 0.7 to 7 μm.

8. The conductivity copper alloy pipe, rod, or wire according to claim 1, wherein a first ratio of minimum tensile strength/maximum tensile strength in variation of tensile strength in an extruding production lot is 0.9 or higher, and a second ratio of minimum conductivity/maximum conductivity in variation of conductivity is 0.9 or higher.

9. The copper alloy pipe, rod, or wire according to claim 1, wherein conductivity of the copper alloy is 45% IACS or higher, and a value of $R^{1/2}\times S\times(100+L)/100$ is 4300 or more, where R (% IACS) is conductivity, S ($N/mm^2$) is tensile strength, and L (%) is elongation.

10. The copper alloy pipe, rod, or wire according to claim 1, wherein the tensile strength of the copper alloy at 400° C. is 200 $N/mm^2$ or higher.

11. The copper alloy pipe, rod, or wire according to claim 1, wherein Vickers hardness (HV) after heating at 700° C. for 120 seconds is 90 or higher, or at least 80% of the Vickers hardness before the heating, and an average grain diameter of precipitates in a metal structure after the heating is 1.5 to 20 nm, or at least 90% of the total precipitates have a size of 30 nm or less, and a recrystallization ratio in the metal structure after the heating is 45% or lower.

12. The copper alloy pipe, rod, or wire according to claim 1, made by a process wherein the copper alloy pipe, rod or wire is cold forged or pressed.

13. The copper alloy wire according to claim 1, made by a process wherein a cold wire drawing process or a pressing process is performed on the alloy composition, and a heat treatment at 200 to 700° C. for 0.001 seconds to 240 minutes is performed during the cold wire drawing process or the pressing process and/or after the cold wire drawing process or the pressing process.

14. The copper alloy pipe, rod, or wire according to claim 2, made by a process wherein a billet is heated to 840 to 960° C. before a hot extruding process, and an average cooling rate from 840° C. after the hot extruding process or a temperature of an extruded material to 500° C. is 15° C./second or higher, and wherein a heat treatment at 375° C. to 630° C. for 0.5 to 24 hours is performed after the hot extruding process, or is performed before and after the cold drawing/wire drawing process or during the cold drawing/wire drawing process when a cold drawing/wire drawing process is performed after the hot extruding process.

15. The copper alloy pipe, rod, or wire according to claim 3, made by a process wherein a billet is heated to 840 to 960° C. before a hot extruding process, and an average cooling rate from 840° C. after the hot extruding process or a temperature of an extruded material to 500° C. is 15° C./second or higher, and wherein a heat treatment at 375° C. to 630° C. for 0.5 to 24 hours is performed after the hot extruding process, or is performed before and after the cold drawing/wire drawing process or during the cold drawing/wire drawing process when a cold drawing/wire drawing process is performed after the hot extruding process.

16. The copper alloy pipe, rod, or wire according to claim 4, made by a process wherein a billet is heated to 840 to 960° C. before a hot extruding process, and an average cooling rate from 840° C. after the hot extruding process or a temperature of an extruded material to 500° C. is 15° C./second or higher, and wherein a heat treatment at 375° C. to 630° C. for 0.5 to 24 hours is performed after the hot extruding process, or is performed before and after the cold drawing/wire drawing process or during the cold drawing/wire drawing process when a cold drawing/wire drawing process is performed after the hot extruding process.

17. The copper alloy pipe, rod, or wire according to claim 2, made by a process wherein an average grain size at the time of completing a hot extruding process is 5 to 75 μm.

18. The copper alloy pipe, rod, or wire according to claim 3, wherein an average grain size at the time of completing a hot extruding process is 5 to 75 μm.

19. The copper alloy pipe, rod, or wire according to claim 4, wherein an average grain size at the time of completing a hot extruding process is 5 to 75 μm.

20. The copper alloy pipe, rod, or wire according to claim 2, wherein a first ratio of minimum tensile strength/maximum tensile strength in variation of tensile strength in an extruding production lot is 0.9 or higher, and a second ratio of minimum conductivity/maximum conductivity in variation of conductivity is 0.9 or higher.

21. The copper alloy pipe, rod, or wire according to claim 3, wherein a first ratio of minimum tensile strength/maximum tensile strength in variation of tensile strength in an extruding production lot is 0.9 or higher, and a second ratio of minimum conductivity/maximum conductivity in variation of conductivity is 0.9 or higher.

22. The copper alloy pipe, rod, or wire according to claim 4, wherein a first ratio of minimum tensile strength/maximum tensile strength in variation of tensile strength in an extruding production lot is 0.9 or higher, and a second ratio of minimum conductivity/maximum conductivity in variation of conductivity is 0.9 or higher.

23. The conductivity copper alloy pipe, rod, or wire according to claim 2, wherein conductivity of the copper alloy is 45% IACS or higher, and a value of $R^{1/2} \times S \times (100+L)/100$ is 4300 or more, where R (% IACS) is conductivity, S ($N/mm^2$) is tensile strength, and L (%) is elongation.

24. The conductivity copper alloy pipe, rod, or wire according to claim 3, wherein conductivity of the copper alloy is 45% IACS or higher, and a value of $R^{1/2} \times S \times (100+L)/100$ is 4300 or more, where R (% IACS) is conductivity, S ($N/mm^2$) is tensile strength, and L (%) is elongation.

25. The copper alloy pipe, rod, or wire according to claim 4, wherein conductivity of the copper alloy is 45% IACS or higher, and a value of $R^{1/2} \times S \times (100+L)/100$ is 4300 or more, where R (% IACS) is conductivity, S ($N/mm^2$) is tensile strength, and L (%) is elongation.

26. The copper alloy pipe, rod, or wire according to claim 2, wherein Vickers hardness (HV) after heating at 700° C. for 120 seconds is 90 or higher, or at least 80% of the Vickers hardness before the heating, and an average grain diameter of precipitates in a metal structure after the heating is 1.5 to 20 nm, or at least 90% of the total precipitates have a size of 30 nm or less, and a recrystallization ratio in the metal structure after the heating is 45% or lower.

27. The copper alloy pipe, rod, or wire according to claim 3, wherein Vickers hardness (HV) after heating at 700° C. for 120 seconds is 90 or higher, or at least 80% of the Vickers hardness before the heating, and an average grain diameter of precipitates in a metal structure after the heating is 1.5 to 20 nm, or at least 90% of the total precipitates have a size of 30 nm or less, and a recrystallization ratio in the metal structure after the heating is 45% or lower.

28. The copper alloy pipe, rod, or wire according to claim 4, wherein Vickers hardness (HV) after heating at 700° C. for 120 seconds is 90 or higher, or at least 80% of the Vickers hardness before the heating, and an average grain diameter of precipitates in a metal structure after the heating is 1.5 to 20 nm, or at least 90% of the total precipitates have a size of 30 nm or less, and a recrystallization ratio in the metal structure after the heating is 45% or lower.

29. The copper alloy pipe, rod, or wire according to claim 2, made by a process wherein the copper alloy pipe, rod or wire is cold forged or pressed.

30. The copper alloy pipe, rod, or wire according to claim 3, made by a process wherein the copper alloy pipe, rod or wire is cold forged or pressed.

31. The copper alloy pipe, rod, or wire according to claim 4, made by a process wherein the copper alloy pipe, rod or wire is cold forged or pressed.

32. The copper alloy pipe, rod, or wire according to claim 1, wherein the Sn content is in a range of 0.005 to 0.095 mass %, and a conductivity is in a range of 65% IACS or more.

* * * * *